US006144398A

United States Patent [19]

Yokoyama et al.

[11] Patent Number: 6,144,398

[45] **Date of Patent: *Nov. 7, 2000**

[54] PROCESS CARTRIDGE AND ELECTROPHOTOGRAPHIC IMAGE FORMING APPARATUS

[75] Inventors: Katsunori Yokoyama, Susono; Kazushi Watanabe, Mishima; Yoshihiro Ito, Shizuoka-ken, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/186,646

[22] Filed: Nov. 6, 1998

[30] Foreign Application Priority Data

Nov. 7, 1997 [JP] Japan ..... 9-305746

[51] Int. Cl.[7] ..... B41J 2/435

[52] U.S. Cl. ..... 347/263; 347/138; 399/25; 399/111

[58] Field of Search ..... 347/138, 263; 399/25, 110, 111, 126, 114

[56] References Cited

U.S. PATENT DOCUMENTS

| | | | |
|---|---|---|---|
| 5,095,335 | 3/1992 | Watanabe et al. | 399/113 |
| 5,294,960 | 3/1994 | Nomura et al. | 399/113 |
| 5,331,372 | 7/1994 | Tsuda et al. | 399/114 |
| 5,345,294 | 9/1994 | Nomura et al. | 399/90 |
| 5,404,198 | 4/1995 | Noda et al. | 399/107 |
| 5,465,136 | 11/1995 | Watanabe | 399/111 |
| 5,470,635 | 11/1995 | Shirai et al. | 428/131 |
| 5,475,470 | 12/1995 | Sasago et al. | 399/111 |
| 5,488,459 | 1/1996 | Tsuda et al. | 399/167 |
| 5,510,878 | 4/1996 | Noda et al. | 399/111 |
| 5,559,581 | 9/1996 | Sugiura et al. | 399/111 |
| 5,583,613 | 12/1996 | Kobayashi et al. | 399/111 |
| 5,602,623 | 2/1997 | Nishibata et al. | 399/111 |
| 5,608,509 | 3/1997 | Shirai et al. | 399/351 |
| 5,623,328 | 4/1997 | Tsuda et al. | 399/111 |
| 5,638,161 | 6/1997 | Numagami et al. | 399/111 |
| 5,640,650 | 6/1997 | Watanabe et al. | 399/117 |
| 5,659,847 | 8/1997 | Tsuda et al. | 399/113 |
| 5,669,042 | 9/1997 | Kobayashi et al. | 399/111 |
| 5,768,658 | 6/1998 | Watanabe et al. | 399/111 |
| 5,828,928 | 10/1998 | Sasago et al. | 399/111 |
| 5,878,304 | 3/1999 | Watanabe et al. | 399/92 |
| 5,884,124 | 3/1999 | Karakama et al. | 399/123 |

*Primary Examiner*—N. Le
*Assistant Examiner*—Hai C. Pham
*Attorney, Agent, or Firm*—Fitzpatrick, Cella, Harper & Scinto

[57] ABSTRACT

A process cartridge is detachably mountable on a main assembly of an electrophotographic image forming apparatus a laser beam emitter, a laser shutter, and a mover. The process cartridge includes a cartridge frame; an electrophotographic photosensitive member; a process device acting to the electrophotographic photosensitive member; a first contact part provided on the cartridge frame to determine the position of the process cartridge relative to the main assembly of the apparatus by contacting a fixing member provided on the main assembly of the apparatus in mounting the process cartridge to the main assembly of the apparatus; and a second contact part provided on the cartridge frame adjacent to the first contact part and contacting with the mover to move the laser shutter from the shutting position to the opening position in mounting step of the process cartridge to the main assembly of the apparatus.

25 Claims, 34 Drawing Sheets

PROCESS CARTRIDGE AND ELECTROPHOTOGRAPHIC IMAGE FORMING APPARATUS

BACKGROUND OF THE INVENTION

1. Field of the Invention

The present invention relates to a process cartridge and electrophotographic image forming apparatus using the same.

2. Related Background Art

Here, the electrophotographic image forming apparatus forms an image on a recording material using an electrophotographic image formation process. Examples of the electrophotographic image forming apparatus includes an electrophotographic copying machine, an electrophotographic printer (laser beam printer, LED printer or the like), a facsimile machine and a word processor or the like.

The process cartridge contains, integrally, an electrophotographic photosensitive member and charging means, developing means or cleaning means, and is detachably mountable relative to a main assembly of the image forming apparatus. It may integrally contain the electrophotographic photosensitive member and at least one of the charging means, the developing means and the cleaning means. As another example, it may contain the electrophotographic photosensitive member and at least the developing means.

In an electrophotographic image forming apparatus using an electrophotographic image forming process, the process cartridge is used, which contains the electrophotographic photosensitive member and process means actable on the electrophotographic photosensitive member, and which is detachably mountable as a unit to a main assembly of the image forming apparatus (process cartridge type). With this process cartridge type, the maintenance of the apparatus can be carried out in effect by the user without depending on a serviceman. Therefore, this process-cartridge type is now widely used in electrophotographic image forming apparatuses.

In the electrophotographic image forming using such process cartridge, a shutter function, for preventing the laser beam from leaking out of the main body of apparatus when the process cartridge is not mounted on the main body, is added.

The present invention is directed to a further improvement of such a process cartridge.

SUMMARY OF THE INVENTION

The purpose of the invention is to provide a process cartridge capable of more accurate opening of a laser shutter and an electrophotographic image forming apparatus detachably mountable of the process cartridge and fitting the process cartridge to the main assembly of the electrophotographic image forming apparatus.

Another purpose of the invention is to provide a process cartridge which has an improved fitting operation in fitting the process cartridge to main assembly of the apparatus.

A further purpose of the invention is to provide a process cartridge which has a first contacting part provided on the cartridge frame to determine the position of the process cartridge to the main assembly of the apparatus by contacting a fixing member provided on the main assembly of the apparatus in fitting the process cartridge to main assembly of the apparatus, and a second contacting part provided on the cartridge frame in parallel to the contacting part of the first contacting part to move a laser shutter from the shutting position to an opening position in the process of fitting the process cartridge to main assembly of the apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Next, desirable embodiments of the present invention will be described. In the following description, the "widthwise" direction of a process cartridge B refers to the direction in which the process cartridge B is installed into, or removed from, the main assembly of an image forming apparatus, and coincides with the direction in which a recording medium is conveyed. The "lengthwise" direction of the process cartridge B refers to a direction which intersects (substantially perpendicular to) the direction in which the process cartridge B is installed into, or removed from, the main assembly 14. It is parallel to the surface of the recording medium, and intersects (substantially perpendicular to) the direction in which the recording medium is conveyed. Further, the terms "left" or "right" refers to the left or right directions, relatively relative to the direction in which the recording medium is conveyed, as seen from above.

Figure 1:
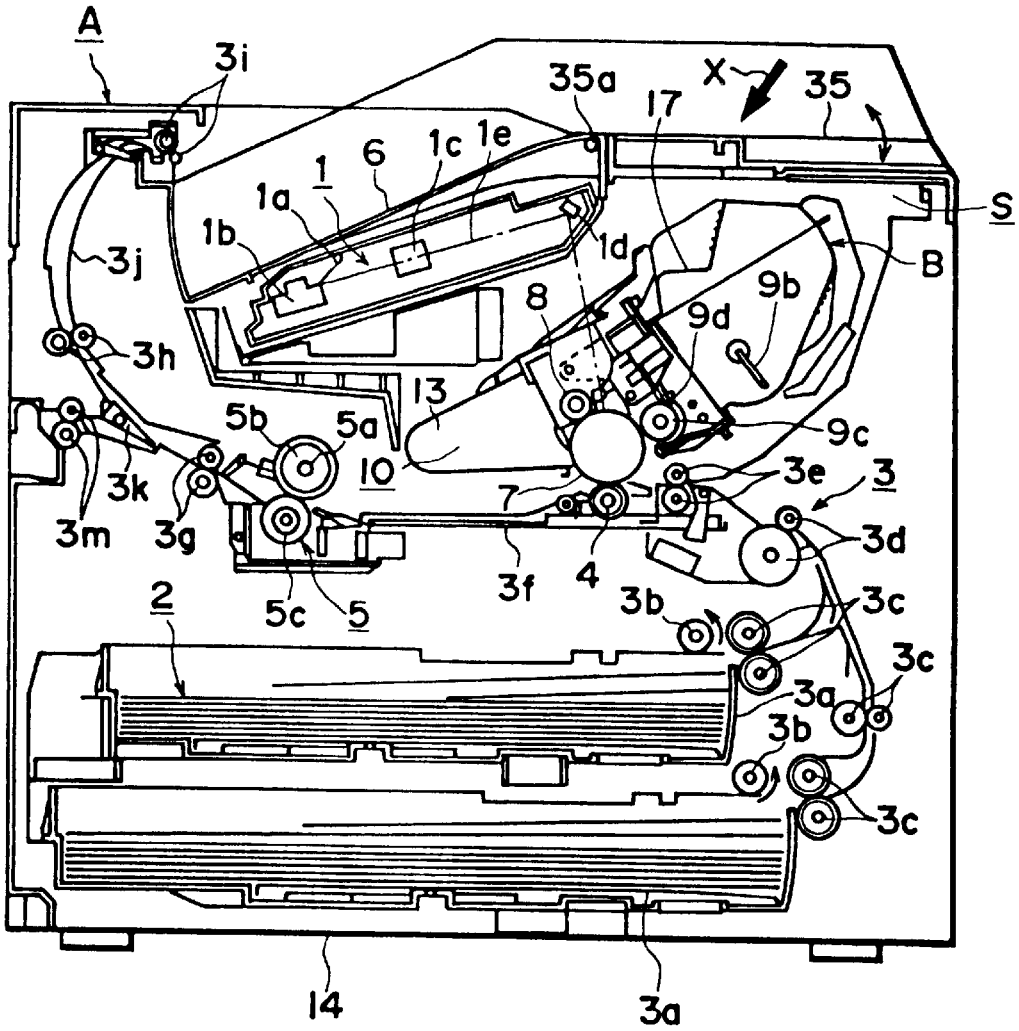
FIG. 1 is a vertical section of an electrophotographic image forming apparatus.
Figure 2:
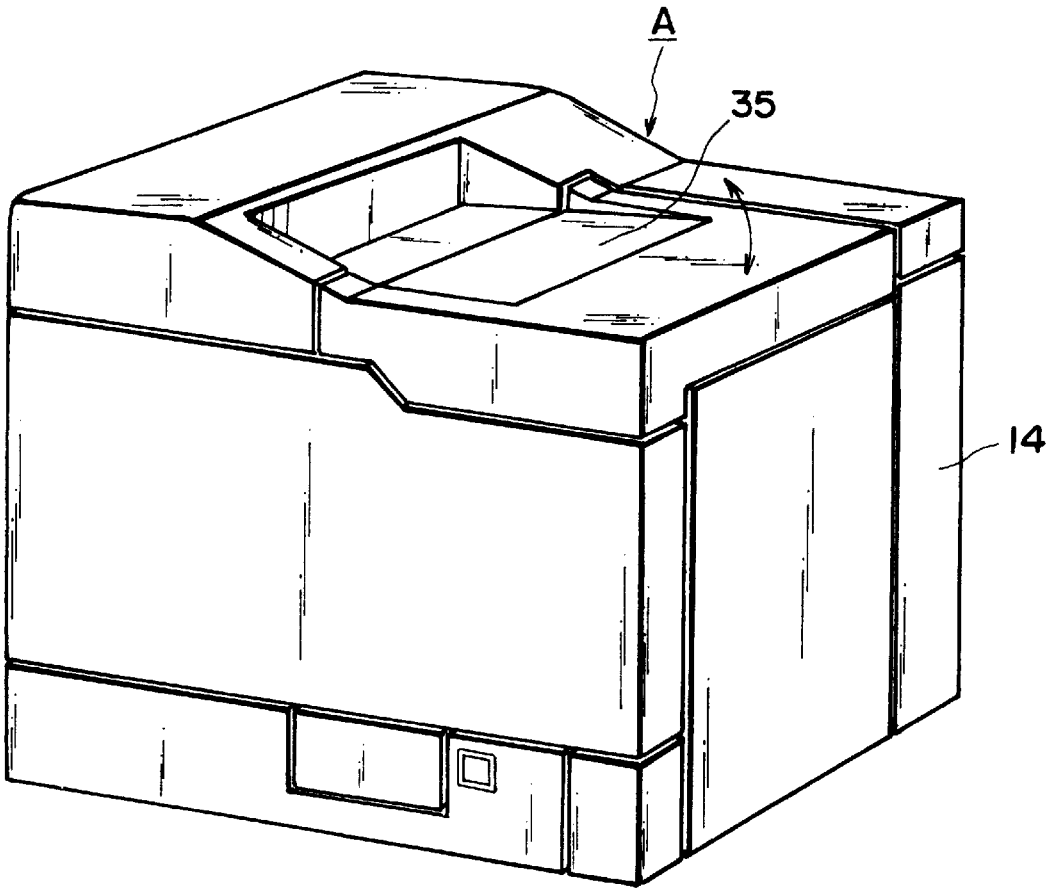
FIG. 2 is an external perspective view of the apparatus illustrated in FIG. 1.
Figure 3:
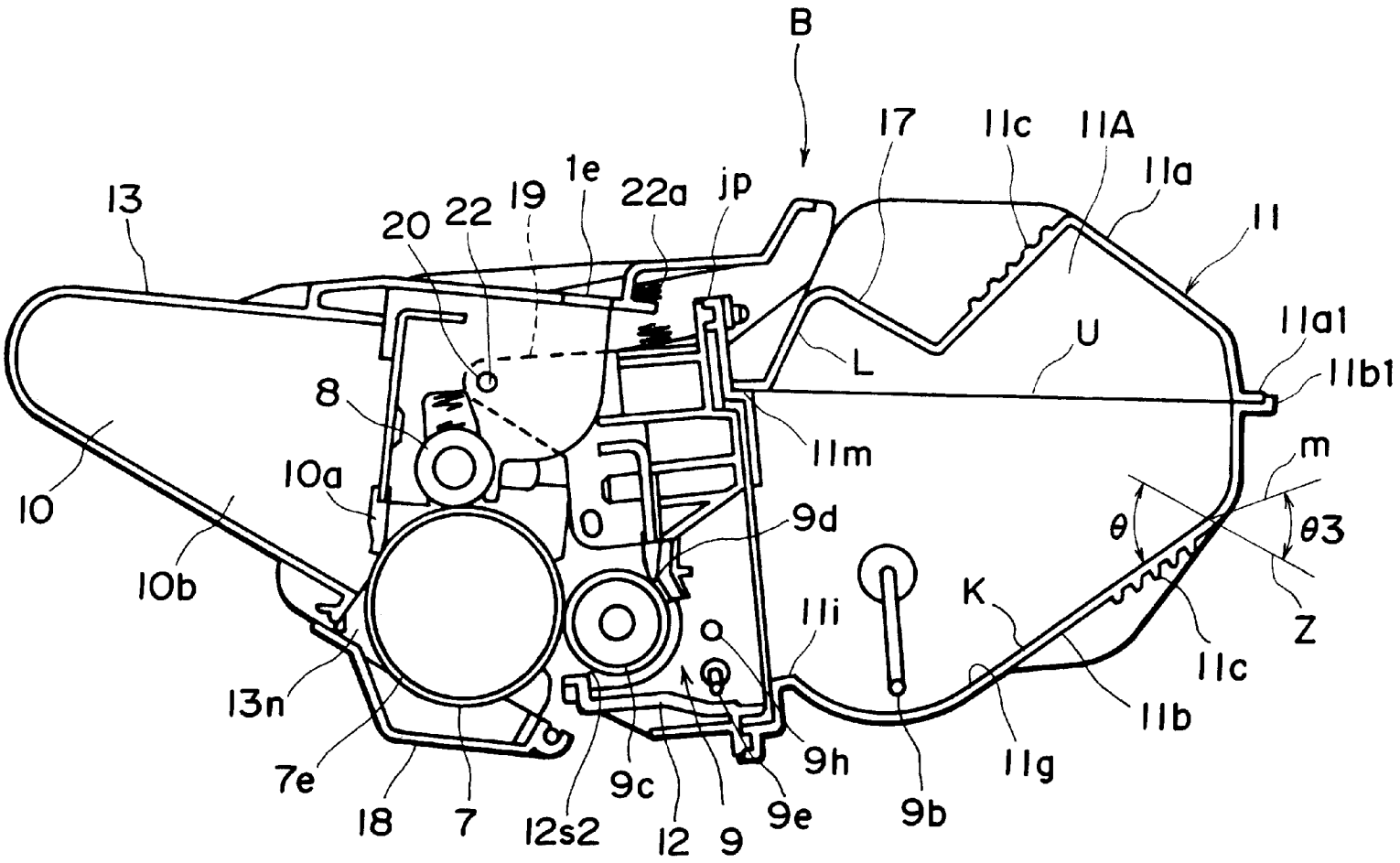
FIG. 3 is a cross-section of a process cartridge.
Figure 4:
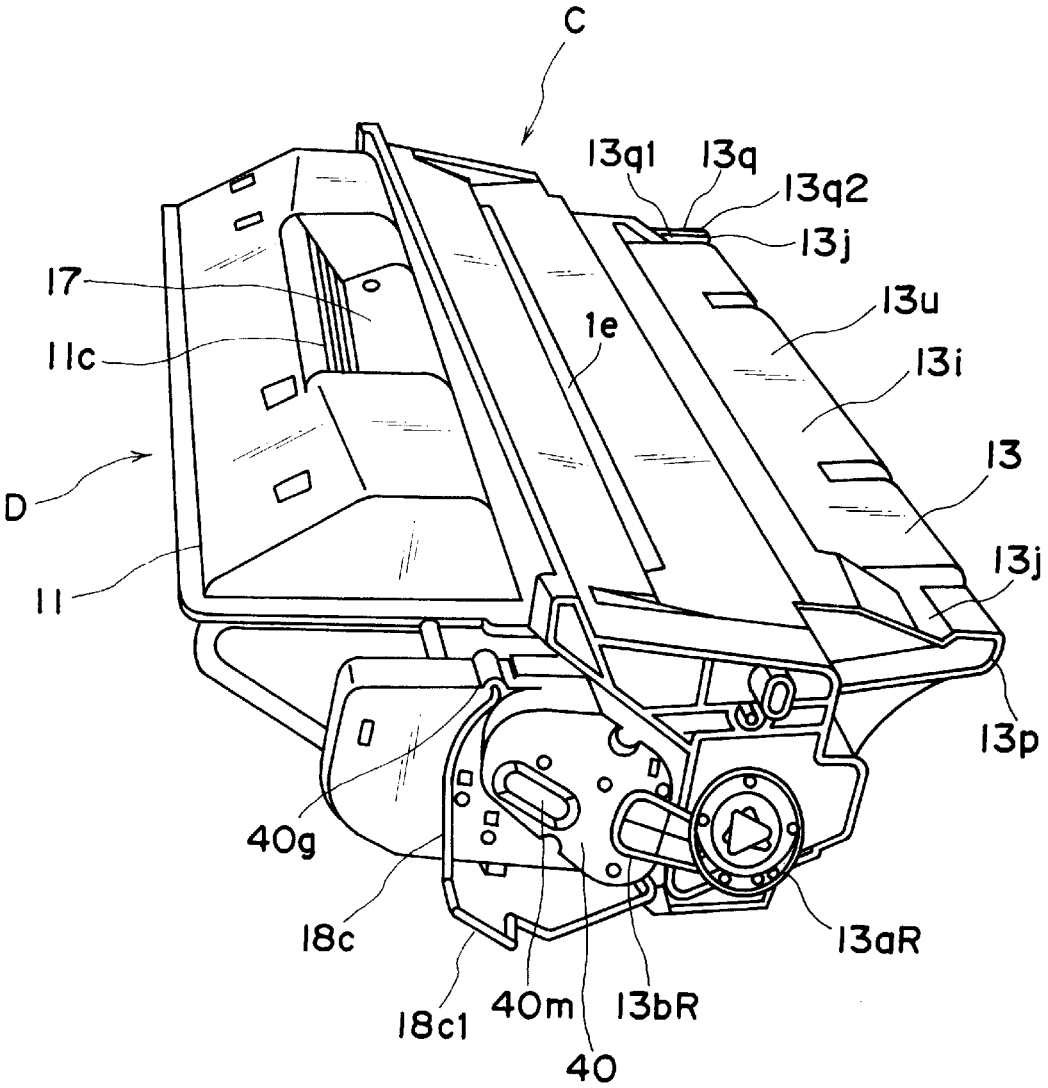
FIG. 4 is an external perspective view of the process cartridge illustrated in FIG. 3, as seen from the top right direction.
Figure 5:
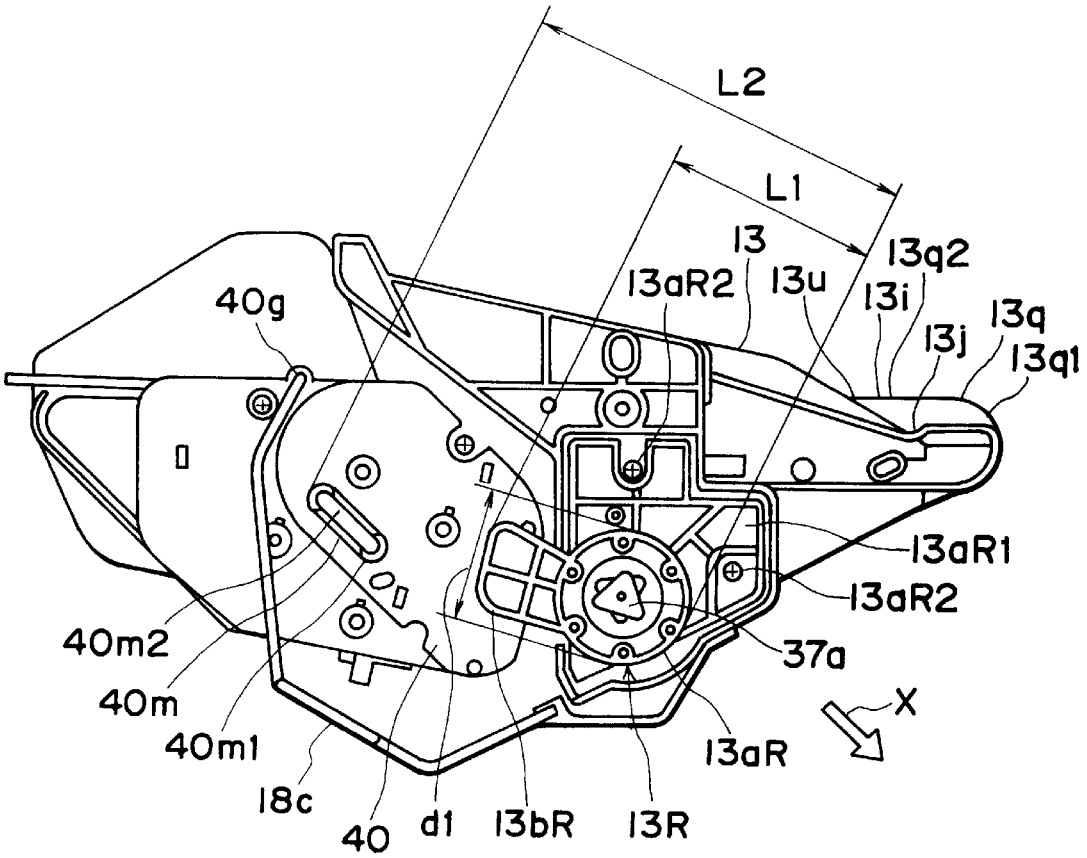
FIG. 5 is the right-hand side view of the process cartridge illustrated in FIG. 3.
Figure 6:
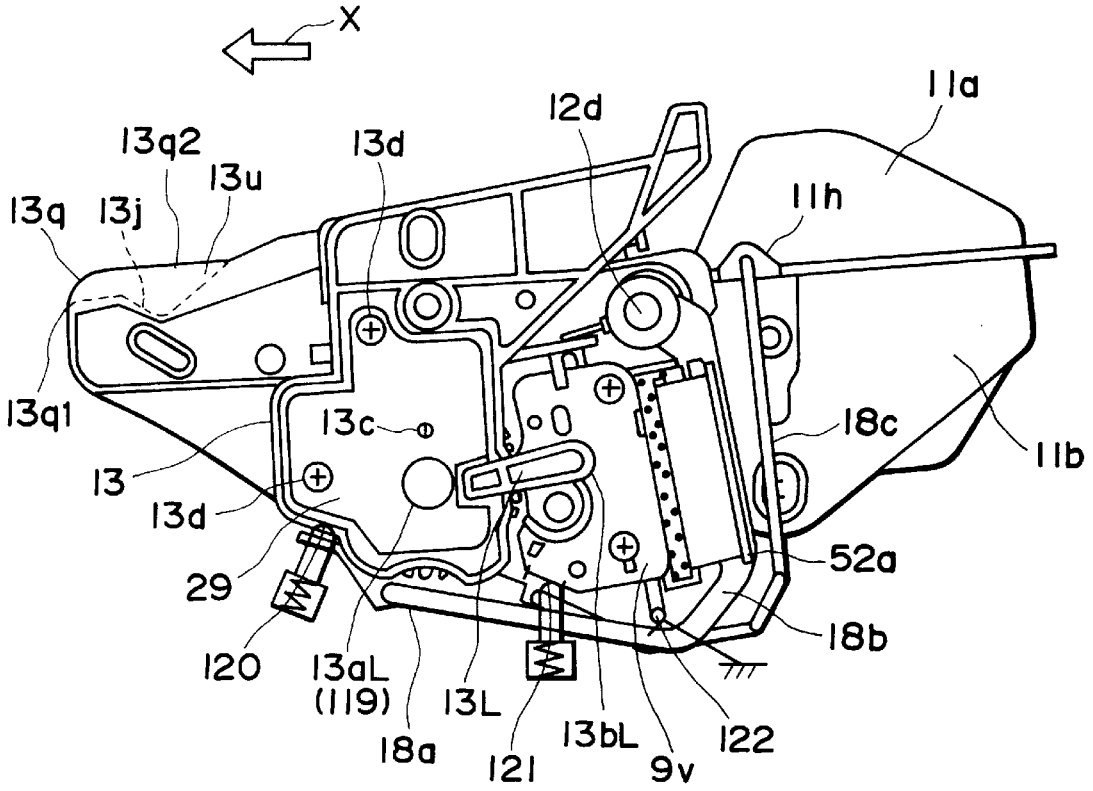
FIG. 6 is the left-hand side view of the process cartridge illustrated in FIG. 3.
Figure 7:
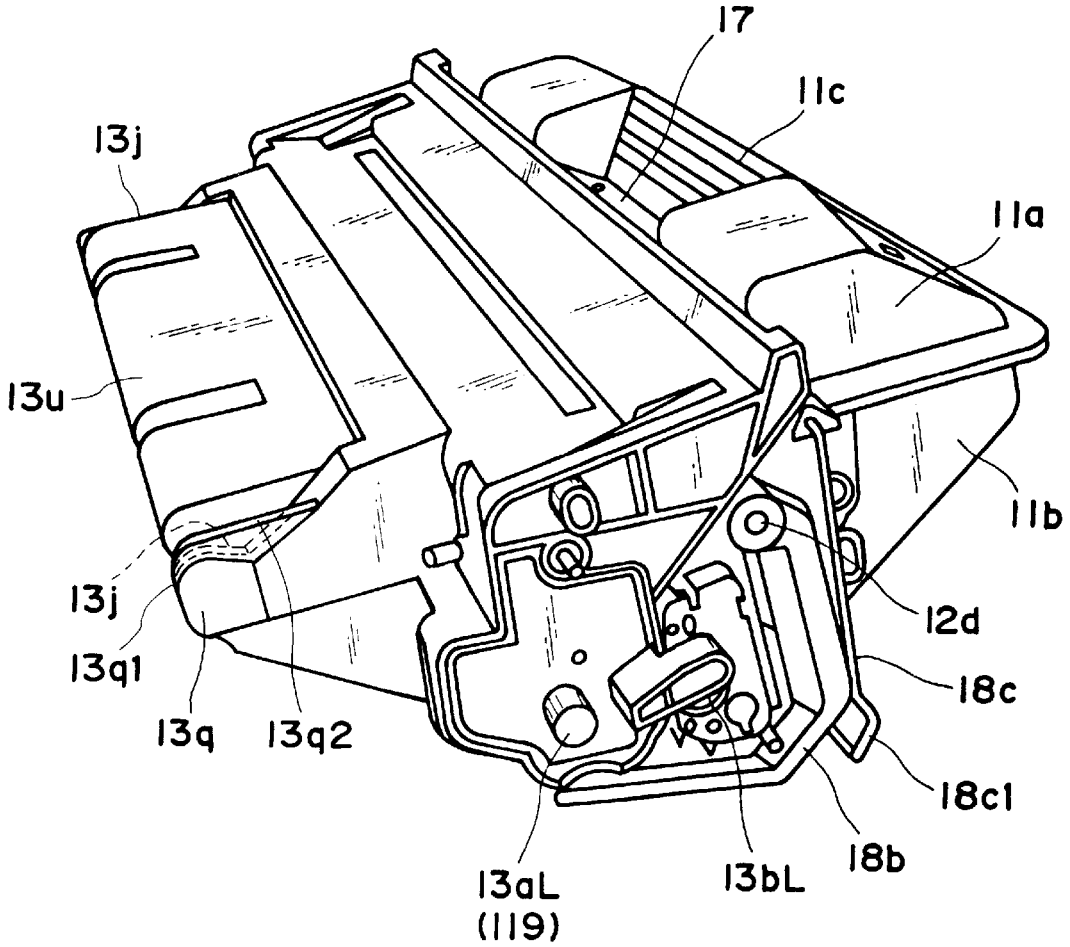
FIG. 7 is an external perspective view of the process cartridge illustrated in FIG. 3, as seen from the top left direction.
Figure 8:
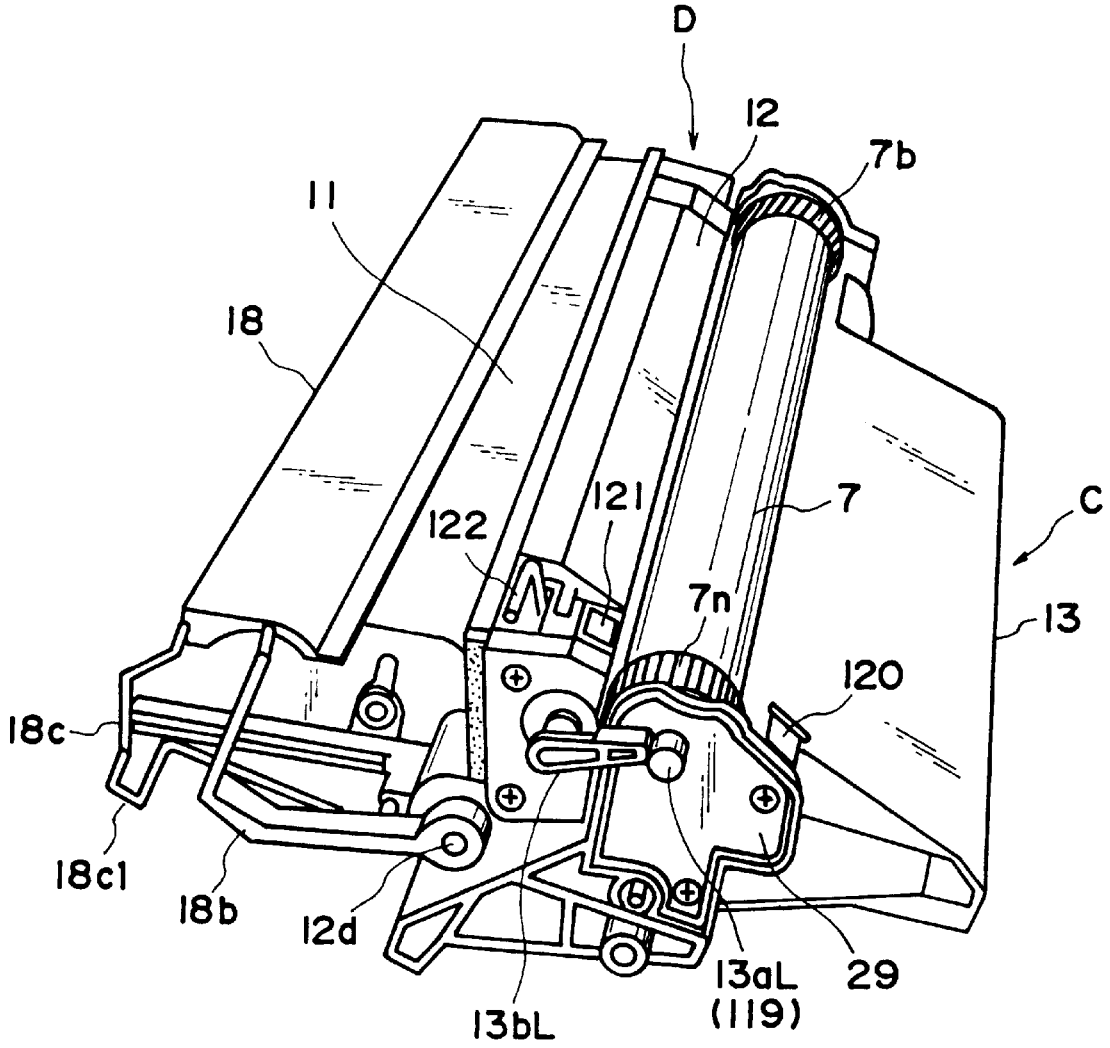
FIG. 8 is an external perspective view of the bottom left side of the process cartridge illustrated in FIG. 3.

FIG. 1 is an electrophotographic image forming apparatus (laser beam printer) which embodies the present invention, depicting the general structure thereof; FIG. 2 is an external perspective thereof; and FIGS. 3 to 8 are drawings of process cartridges which embody the present invention. More specifically, FIG. 3 is a cross-section of a process cartridge; FIG. 4 is an external perspective view of the process cartridge; FIG. 5 is a right-hand side view of the process cartridge; FIG. 6 is a left-hand side view of the process cartridge; FIG. 7 is a perspective view of the process cartridge as seen from the top left direction; and FIG. 8 is a perspective view of the process cartridge as seen from the bottom left direction. In the following description, the "top" surface of the process cartridge B refers to the surface which faces upward when the process cartridge B is in the main assembly 14 of the image forming apparatus, and the "bottom" surface refers to the surface which faces downward.

I. Electrophotographic Image Forming Apparatus A and Process Cartridge B

First, referring to FIGS. 1 and 2, a laser beam printer A as an electrophotographic image forming apparatus which embodies the present invention will be described. FIG. 3 is a cross-section of a process cartridge which also embodies the present invention.

Referring to FIG. 1, the laser beam printer A is an apparatus which forms an image on a recording medium (for example, recording sheet, OHP sheet, and fabric) through an electrophotographic image forming process. It forms a toner image on an electrophotographic photosensitive drum (hereinafter, photosensitive drum) in the form of a drum. More specifically, the photosensitive drum is charged with the use of a charging means, and a laser beam modulated with the image data of a target image is projected from an optical means onto the charged peripheral surface of the photosensitive drum, forming thereon a latent image in accordance with the image data. This latent image is developed into a toner image by a developing means. Meanwhile, a recording medium 2 placed in a sheet feeding cassette 3*a* is reversed and conveyed by a pickup roller 3*b*, a conveyer roller pairs 3*c* and 3*d*, and register roller pair 3*e*, in synchronism with the toner formation. Then, voltage is applied to an image transferring roller 4 as a means for transferring the toner image formed on the photosensitive drum 7 of the process cartridge B, whereby the toner image is transferred onto the recording medium 2. Thereafter, the recording medium 2, onto which the toner image has been transferred, is conveyed to a fixing means 5 by guiding conveyer 3*f*. The fixing means 5 has a driving roller 5*c*, and a fixing roller 5*b* containing a heater 5*a*, and applies heat and pressure to the recording medium 2 as the recording medium 2 is passed through the fixing means 5, so that the image having been transferred onto the recording medium 2 is fixed to the recording medium 2. Then, the recording medium 2 is conveyed farther, and is discharged into a delivery tray 6 through a reversing path 3*j*, by discharging roller pairs 3*q*, 3*h* and 3*i*. The delivery tray 6 is located at the top of the main assembly 14 of the image forming apparatus A. It should be noted here that a pivotable flapper 3*k* may be operated in coordination with a discharge roller pair 2*m* to discharge the recording medium 2 without passing it through the reversing path 3*j*. The pickup roller 3*b*, the conveyer roller pairs 3*c* and 3*d*, the register roller pair 3*e*, the guiding conveyer 3*f*, the discharge roller pairs 3*g*, 3*h* and 3*i*, and the discharge roller pair 3*m* constitute a conveying means 3.

Referring to FIGS. 3 to 8, in the process cartridge B, on the other hand, the photosensitive drum 7 with a photosensitive layer 7*e* (FIG. 11) is rotated to uniformly charge its surface by applying voltage to the charging roller 8 as a photosensitive drum charging means. Then, a laser beam modulated with the image data is projected onto the photosensitive drum 7 from the optical system 1 through an exposure opening 1*e*, forming a latent image on the photosensitive drum 7. The thus formed latent image is developed with the use of toner and the developing means 9. More specifically, the charging roller 8 is disposed in contact with the photosensitive drum 7 to charge the photosensitive drum 7. It is rotated by the rotation of the photosensitive drum 7. The developing means 9 provides the peripheral surface area (area to be developed) of the photosensitive drum 7 with toner so that the latent image formed on the photosensitive drum 7 is developed. The optical system 1 comprises a laser diode 1*a*, a polygon mirror 1*b*, a lens 1*c*, and a deflective mirror 1*d*.

In the developing means 9, the toner contained in a toner container 11A is delivered to an developing roller 9*c* by the rotation of a toner feeding member 9*b*. The developing roller 9*c* contains a stationary magnet. It is also rotated so that a layer of toner with triboelectric charge is formed on the peripheral surface of the developing roller 9*c*. The image developing area of the photosensitive drum 7 is provided with the toner from this toner layer, the toner is transferred onto the peripheral surface of the photosensitive drum 7 in a manner to reflect the latent image, visualizing the latent image as a toner image. The developing blade 9*d* is a blade which regulates the amount of the toner adhered to the peripheral surface of the developing roller 9*c* and also triboelectrically charges the toner. Adjacent to the developing roller 9*c*, a toner stirring member 9*c* is rotatively disposed to circulatively stir the toner within the image developing chamber.

After the toner image formed on the photosensitive drum 7 is transferred onto the recording medium 2 by applying voltage with a polarity opposite to that of the toner image to the image transferring roller 4, the residual toner on the photosensitive drum 7 is removed by the cleaning means 10. The cleaning means 10 comprises an elastic cleaning blade 10*a* disposed in contact with the photosensitive drum 7, and the toner remaining on the photosensitive drum 7 is scraped off by the elastic cleaning blade 10*a*, being collected into a waste toner collector 10*b*.

The process cartridge B is formed in the following manner. First, a toner chamber frame 11 which comprises a toner container (toner storing portion) 11A for storing toner is joined with an image developing chamber frame 12 which houses the image developing means 9, such as an image developing roller 9*c*, and then, a cleaning chamber frame 13, in which the photosensitive drum 7, the cleaning means 10 such as the cleaning blade 10*a*, and the charging roller 8 are mounted, is joined with the preceding two frames 11 and 12 to complete the process cartridge B. The thus formed process cartridge B is removably installable into the main assembly 14 of the image forming apparatus A.

The process cartridge B is provided with an exposure opening through which a light beam modulated with image data is projected onto the photosensitive drum 7, and a transfer opening 13*n* through which the photosensitive drum 7 opposes the recording medium 2. The exposure opening 1*e* is a part of the cleaning chamber frame 11, and the transfer opening 13*n* is located between the image developing chamber frame 12 and the cleaning chamber frame 13.

Next, the structure of the housing of the process cartridge B in this embodiment will be described.

The process cartridge in this embodiment is formed in the following manner. First the toner chamber frame 11 and the image developing chamber frame 12 are joined, and then, the cleaning chamber frame 13 is rotatively joined with the preceding two frames 11 and 12 to complete the housing. In this housing, the aforementioned photosensitive drum 7, the charging roller 8, the developing means 9, the cleaning means 10, and the like, are mounted to complete the process cartridge B. The thus formed process cartridge B is removably installable into the cartridge accommodating means provided in the main assembly 14 of an image forming apparatus.

II. Housing Structure of Process Cartridge B

As described above, the housing of the process cartridge B in this embodiment is formed by joining the toner chamber frame 11, the image developing chamber frame 12, and the cleaning chamber frame 13. Next, the structure of the thus formed housing will be described.

Figure 13:
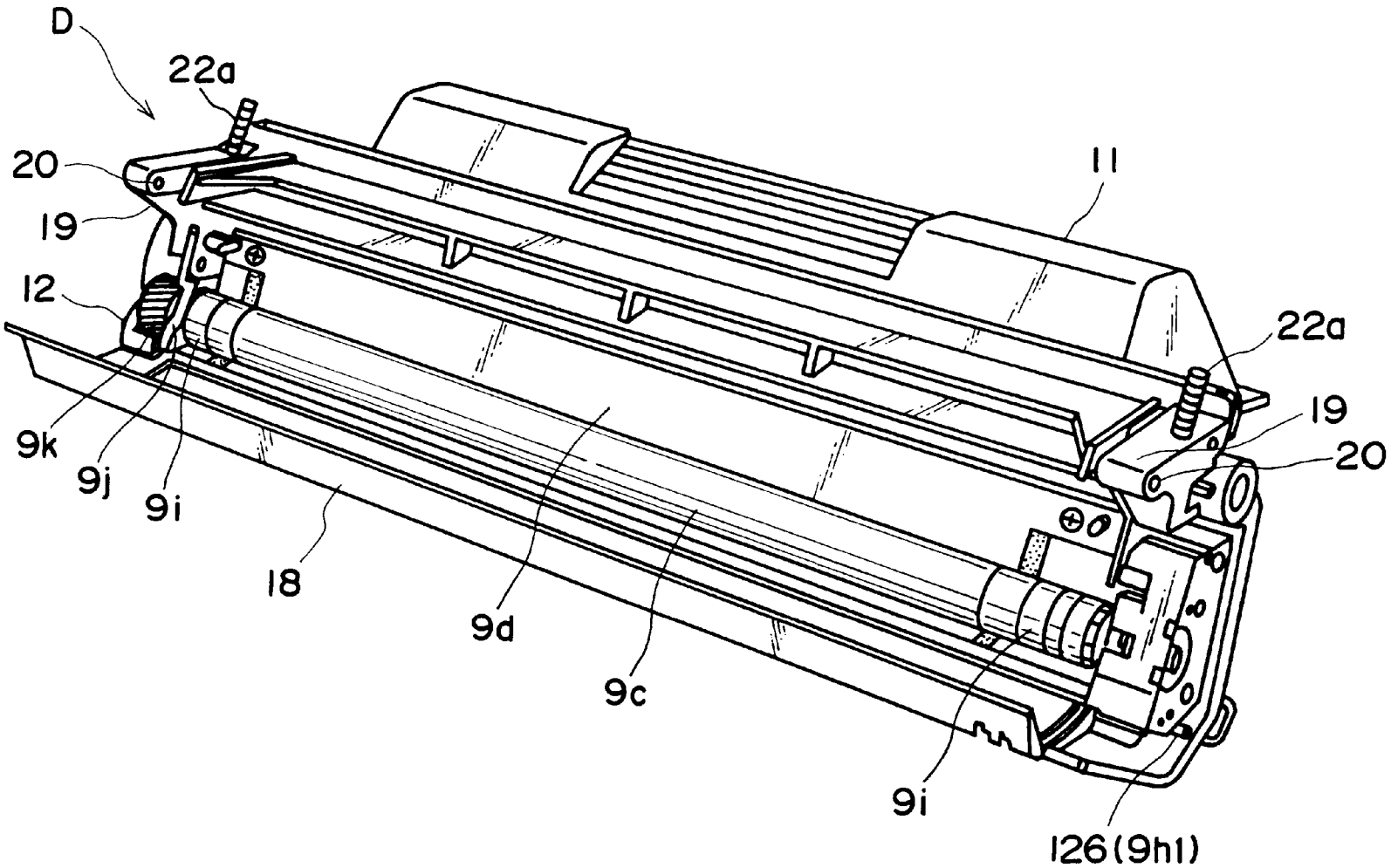
FIG. 13 is a perspective view of an image developing unit.
Figure 19:
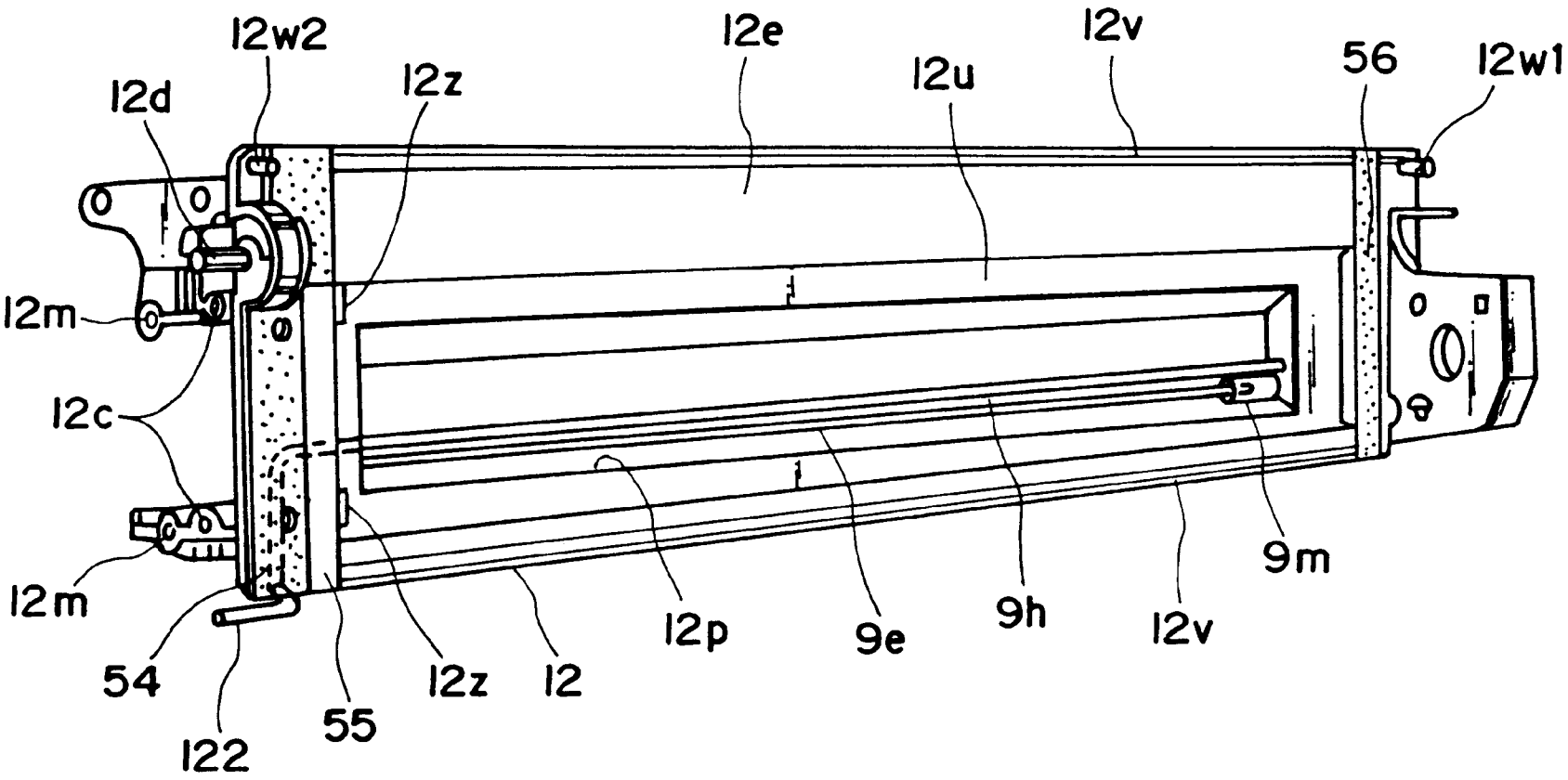
FIG. 19 is a perspective view of the image developing chamber frame.
Figure 20:
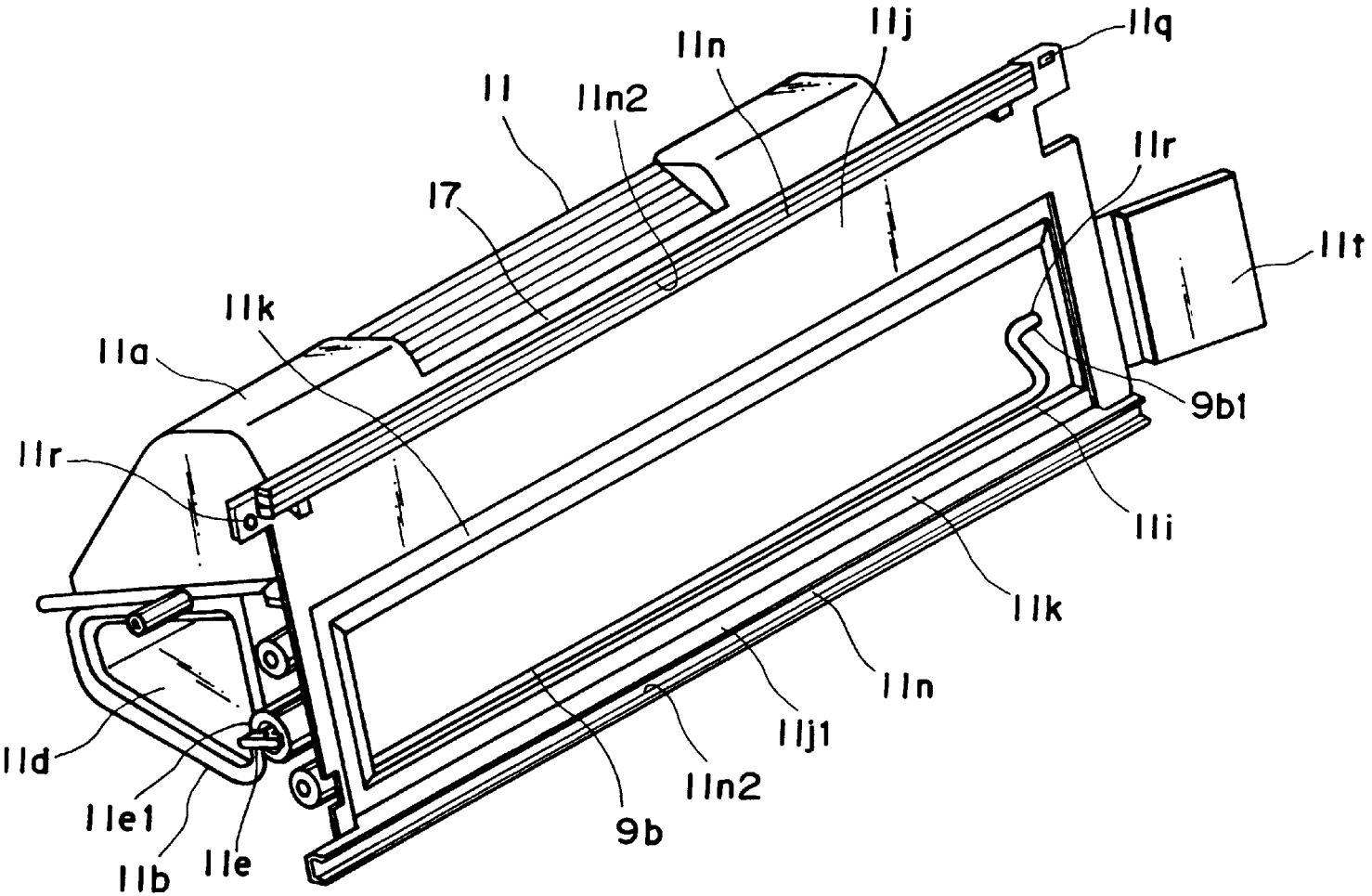
FIG. 20 is a perspective view of the toner chamber frame.

Referring to FIGS. 3 and 20, in the toner chamber frame 11, the toner feeding member 9*b* is rotatively mounted. In the image developing chamber frame 12, the image developing roller 9*c* and the developing blade 9*d* are mounted, and adjacent to the developing roller 9*c*, the stirring member 9*c* is rotatively mounted to circulatively stir the toner within the image developing chamber. Referring to FIGS. 3 and 19, in the image developing chamber frame 12, a rod antenna 9*h* is mounted, extending in the lengthwise direction of the developing roller 9*c* substantially in parallel to the developing roller 9*c*. The toner chamber frame 11 and the development chamber frame 12, which are equipped in the above-described manner, are welded together (in this embodiment, by ultrasonic wave) to form a second frame which constitutes an image developing unit D (FIG. 13).

The image developing unit of the process cartridge B is provided with a drum shutter assembly 18, which covers the photosensitive drum 7 to prevent it from being exposed to light for an extent period of time or from coming in contact with foreign objects when or after the process cartridge B is removed from the main assembly 14 of an image forming apparatus.

Referring to FIG. 6, the drum shutter assembly 18 has a shutter cover 18*a* which covers or exposes the transfer opening 13*n* illustrated in FIG. 3, and linking members 18*b* and 18*c* which support the shutter cover 18. On the upstream side relative to the direction in which the recording medium 2 is conveyed, one end of the right-hand side linking member 18*c* is fitted in a hole 40*g* of a developing means gear holder 40 as shown in FIGS. 4 and 5, and one end of the left-hand side linking member 18*c* is fitted in a boss 11*h* of the bottom portion 11*b* of the toner chamber frame 11. The other ends of the left- and right-hand linking members 18*c* are attached to the corresponding lengthwise ends of the shutter cover 18*a*, on the upstream side relative to the recording medium conveying direction. The linking member 18*c* is made of metallic rod. Actually, the left- and right-hand linking members 18*c* are connected through the shutter cover 18*a*; in other words, the left- and right-hand linking members 18*c* are the left- and right-hand ends of a single-piece linking member 18*c*. The linking member 18*b* is provided only on one lengthwise end of the shutter cover 18*a*. One end of the linking member 18*b* is attached to the shutter cover 18*a*, on the downstream side, relative to the recording medium conveying direction, of the position at which the linking member 18*c* is attached to the shutter cover 18*a*, and the other end of the linking member 18*b* is fitted around a dowel 12*d* of the image development chamber frame 12. The linking member 18*b* is formed of synthetic resin.

The linking members 18*b* and 18*c*, which are different in length, form a four piece linkage structure in conjunction with the shutter cover 18*a* and the toner chamber frame 11. As the process cartridge B is inserted into an image forming apparatus, the portion 18*c*1 of the linking member 18*c*, which projects away from the process cartridge B, comes in contact with the stationary contact member (unillustrated) provided on the lateral wall of the cartridge accommodating space S of the mains assembly 14 of the image forming apparatus, and activates the drum shutter assembly 18 to open the shutter cover 18*a*.

The drum shutter assembly 18 constituted of the shutter cover 18*a* and the linking members 18*b* and 18*c* is loaded with the pressure from a torsional coil spring (unillustrated) fitted around a dowel 12*d*. One end of the spring is anchored to the linking member 18*b*, and the other end is anchored to the image developing chamber frame 12, so that the pressure is generated in the direction to cause the shutter cover 18*a* to cover the transfer opening 13*n*.

Referring again to FIGS. 3 and 12, the cleaning means frame 13 is fitted with the photosensitive drum 7, the charging roller 8, and the various components of the cleaning means 10, to form a first frame as a cleaning unit C (FIG. 12).

Figure 12:
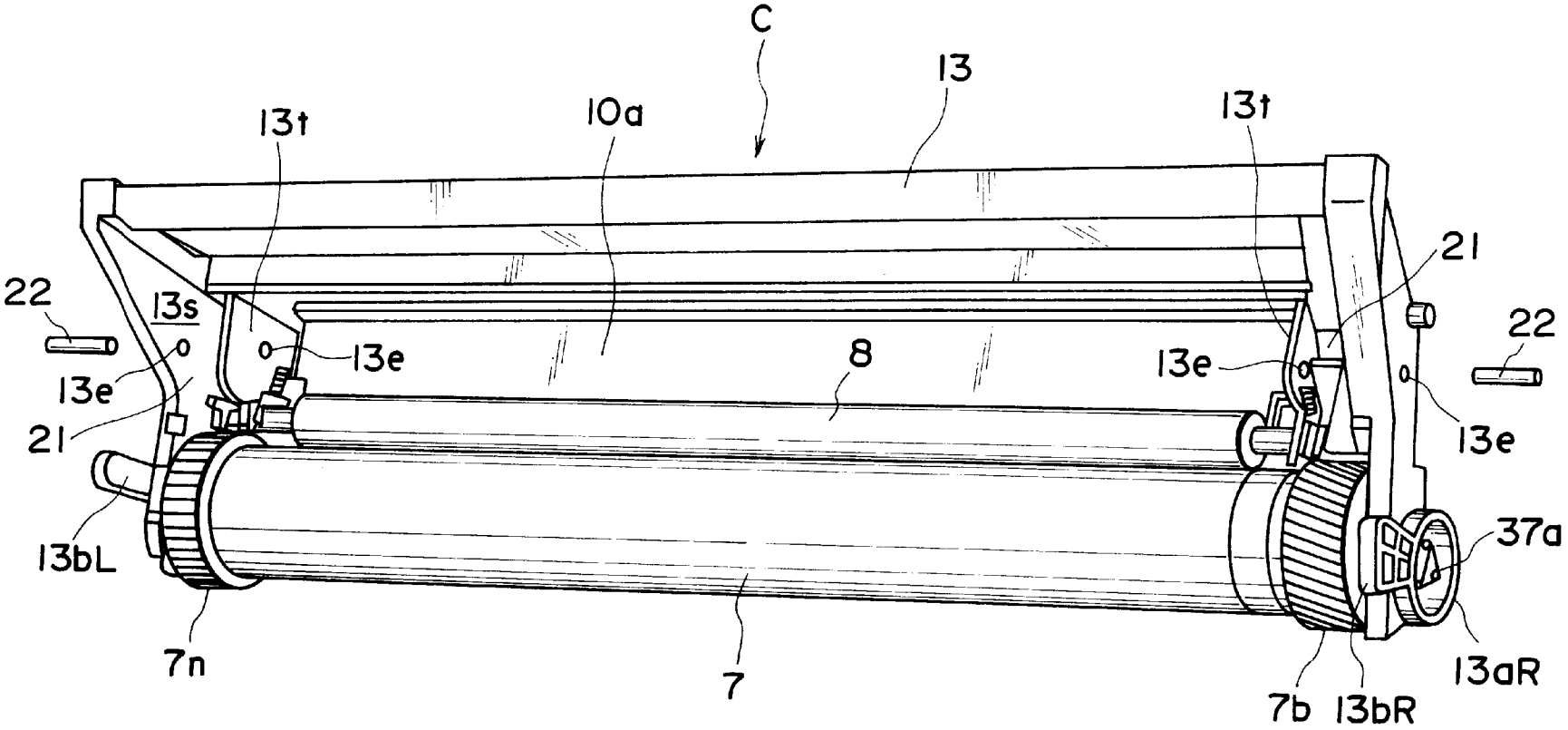
FIG. 12 is a perspective view of a cleaning unit.

Then, the aforementioned image developing unit D and cleaning unit C are joined with the use of a joining member 22, in a mutually pivotable manner, to complete the process cartridge B. More specifically, referring to FIG. 13, both lengthwise (axial direction of the developing roller 9*c*) ends of the image developing chamber frame 12 are provided with an arm portion 19, which is provided with a round hole 20 which is in parallel to the developing roller 9*c*. On the other hand, a recessed portion 21 for accommodating the arm portion 19 is provided at each lengthwise end of the cleaning chamber frame (FIG. 12). The arm portion 19 is inserted in this recessed portion 21, and the joining member 22 is pressed into the mounting hole 13*e* of the cleaning chamber frame 13, put through the hole 20 of the end portion of the arm portion 19, and pressed, farther, into the hole 13*e* of an partitioning wall 13*t*, so that the image developing unit D and the cleaning unit C are joined to be pivotable relative to each other about the joining member 22.

In joining the-image developing unit D and the cleaning unit C, a compression type coil spring 22*a* is placed between the two units, with one end of the coil spring being fitted around an unillustrated dowel erected from the base portion of the arm portion 19, and the other end being pressed against the top wall of the recessed portion 21 of the cleaning chamber frame 13. As a result, the image developing chamber frame 12 is pressed downward to reliably keep the developing roller 9*c* pressed downward toward the photosensitive drum 7. More specifically, referring to FIG. 13, a roller 9*i* having a diameter larger than that of the developing roller 9*c* is attached to each lengthwise end of the developing roller 9*c*, and this roller 9*i* is pressed on the photosensitive drum 7 to maintain a predetermined gap (approximately 300 $\mu$m) between the photosensitive drum 7 and the developing roller 9*c*. The top surface of the recessed portion 21 of the cleaning chamber frame 13 is slanted so that the compression type coil spring 22*a* is gradually compressed when the image developing unit D and the cleaning unit C are united. That is, the image developing unit D and the cleaning unit C are pivotable toward each other about the joining member 22, wherein the positional relationship (gap) between the peripheral surface of the photosensitive drum 7 and the peripheral surface of the developing roller 9*c* is precisely maintained by the elastic force of the compression type coil spring 22*a*.

Since the compression-type coil spring 22*a* is attached to the base portion of the arm portion 19 of the image developing chamber frame 12, the elastic force of the compression-type coil spring 22*a* affects nothing but the base portion of the arm portion 19. In a case in which the image developing chamber frame 12 is provided with a dedicated spring mount for the compression type coil spring 22*a*, the areas adjacent the spring seat must be reinforced to precisely maintain the predetermined gap between the photosensitive drum 7 and the developing roller 9*c*. However, with the placement of the compression-type coil spring 22*a* in the above described manner, it is unnecessary to reinforce the areas adjacent the spring seat, that is, the areas adjacent the base portion of the arm portion 19 in the case of this embodiment, because the base portion of the arm portion 19 is inherently greater in strength and rigidity.

The above described structure which holds together the cleaning chamber frame 13 and the image developing chamber frame 12 will be described later in more detail.

III. Structure of Process Cartridge B Guiding Means

Figure 9:
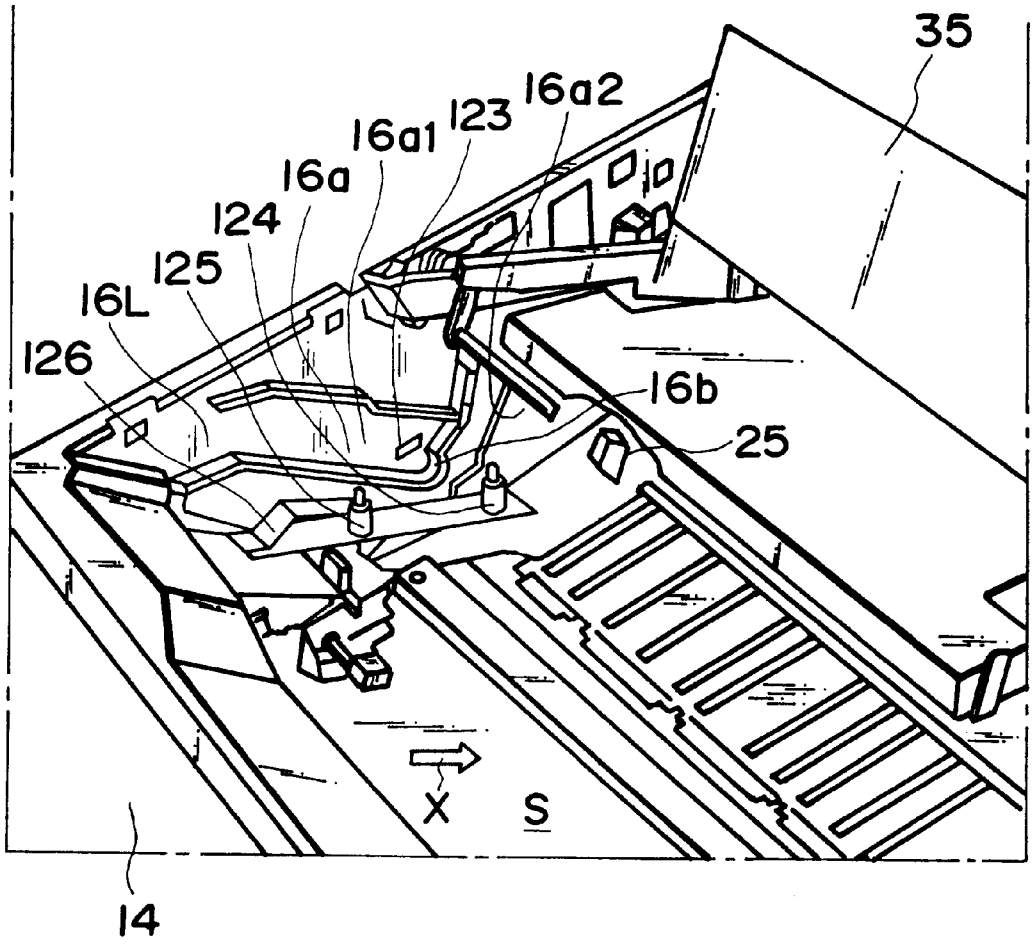
FIG. 9 is an external perspective view of the process-cartridge accommodating portion of the main assembly of the apparatus illustrated in FIG. 1.
Figure 10:
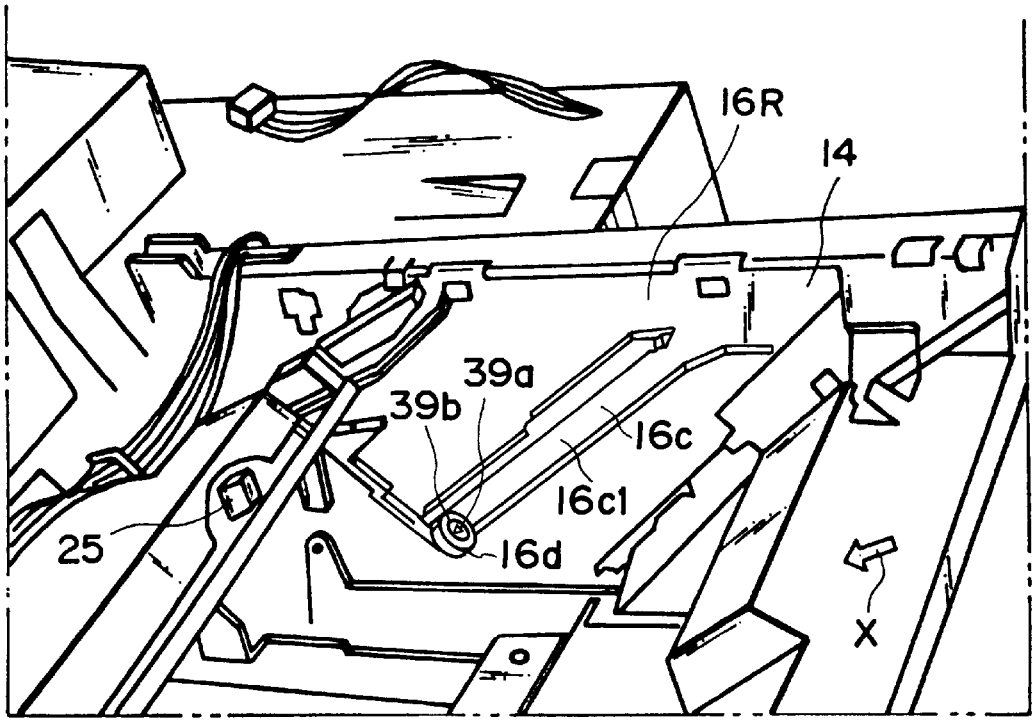
FIG. 10 is an external perspective view of the process-cartridge accommodating portion of the main assembly of the apparatus illustrated in FIG. 1.

Next, the means for guiding the process cartridge B when the process cartridge B is installed into, or removed from, the main assembly 14 of an image forming apparatus will be discussed. This guiding means is illustrated in FIGS. 9 and 10. FIG. 9 is a perspective view of the left-hand side of the guiding means, as seen (in the direction of an arrow mark X) from the side from which the process cartridge B is installed into the main assembly 14 of the image forming apparatus A (as seen from the side of the image developing unit D side). FIG. 10 is a perspective view of the right-hand side of the same, as seen from the same side.

Referring to FIGS. 4, 5, 6 and 7, each lengthwise end of the cleaning frame portion 13 is provided with means which serves as a guide when the process cartridge B is installed into, or removed from, the apparatus main assembly 14. This guiding means is constituted of cylindrical guides 13*a*R and 13*a*L as a cartridge positioning guiding member, and rotation controlling guides 13*b*R and 13*b*L as means for controlling the attitude of the process cartridge B when the process cartridge B is installed or removed.

As illustrated in FIG. 5, the cylindrical guide 13*a*R is a hollow cylindrical member. The rotation controlling guides 13*b*R are integrally formed together with the cylindrical guide 13*a*R, and radially protrude from the peripheral surface of the cylindrical guide 13*a*R. The cylindrical guide 13*a*R is provided with a mounting flange 13*a*R1 which is also integral with the cylindrical guide 13*a*R. Thus, the cylindrical guide 13*a*R, the rotation controlling guide 13*b*R, and the mounting flange 13*a*R1 constitute the right-hand side guiding member 13R, which is fixed to the cleaning chamber frame 13 with small screws put through the screw holes of the mounting flange 13*a*R*a*. With the right-hand side guiding member 13R being fixed to the cleaning chamber frame 13, the rotation controlling guide 13*b*R extends over the lateral wall of the developing means gear holder 40 fixed to the image developing chamber frame 12.

Figure 11:
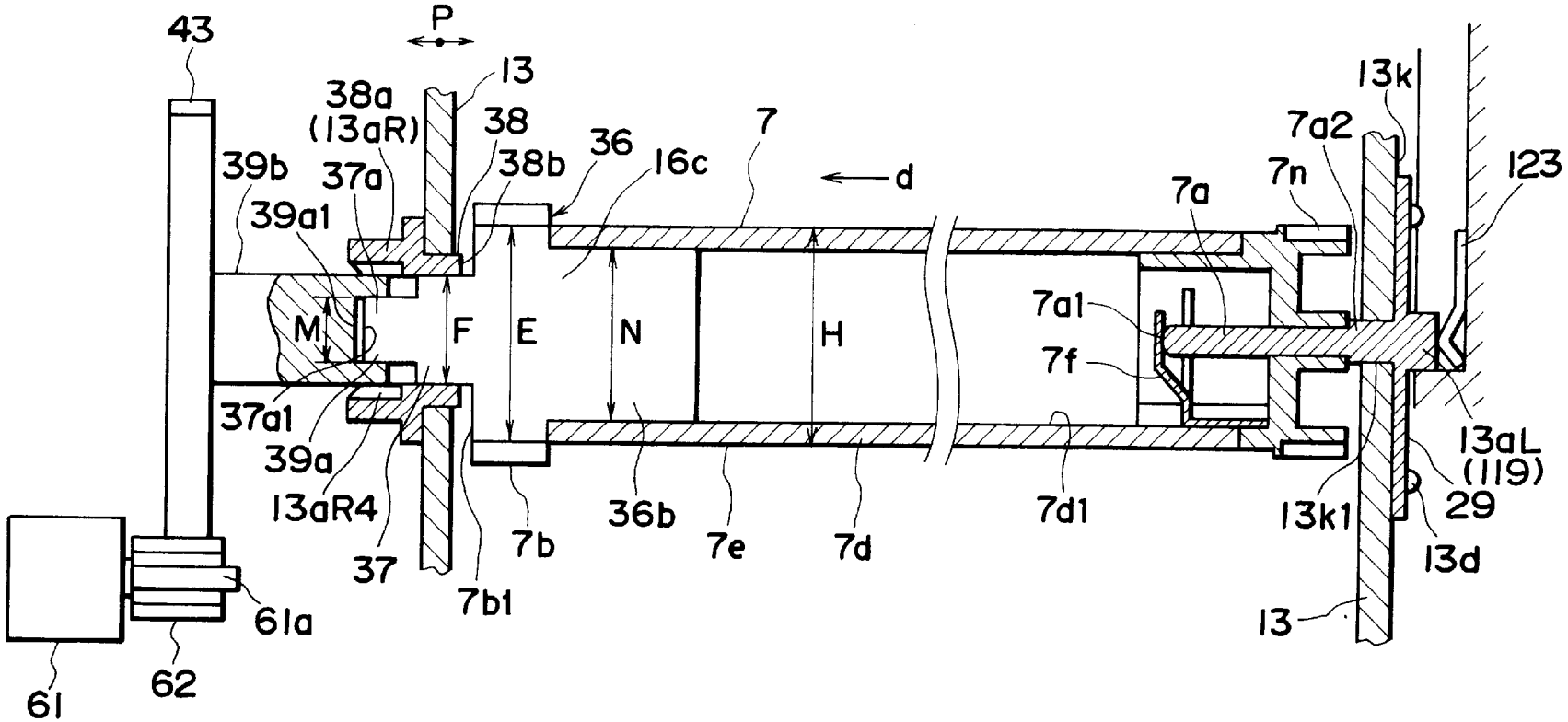
FIG. 11 is a vertical section of a photosensitive drum and a driving mechanism for driving the photosensitive drum.

Referring to FIG. 11, a drum shaft member is constituted of a drum shaft portion 7*a* inclusive of a larger diameter portion 7*a*2, a disk-shaped flange portion 29 and a cylindrical guide portion 13*a*L. The larger diameter portion 7*a*2 is fitted in the hole 13*k*1 of the cleaning frame portion 13. The flange portion 29 is engaged with a positioning pin 13*c* projecting from the side wall of the lengthwise end wall of the cleaning frame portion 13, being prevented from rotating, and is fixed to the cleaning frame portion 13 with the use of small screws 13*d*. The cylindrical guide 13*a*L projects outward (toward the front, that is, the direction perpendicular to the page of FIG. 6). The aforementioned stationary drum shaft 7*a* which rotatively supports a spur gear 7*n* fitted around the photosensitive drum 7 projects inwardly from the flange 29 (FIG. 11). The cylindrical guide 13*a*L and the drum shaft 7*a* are coaxial. The flange 29, the cylindrical guide 13*a*L, and the drum shaft 7*a*, are integrally formed of metallic material such as steel.

Referring to FIG. 6, there is a rotation controlling guide 13*b*L slightly away from the cylindrical guide 13*a*L. It is long and narrow, extending substantially in the radial direction of the cylindrical guide 13*a*L and also projecting outward from the cleaning chamber frame 13. It is integrally formed with the cleaning chamber frame 13. In order to accommodate this rotation controlling guide 13*b*L, the flange 29 is provided with a cutaway portion. The distance where the rotation controlling guide 13*b*L projects outward is such that its end surface is substantially even with the end surface of the cylindrical guide 13*a*L. The rotation controlling guide 13*b*L extends over the side wall of the developing roller bearing box 9*v* fixed to the image developing chamber frame 12. As is evident from the above description, the left-hand side guiding member 13L is constituted of two separate pieces: the metallic cylindrical guide 13*a*L and the rotation controlling guide 13*b*L composed of synthetic resin.

Next, a regulatory contact portion 13*j*, which is a part of the top surface of the cleaning chamber frame 13, will be described. In the following description of the regulatory contact portion 13*j*, the "top surface" refers to the surface which faces upward when the process cartridge B is in the main assembly 14 of an image forming apparatus.

Referring to FIGS. 4 to 7, two portions 13*j* of the top surface 13*i* of the cleaning unit C, which are the portions right next to the right and left front corners 13*p* and 13*q*, relative to the direction perpendicular to the direction in which the process cartridge B is inserted, constitute the regulatory contact portions 13*j*, which regulate the position and attitude of the process cartridge B when the cartridge B is installed into the main assembly 14. In other words, when the process cartridge B is installed into the main assembly 14, the regulatory contact portion 13*j* comes in contact with the fixed contact member 25 provided in the main assembly 14 of an image forming apparatus (FIGS. 9, 10 and 30), and regulates the rotation of the process cartridge B about the cylindrical guide 13*a*R and 13*a*L.

IV. Construction of Guide Means of the Main Assembly 14 of Image Forming Apparatus Next, the guiding means on the main assembly side 14 will be described. Referring to FIG. 1, as the lid 35 of the main assembly 14 of an image forming apparatus is pivotally opened about a supporting point 35*a* in the counterclockwise direction, the top portion of the main assembly 14 is exposed, and the process cartridge accommodating portion appears as illustrated in FIGS. 9 and 10. The left and right internal walls of the image forming apparatus main assembly 14, relative to the direction in which the process cartridge B is inserted, are provided with guide members 16L (FIG. 9) and 16R (FIG. 10), respectively, which extend diagonally downward from the side opposite to the supporting point 35*a*.

As shown in the drawings, the guide members 16L and 16R comprise guide portions 16*a* and 16*c*, and positioning grooves 16*b* and 16*d* connected to the guide portions 16*a* and 16*c*, respectively. The guide portions 16*a* and 16*c* extend diagonally downward, as seen from the direction indicated by an arrow mark X, that is, the direction in which the process cartridge B is inserted. The positioning grooves 16*b* and 16*d* have a semicircular cross-section which perfectly matches the cross-section of the cylindrical guides 13*a*L or 13*a*R of the process cartridge B. After the process cartridge B is completely installed in the apparatus main assembly 14, the centers of semicircular cross-sections of the positioning groove 16*b* and 16*d* coincide with the axial lines of the cylindrical guides 13*a*L and 13*a*R, respectively, of the process cartridge B, and hence, with the axial line of the photosensitive drum 7.

The width of the guide portions 16*a* and 16*c* as seen from the direction in which the process cartridge B is installed or removed is wide enough to allow the cylindrical guides 13*a*L and 13*a*R to ride on them with a reasonable amount of play. Therefore, the rotation controlling guides 13*b*L and 13*b*R, which are narrower than the diameter of the cylindrical guide 13*a*L and 13*a*R, naturally fit more loosely in the guide portions 16*a* and 16*c* than the cylindrical guides 13*a*L and 13*a*R, respectively, yet their rotation is controlled by the guide portions 16*a* and 16*c*. In other words, when the process cartridge B is installed, the angle of the process cartridge B is kept within a predetermined range. After the process cartridge B is installed in the image forming apparatus main assembly 14, the cylindrical guides 13*a*L and 13*a*R of the process cartridge B are in engagement with the positioning grooves 16*b* and 16*d* of the guiding members 13L and 13R, and the left and right regulatory contact portions 13*j* located at the front portion, relative to the cartridge inserting direction, of the cleaning chamber frame 13 of the process cartridge B, are in contact with the fixed positioning members 25, respectively.

The weight distribution of the process cartridge B is such that when the line which coincides with the axial lines of the cylindrical guide 13*a*L and 13*a*R is level, the image developing unit D side of the process cartridge B generates a larger moment about this line than the cleaning unit C side.

V. Attachment/Removal of Process Cartridge B to/from Main Assembly 14 of Image Forming Apparatus The process cartridge B is installed into the image forming apparatus main assembly 14 in the following manner. First, the cylindrical guides 13*a*L and 13*a*R of the process cartridge B are inserted into the guide portion 16*a* and 16*c*, respectively of the cartridge accommodating portion in the image forming apparatus main assembly 14 by grasping the recessed portion 17 and ribbed portion 11c of the process cartridge B with one hand, and the rotation controlling guides 13*b*L and 13*b*R are also inserted into the guide portions 16*a* and 16*c*, tilting downward the front portion, relative to the inserting direction, of the process cartridge B. Then, the process cartridge B is inserted farther with the cylindrical guides 13*a*L and 13*a*R and the rotation controlling guides 13*b*L and 13*b*R of the process cartridge B following the guide portions 16*a* and 16*c*, respectively, until the cylindrical guides 13*a*L and 13*a*R reach the positioning grooves 16*b* and 16*d* of the image forming apparatus main assembly 14.

Then, the cylindrical guides 13*a*L and 13*a*R become seated in the positioning grooves 16*b* and 16*d*, respectively, due to the weight of the process cartridge B itself; the cylindrical guides 13*a*L and 13*a*R of the process cartridge B are accurately positioned relative to the positioning grooves 16*b* and 16*d*. In this condition, the line which coincides with the axial lines of the cylindrical guides 13*a*L and 13*a*R also coincides with the axial line of the photosensitive drum 7, and therefore, the photosensitive drum 7 is reasonably accurately positioned relative to the image forming apparatus main assembly 14. It should be noted here that the final positioning of the photosensitive drum 7 relative to the image forming apparatus main assembly 14 occurs at the same time as the coupling between the two is completed.

Also in this condition, there is a slight gap between the stationary positioning member 25 of the image forming apparatus main assembly 14 and the regulatory contact portion 13*j* of the process cartridge B. At this point of time, the process cartridge B is released from the hand. Then, the process cartridge B rotates about the cylindrical guides 13*a*L and 13*a*R in a direction to lower the image developing unit D side and raise the cleaning unit C side until the regulatory contact portions 13*j* of the process cartridge B come in contact with the corresponding stationary positioning members 25. As a result, the process cartridge B is accurately positioned relative to the image forming apparatus main assembly 14. Thereafter, the lid 35 is closed by rotating it clockwise about the supporting point 35*a*.

In order to remove the process cartridge B from the apparatus main assembly 14, the above described steps are carried out in reverse. More specifically, first, the lid 35 of the apparatus main assembly 14 is opened, and the process cartridge B is pulled upward by grasping the aforementioned top and bottom ribbed portions 11*c*, that is, the handhold portions, of the process cartridge by hand. Then, the cylindrical guides 13*a*L and 13*a*R of the process cartridge B rotate in the positioning grooves 16*b* and 16*d* of the apparatus main assembly 14. As a result, the regulatory contact portions 13*j* of the process cartridge B separate from the corresponding stationary positioning member 25. Next, the process cartridge B is pulled more. Then, the cylindrical guides 13*a*L and 13*a*R come out of the positioning grooves 16*b* and 16*d*, and move into the guide portions 16*a* and 16*c* of the guiding member 16L and 16R, respectively, fixed to the apparatus main assembly 14. In this condition, the process cartridge B is pulled more. Then, the cylindrical guides 13*a*L and 13*a*R and the rotation controlling guides 13*b*L and 13*b*R of the process cartridge B slide diagonally upward through the guide portions 16*a* and 16*c* of the apparatus main assembly 14, with the angle of the process cartridge B being controlled so that the process cartridge B can be completely moved out of the apparatus main assembly 14 without making contact with the portions other than the guide portions 16*a* and 16*c*.

Referring to FIG. 12, the spur gear 7*n* is fitted around one of the lengthwise ends of the photosensitive drum 7, which is the end opposite to where the helical drum gear 7*b* is fitted. As the process cartridge B is inserted into the apparatus main assembly 14, the spur gear 7*n* meshes with a gear (unillustrated) coaxial with the image transferring roller 4 located in the apparatus main assembly, and transmits from the process cartridge B to the transferring roller 4 the driving force which rotates the transferring roller 4.

VI. Construction of Toner Chamber Frame 11 of Developing Unit D

Figure 21:
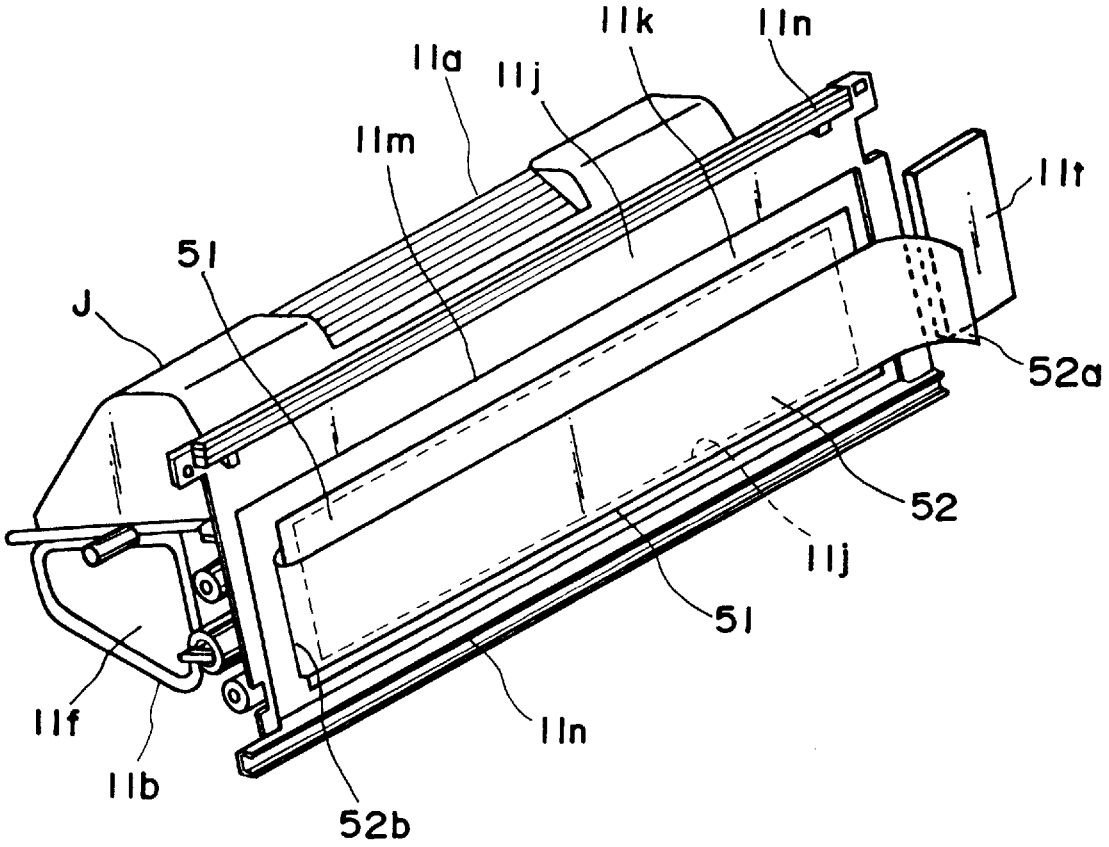
FIG. 21 is a perspective view of the toner chamber frame.

Referring to FIGS. 3, 5, 7, 16, 20 and 21, the toner chamber frame will be described in detail. FIG. 20 is a perspective view of the toner chamber frame as seen before a toner seal is welded on, and FIG. 21 is a perspective view of the toner chamber frame after toner is fitted in.

Referring to FIG. 3, the toner chamber frame 11 is constituted of two portions: the top and bottom portions 11*a* and 11*b*. Referring to FIG. 1, the top portion 11*a* bulges upward, occupying the space on the left-hand side of the optical system 1 in the image forming apparatus main assembly 14, so that the toner capacity of the process cartridge B can be increased without increasing the size of the image forming apparatus A. Referring to FIGS. 3, 4 and 7, the top portion 11*a* of the toner chamber frame 11 has a recessed portion 17, which is located at the lengthwise center portion of the top portion 11*a*, and serves as a handhold. An operator of the image forming apparatus can handle the process cartridge B by grasping it by the recessed portion 17 of the top portion 11*a* and the downward facing side of the bottom portion 11*b*. The ribs 11*c* extending on the downward facing surface of the bottom portion 11*b* in the lengthwise direction of the bottom portion 11*b* serve to prevent the process cartridge B from slipping out of the operator's hand.

Referring again to FIG. 3, the flange 11*a*1 of the top portion 11*a* is aligned with the raised-edge flange 11*b*1 of the bottom portion 11*b*, the flange 11*a*1 being fitted within the raised edge of the flange 11*b*1 of the bottom portion 11*b*1, so that the walls of the top and bottom portions of the toner chamber frame 11 perfectly meet at the welding surface U, and then, the top and bottom portions 11*a* and 11*b* of the toner chamber frame 11 are welded together by melting the welding ribs with the application of ultrasonic waves. The method for uniting the top and bottom portions 11*a* and 11*b* of the toner chamber frame 11 does not need to be limited to ultrasonic welding. They may be welded by heat or forced vibration, or may be glued together. Further, the bottom portion 11*b* of the toner chamber frame 11 is provided with a stepped portion 11*m*, in addition to the flange 11*b*1 which keeps the top and bottom portions 11*a* and 11*b* aligned when they are welded together by ultrasonic welding. The stepped portion 11*m* is located above an opening 11*m* and is substantially in the same plane as the flange 11*b*1. The structures of stepped portion 11*m* and its adjacent areas will be described later.

Figure 16:
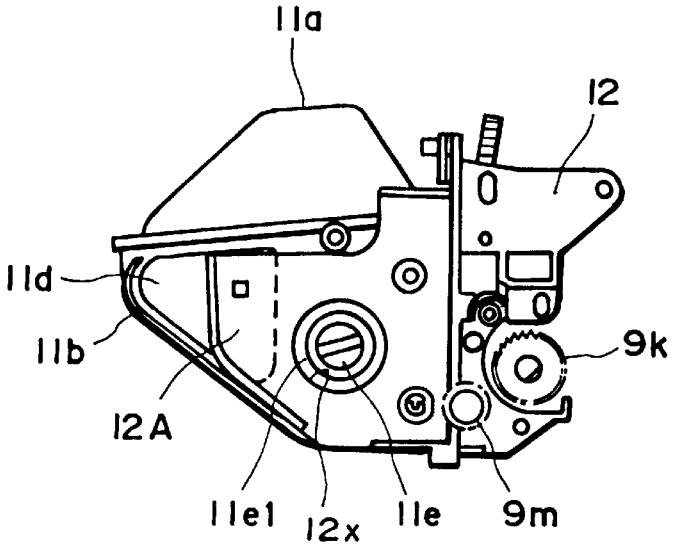
FIG. 16 is a side view of the image developing unit inclusive of the toner chamber frame and the image developing chamber frame.

Before the top and bottom portions 11*a* and 11*b* of the toner chamber frame 11 are united, a toner feeding member 9*b* is assembled into the bottom portion 11, and a coupling member 11*e* is attached to the end of the toner feeding member 9*b* through the hole 11*e*1 of the side wall of the toner chamber frame 11 as shown in FIG. 16. The hole 11*e*1 is located one of the engthwise ends of the bottom portion 11*b*, and the side plate, which has the hole 11*e*1, is also provided with a toner filling opening 11*d* substantially shaped like a right triangle. The triangular rim of the toner filling opening 11*d* is constituted of a first edge, which is one of two edges that are substantially perpendicular to each other, and extends along the joint between the top and bottom portion 11*a* and 11*b* of the toner chamber frame 11, a second edge, which vertically extends in the direction substantially perpendicular to the first edge, and a third edge, that is, a diagonal edge, which extends along the slanted edge of the bottom portion 11*b*. In other words, the toner filling opening 11*d* is rendered as large as possible, while being located next to the hole 11*e*1.

Next, referring to FIG. 20, the toner chamber frame 11 is provided with an opening 11*i* through which toner is fed from the toner chamber frame 11 into the image developing chamber frame 12, and a seal (which will be described later) is welded to seal this opening 11*i*. Thereafter, toner is filled into the toner chamber frame 11 through the toner filling opening 11*d*, and then, the toner filling opening 11*d* is sealed with a toner sealing cap 11*f* to finish a toner unit J. The toner sealing cap 11*f* is formed of polyethylene, polypropylene, or the like, and is pressed into, or glued to, the toner filling opening 11*d* of the toner chamber frame 11 so that it does not come off. Next, the toner unit J is welded to the image developing chamber frame 12, which will be described later, by ultrasonic welding, to form the image developing unit D. The means for uniting the toner unit J and the image developing unit D is not limited to ultrasonic welding; it may be gluing or snap-fitting, which utilizes the elasticity of the materials of the two units.

Referring to FIG. 3, the slanted surface K of the bottom portion 11*b* of the toner chamber frame 11 is given an angle of θ so that the toner in the top portion of the toner chamber frame 11 naturally slides down as the toner at the bottom is consumed. More specifically, it is desirable that the angle θ formed between the slanted surface K of the process cartridge B in the apparatus main assembly 14 and the horizontal line Z is approximately 65 degrees when the apparatus main assembly 14 is horizontally placed. The bottom portion 11*b* is given an outwardly bulging portion 11*g* so that it does not interfere with the rotation of the toner feeding member 9*b*. The diameter of the sweeping range of the toner feeding member 9*b* is approximately 37 mm. The height of the bulging portion 11*g* has only to be approximately 0 to 10 mm from the imaginary extension of the slanted surface K. This is due to the following reason; if the bottom surface of the bulging portion 11*g* is above the imaginary extending of the slanted surface K, the toner which, otherwise, naturally slides down from the top portion of the slanted surface K and is fed into the image developing chamber frame 12, partially fails to be fed into the image developing chamber frame 12, collecting in the area where the slanted surface K and the outwardly bulging portion 11*g* meet. Contrarily, in the case of the toner chamber frame 11 in this embodiment, the toner is reliably fed into the image developing chamber frame 12 from the toner chamber frame 11.

The toner feeding member 9*b* is formed of a steel rod having a diameter of approximately 2 mm, and is in the form of a crank shaft. Referring to FIG. 20 which illustrates one end of the toner feeding member 9*b*, one 9*b*1 of the journals of the toner feeding member 9*b* is fitted in a hole 11*r*, which is located in the toner chamber frame 11, adjacent to the opening 11*i* of the toner chamber frame 11. The other of the journals 11 is fixed to the coupling member 11*e* (where the journal is fixed to the coupling member 11*e* is not visible in FIG. 20).

As described above, providing the bottom wall of the toner chamber frame section 11 with the outwardly bulging portion 11*g* as the sweeping space for the toner feeding member 9*b* makes it possible to provide the process cartridge B with stable toner feeding performance without an increase in cost.

Figure 22:
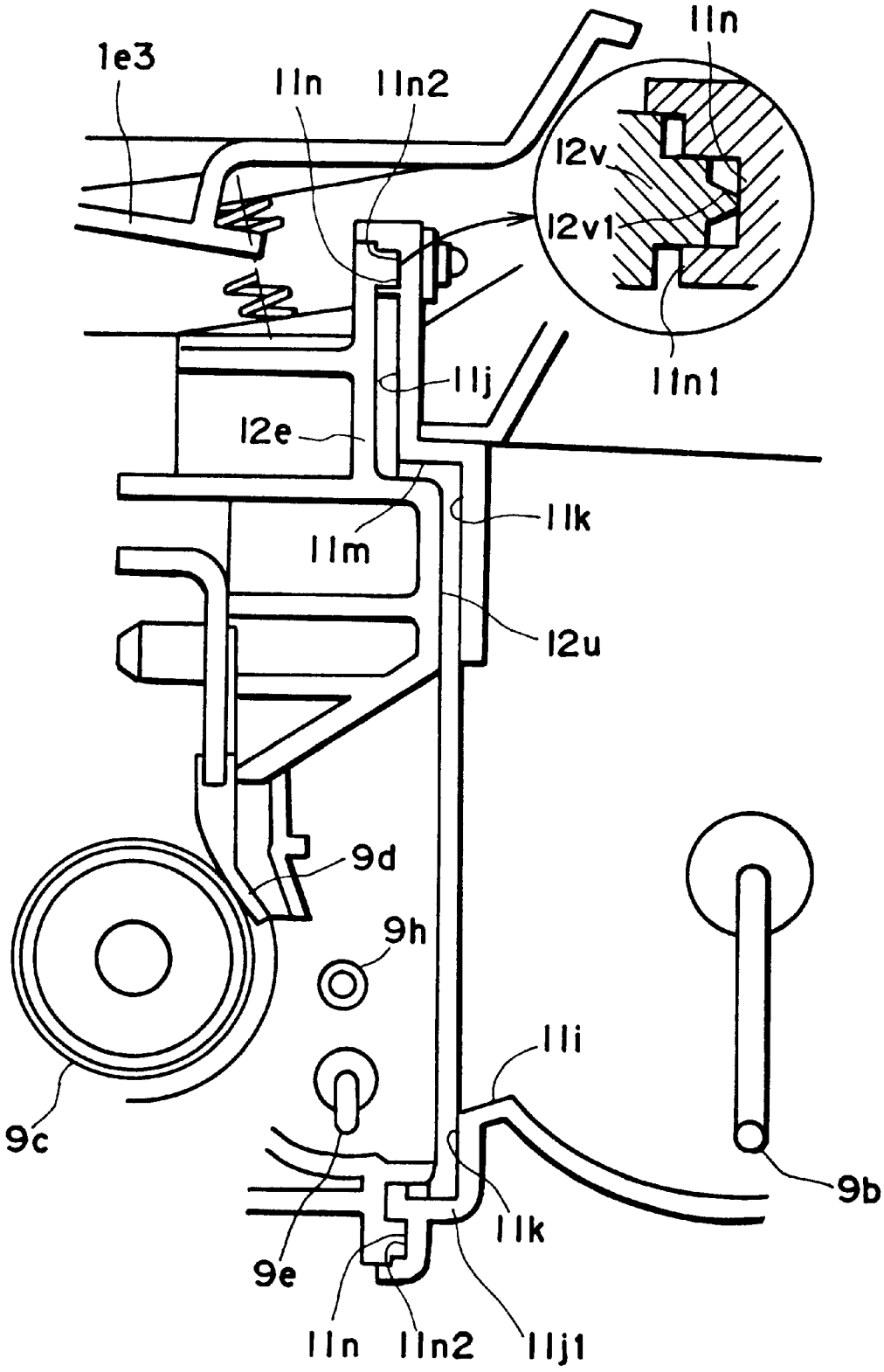
FIG. 22 is a vertical section of the toner sealing portion illustrated in FIG. 21.

Referring to FIGS. 3, 20 and 22, the opening 11*i* through which toner is fed from the toner chamber frame section 11 into the development chamber frame section is located at the joint between the toner chamber frame section 11 and the development chamber frame section 12. The opening 11*i* is surrounded by a recessed surface 11*k*, which in turn is surrounded by the top and bottom portions 11*j* and 11*j*1 of the flange of the toner chamber frame 11. The lengthwise outer (top) edge of the top portion 11*j* and the lengthwise outer (bottom) edge of the bottom portion 11*j*1 are provided with grooves 11*n*, respectively, which are parallel to each other. The top portion 11*j* of the flange above the recessed surface 11*k* is in the form of a gate, and the surface of the bottom portion 11*j*1 of the flange is perpendicular to the surface of the recessed surface 11*k*. Referring to FIG. 22, the plane of the bottom surface 11*n*2 of the groove 11*n* is on the outward side (toward the image developing chamber frame 12) of the surface of the recessed surface 11*k*. However, the flange of the toner chamber frame 11 may be structured like the flange illustrated in FIG. 39 in which the top and bottom portion 11*j* of the flanges are in the same plane and surround the opening 11*i* like the top and bottom pieces of a picture frame.

VII. Construction of Connecting Portion between Developing Chamber Frame 12 of Developing Unit D and Toner Chamber Frame 12

Referring to FIG. 19, an alphanumeric reference 12*u* designates one of the flat surfaces of the image developing chamber frame 12, which faces the toner chamber frame 11. The flange 12*e* which is parallel to the flat surface 12*u* and surrounds all four edges of this flat surface 12*u*, like a picture frame, is provided at a level slightly recessed from the flat surface 12*u*. The lengthwise edges of the flange 12*e* are provided with a tongue 12*v* which fit into the groove 11*n* of the toner chamber frame 11. The top surface of the tongue 12*v* is provided with an angular ridge 12*v*1 (FIG. 22) for ultrasonic welding. After the various components are assembled into the toner chamber frame 11 and image developing chamber frame 12, the tongue of the image developing chamber frame 12 is fitted into the groove 11*n* of the toner chamber frame 11, and the two frames 11 and 12 are welded together along the tongue 12*v* and groove 11*n* (detail will be given later).

Referring to FIG. 21, a cover film 51, which can be easily torn in the lengthwise direction of the process cartridge B, is pasted to the recessed surface 11*k* to seal the opening 11*i* of the toner chamber frame 11; it is pasted to the toner chamber frame 11, on the recessed surface 11*k*, alongside the four edges of the opening 11*i*. In order to unseal the opening 11*i* by tearing the cover film 51, the process cartridge B is provided with a tear tape 52, which is welded to the cover film 51. The cover tape 52 is doubled back from the lengthwise end 52*b* of the opening 11*i*, is put through between an elastic sealing member 54 such as a piece of felt (FIG. 19) and the opposing surface of the toner chamber frame 11, at the end opposite to the end 52*b*, and is slightly extended from the process cartridge B. The end portion 52*a* of the slightly sticking out tear tape 52 is adhered to a pull-tab 11*t* which is to be grasped with hand (FIGS. 6, 20 and 21). The pull-tab 11*t* is integrally formed with the toner chamber frame 11, wherein the joint portion between the pull-tab 11*t* and the toner chamber frame 11 is substantially thin so that the pull-tab 11*t* can be easily torn away from the toner chamber frame 11. The surface of the sealing member 54, except for the peripheral areas, is covered with a synthetic resin film tape 55 having a small friction coefficient. The tape 55 is pasted to the sealing member 54. Further, the flat surface 12*e* located at the other of the lengthwise end portions of the toner chamber frame 11, that is, the end portion opposite to the position where the elastic sealing member 54 is located, is covered with the elastic sealing member 56, which is pasted to the flat surface 12*e* (FIG. 19).

The elastic sealing members 54 and 56 are pasted on the flange 12*e*, at the corresponding lengthwise ends, across the entire width of the flange 12*e*. As the toner chamber frame 11 and the image developing chamber frame 12 are joined, the elastic sealing members 54 and 56 exactly cover the corresponding lengthwise end portions of the flange 11*j* surrounding the recessed surface race 11*k*, across the entire width the flange 11*j*, overlapping with the tongue 12*v*.

Further, in order to precisely position the toner chamber frame 11 and the image developing chamber frame 12 relative to each other when they are joined, the flange 11*j* of the toner chamber frame 11 is provided with a round hole 11*r* and a square hole 11*q* which engage with the cylindrical dowel 12*w*1 and square dowel 12*w*2, respectively, of the image developing chamber frame 12. The round hole 11*r* tightly fits with the dowel 12*w*1, whereas the square hole 11*q* loosely fits with the dowel 12*w*2 in terms of the lengthwise direction while tightly fitting therewith in terms of the lengthwise direction.

The toner chamber frame 11 and the image developing chamber frame 12 are independently assembled as a compound component prior to a process in which they are united. Then, they are united in the following manner. First, the cylindrical positioning dowel 12*w*1 and square positioning dowel 12*w*2 of the image developing chamber frame 12 are fitted into the positioning round hole 11*r* and positioning square hole 11*q* of the toner chamber frame 11, and the tongue 12*v* of the image developing chamber frame 12 is placed in the groove 11*n* of the toner chamber frame 11. Then, the toner chamber frame 11 and the image developing chamber frame 12 are pressed toward each other. As a result, the sealing members 54 and 56 come in contact with, being thereby compressed by, the corresponding lengthwise end portions of the flange 11*j*, and at the same time, a rib-like projections 12*z*, which are located, as a spacer, at each lengthwise end of the flat surface 12*u* of the image developing chamber frame 12, are positioned close to the flange 11*j* of the toner chamber frame 11. The rib-like projection 12*z* is integrally formed with the image developing chamber frame 12, and is located at both sides, relative to the lengthwise direction, of the tear tape 52, so that the tear tape can be passed between the opposing projections 12*z*.

With the toner chamber frame 11 and the image developing chamber frame 12 being passed toward each other as described above, ultrasonic vibration is applied between the tongue-like portion 12*v* and the groove 11*n*. As a result, the angular ridge 12*v*1 is melted by frictional heat and fuses with the bottom of the groove 11*n*. Consequently, the rim portion 11*n*1 of the groove 11*n* of the toner chamber frame 11 and the rib-like projection 12*z* of the image developing chamber frame 12 remain airtightly in contact with each other, leaving a space between the recessed surface 11*k* of the toner chamber frame 11 and the flat surface 12*u* of the image developing chamber frame 12. The aforementioned cover film 51 and tear tape 52 fit in this space.

In order to feed the toner stored in the toner chamber frame 11 into the image developing chamber frame 12, the opening 11*i* of the toner chamber frame 11 must be unsealed. This is accomplished in the following manner. First, the pull-tab 11*t* attached to the end portion 52*a* (FIG. 6) of the tear tape 52 extending from the process cartridge B is cut loose, or torn loose, from the toner chamber frame 11, and then, is pulled by the hand of an operator. This will tear the cover film 51 to unseal the opening 11*i*, enabling the toner to be fed from the toner chamber frame 11 into the image developing chamber frame 12. After the cover film 52 is pulled out of the process cartridge B, the lengthwise ends of the cartridge B are kept sealed by the elastic seals 54 and 56 which are located at the corresponding lengthwise ends of the flange 11*j* of the toner chamber frame 11. Since the elastic sealing members 54 and 56 are deformed (compressed) only in the direction of their thickness while maintaining their hexahedral shapes, they can keep the process cartridge sealed very effectively.

Since the side of the toner chamber frame 11, which faces the image developing chamber frame 12, and the side of the image developing chamber frame 12, which faces the toner chamber frame 11, are structured as described above, the tear tape 52 can be smoothly pulled out from between the two frames 11 and 12 by simply applying to the tear tape 52 a force strong enough to tear the cover film 51.

As described above, when the toner chamber frame 11 and the image developing chamber frame 12 are united, a welding method employing ultrasonic energy is employed to generate frictional heat which melts the angular ridge 12*v*1. This frictional heat is liable to cause thermal stress in the toner chamber frame 11 and the image developing chamber frame 12, and these frames may become deformed due to the stress. However, according to this embodiment, the groove 11*n* of the toner chamber frame 11 and the tongue 12*v* of the image developing chamber frame 12 engage with each other across the almost their entire length. In other words, as the two frames 11 and 12 are united, the welded portion and its adjacent regions are reinforced, and therefore, the two frames are not likely to be deformed by the thermal stress.

As for the material for the toner chamber frame 11 and the image developing chamber frame 12, plastic material is used; for example, polystyrene, ABS resin (acrylonitrile-butadiene-styrene), polycarbonate, polyethylene, polypropylene, and the like.

Referring to FIG. 3, this drawing is a substantially vertical cross-section of the toner chamber frame 11 of the process cartridge B in this embodiment, and illustrates the interface between the toner chamber frame 11 and the image developing chamber frame 12, and its adjacent regions.

VIII. Construction of Toner Container 11A of Toner Chamber Frame 11

At this time, the toner chamber frame 11 of the process cartridge B in this embodiment will be described in more detail with reference to FIG. 3. The toner held in a toner container 11A is single component toner. In order to allow this toner to efficiently free fall toward the opening 11*i*, the toner chamber frame 11 is provided with slanted surfaces K and L, which extend across the entire length of the toner chamber frame 11. The slanted surface L is above the opening 11*i*, and the slanted surface K is in the rear of the toner chamber frame 11 as seen from the opening 11*i* (in the widthwise direction of the toner chamber frame 11). The slanted surfaces L and K are parts of the top and bottom pieces 11*a* and 11*b*, respectively, of the toner chamber frame 11. After the process cartridge B is installed in the apparatus main assembly 14, the slanted surface L faces diagonally downward, and the slanted surface K faces diagonally upward, an angle θ3 between the slanted surface K and the line m perpendicular to the interface between the toner chamber frame 11 and the image developing chamber frame 12 being approximately 20 degrees to 40 degrees. In other words, in this embodiment, the configuration of the top portion 11*a* of the toner chamber frame 11 is designed so that the slanted surfaces K and L hold the aforementioned angles, respectively, after the top and bottom portions 11*a* and 11*b* of the toner chamber frame 11 are united. Thus, according to this embodiment, the toner container 11A holding the toner is enabled to efficiently feed the toner toward the opening 11*i*.

Next, the image developing chamber frame will be described in detail.

IX. Construction of Developing Chamber Frame 12

Figure 14:
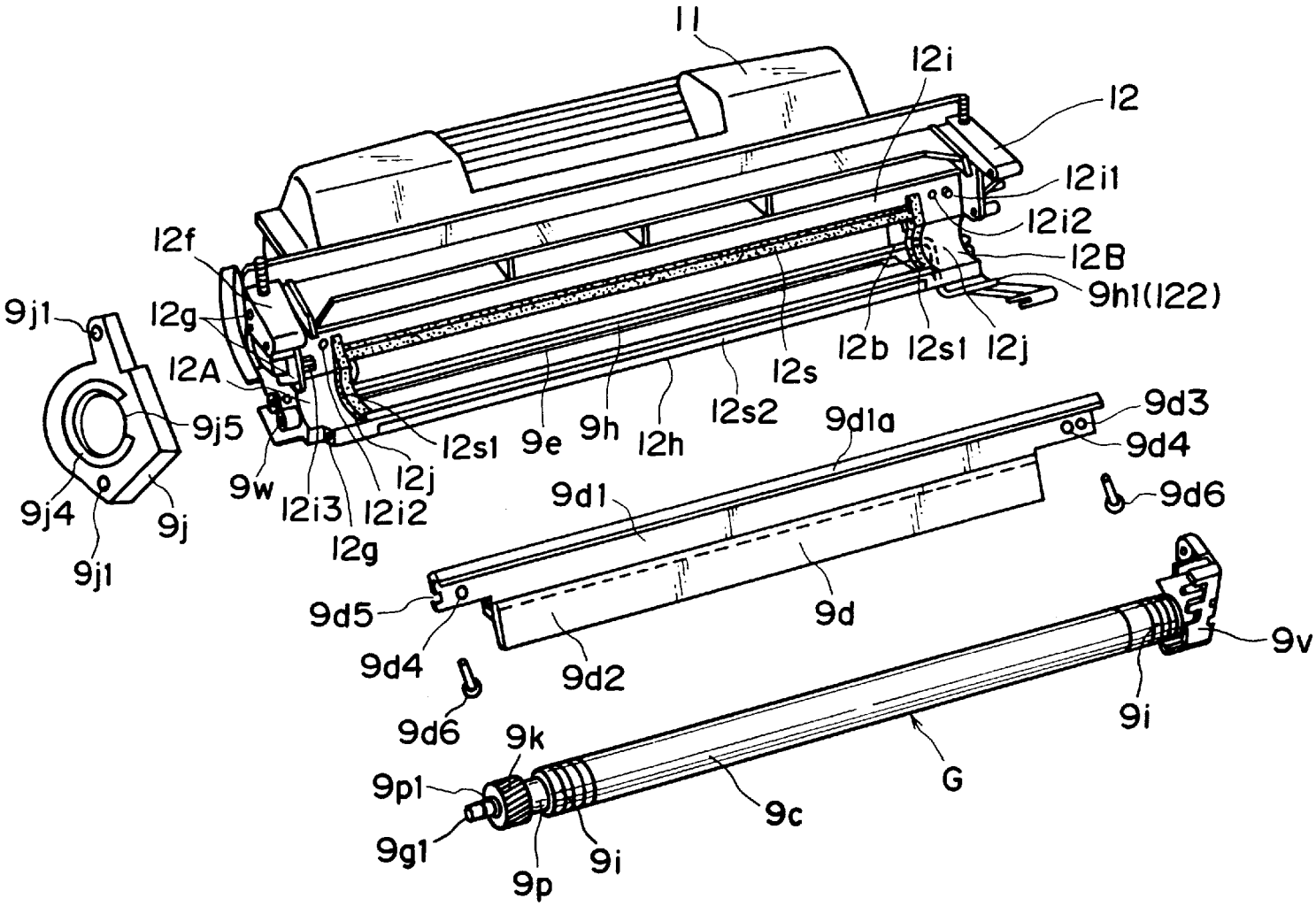
FIG. 14 is a partially exploded perspective view of an image developing unit.
Figure 15:
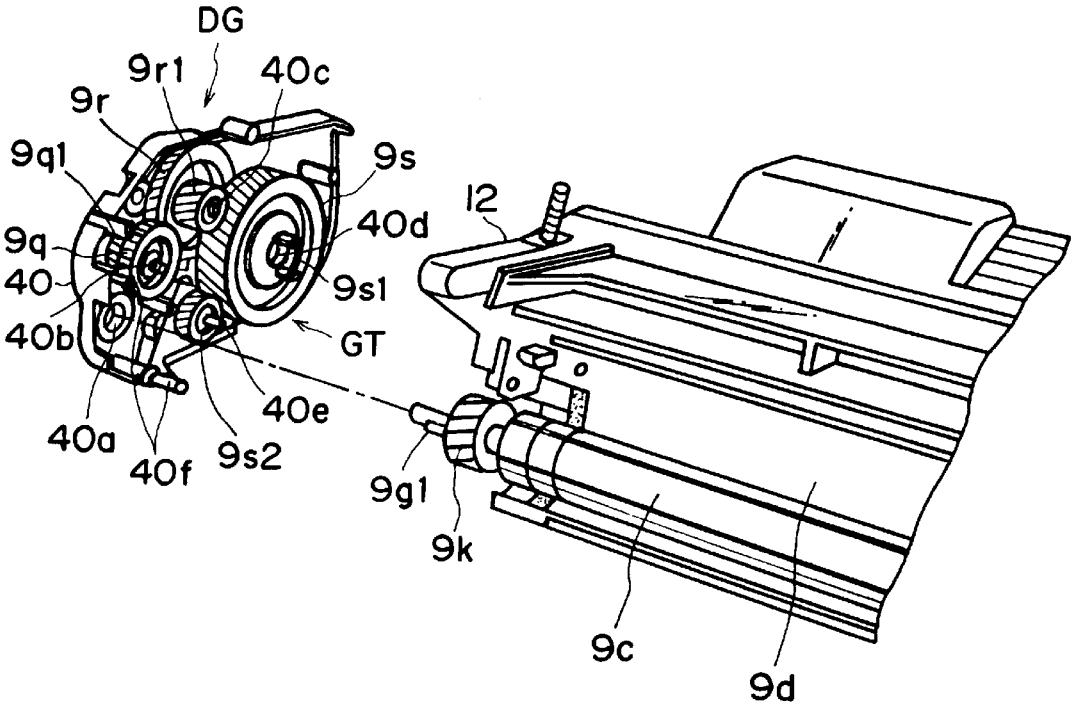
FIG. 15 is a partially exploded perspective view of a gear holding frame portion of the image developing chamber frame, and the gears which drive the image developing unit, depicting the back side thereof.
Figure 17:
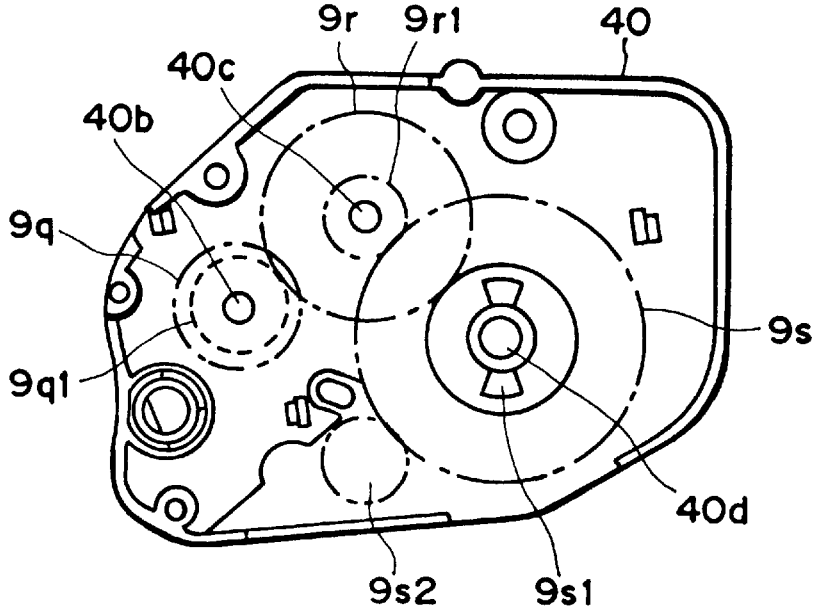
FIG. 17 is a plan view of the gear holding frame portion illustrated in FIG. 15, as seen from the inside of the image developing unit.
Figure 18:
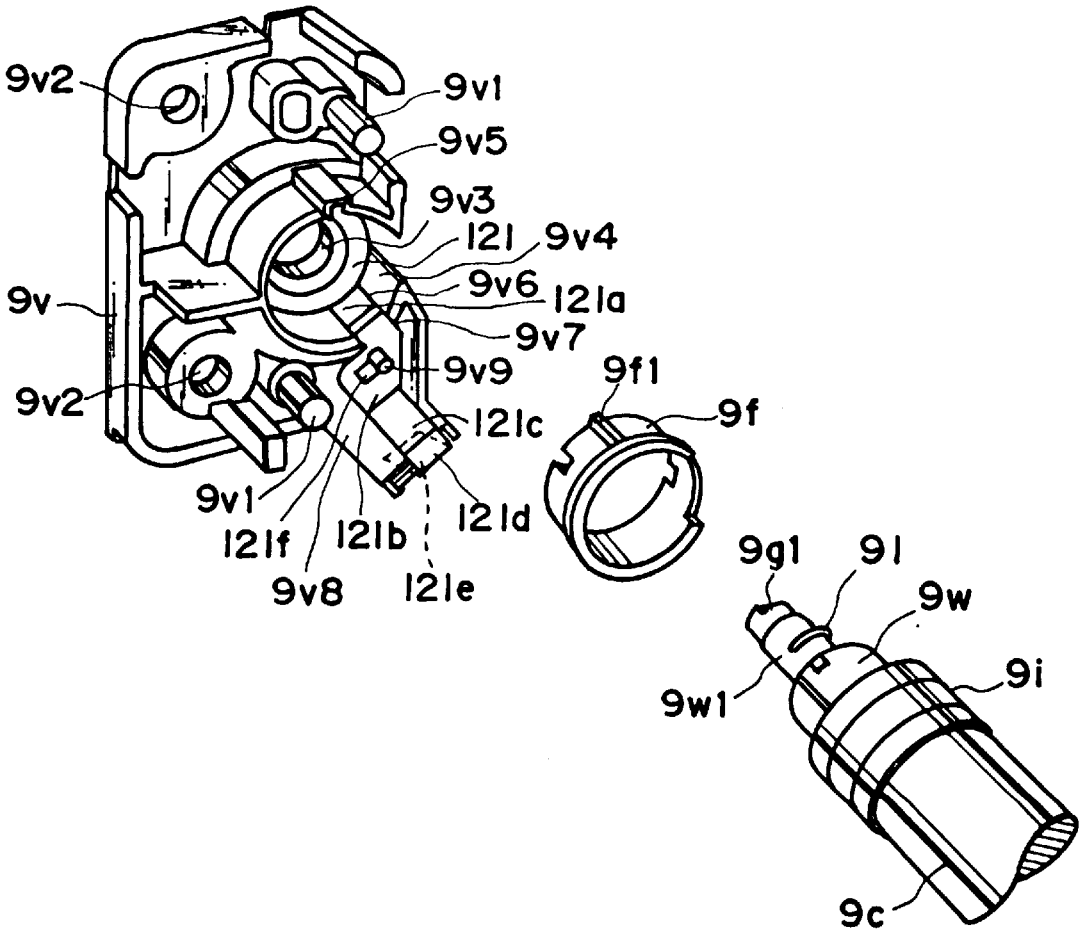
FIG. 18 is a perspective view of an image developing roller bearing box.

The image developing chamber frame 12 of the process cartridge B will be described with reference to FIGS. 3, 14, 15, 16, 17 and 18. FIG. 14 is a perspective view depicting the way various components are assembled into the image developing chamber frame 12; FIG. 15, a perspective view depicting the way a developing station driving force transmitting unit DG is assembled into the image developing chamber frame 12; FIG. 16, a side view of the development unit before the driving force transmitting unit DG is attached; FIG. 17, a side view of the developing station driving force transmitting unit DG as seen from inside the image developing chamber frame 12; and FIG. 18 is a perspective view of the bearing box as seen from inside.

As described before, the developing roller 9*c*, the developing blade 9*d*, the toner stirring member 9*e*, and the rod antenna 9*h* for detecting the toner remainder, are assembled into the image developing chamber frame 12.

Referring to FIG. 14, the developing blade 9*d* comprises an approximately 1 to 2 mm thick metallic plate 9*d*1, and a urethane rubber 9d2 glued to the metallic plate 9d1 with the use of hot melt glue, double-side adhesive tape, or the like. It regulates the amount of toner to be carried on the peripheral surface of the developing roller 9c as the urethane rubber 9d2 is placed in contact with the generatrix of the developing roller 9c. Both the lengthwise ends of the blade mounting reference flat surface 12i, as a blade mount, of the image developing chamber frame 12, are provided with a dowel 12i1, a square projection 12i3, and a screw hole 12i2. The dowel 12i1 and the projection 12i3 are fitted in a hole 9d3 and a notch 9d5, respectively, of the metallic plate 9d1. Then, a small screw 9d6 is put through a screw hole 9d4 of the metallic plate 9d1, and is screwed into the aforementioned screw hole 12i2 with female threads, to fix the metallic plate 9d1 to the flat surface 12i. In order to prevent toner from leaking out, an elastic sealing member 12s formed of MOLTPLANE, or the like, is pasted to the image developing chamber frame 12, along the lengthwise top edge of the metallic plate 9d1. Also, an elastic sealing member 12s1 is pasted to the toner chamber frame 11, along the edge 12j of the curved bottom wall portion which accommodates the developing roller 9c, starting from each lengthwise end of the elastic sealing member 12s. Further, a thin elastic sealing member 12s2 is pasted to the image developing chamber frame 12, along a mandible-like portion 12h, in contact with the generatrix of the developing roller 9c.

The metallic plate 9d1 of the developing blade 9d is bent 90 degrees on the side opposite to the urethane rubber 9d2, forming a bent portion 9d1a.

Next, referring to FIGS. 14 and 18, the image developing roller unit G will be described. The image developing roller unit G comprises: (1) image developing roller 9c; (2) spacer roller 9i for keeping constant the distance between the peripheral surfaces of the developing roller 9c and the photosensitive drum 7, being formed of electrically insulative synthetic resin and doubling a sleeve cap which covers the developing roller 9c at each lengthwise end to prevent electrical leak between the aluminum cylinder portions of the photosensitive drum 7 and the developing roller 9c; (3) developing roller bearing 9j (illustrated in enlargement in FIG. 14); (4) developing roller gear 9k (helical gear) which receives a driving force from a helical drum gear 7b attached to the photosensitive drum 7 and rotates the developing roller 9c; (5) a coil spring type contact 9l, one end of which is in contact with one end of the developing roller 9c (FIG. 18); and (6) a magnet 9g which is contained in the developing roller 9c to adhere the toner onto the peripheral surface of the developing roller 9c.

In FIG. 14, the bearing box 9v has been already attached to the developing roller unit G. However, in some cases, the developing roller unit G is first disposed between the side plates 12A and 12B of the image developing chamber frame 12, and then is united with the bearing box 9v when the bearing box 9v is attached to the image developing chamber frame 12.

Figure 31:
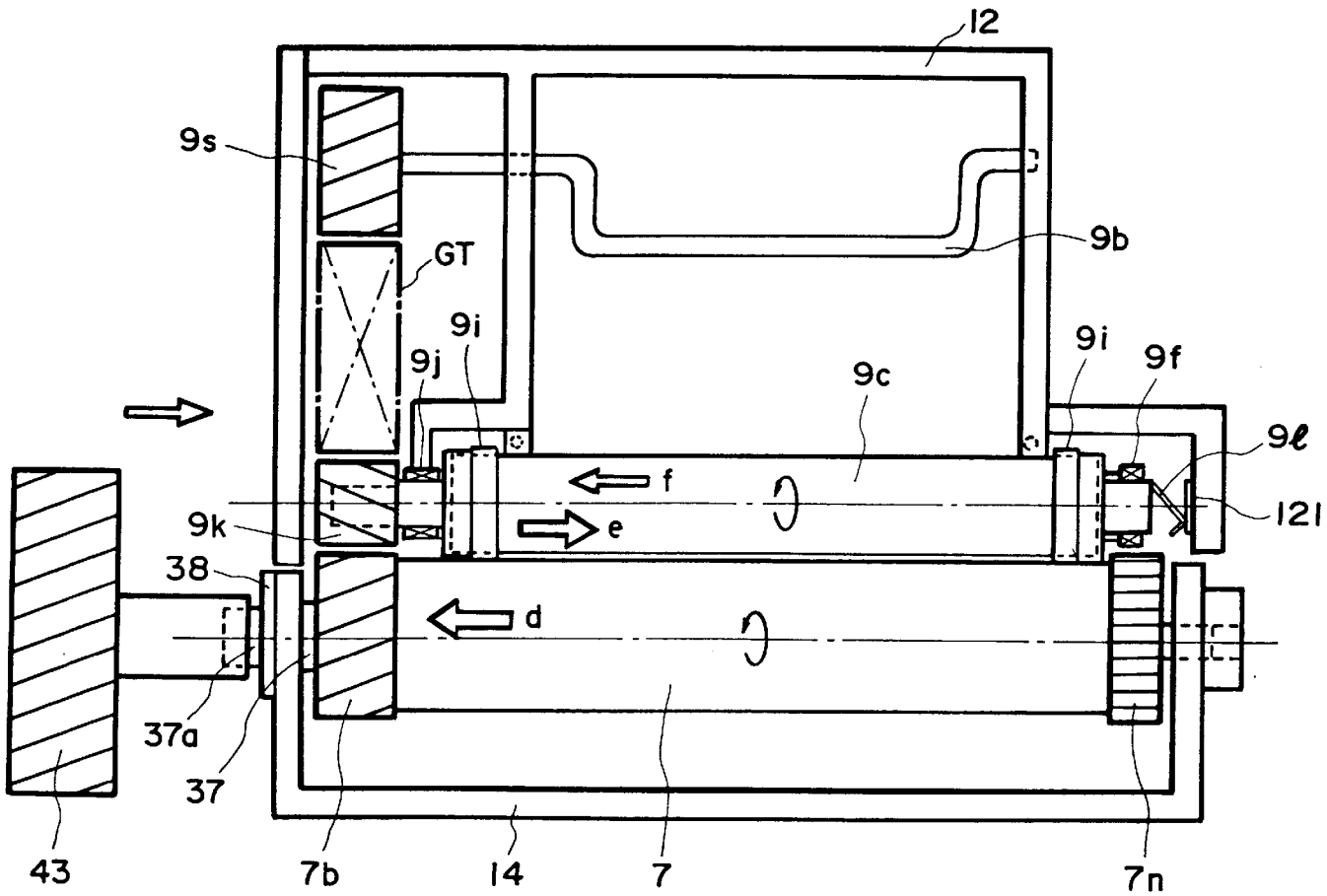
FIG. 31 is a plan view of the process cartridge, depicting the relationship among the various thrust generated in the cartridge, in terms of direction and magnitude.

Referring again to FIG. 14, in the developing roller unit G, the developing roller 9c is rigidly fitted with a metallic flange 9p at one lengthwise end. This flange 9p has a developing roller gear shaft portion 9p1 which extends outward in the lengthwise direction of the developing roller 9c. The developing roller gear shaft portion 9p1 has a flattened portion, with which the developing roller gear 9k mounted on the developing gear shaft portion 9p1 is engaged, being prevented from rotating on the developing roller gear shaft portion 9p1. The developing roller gear 9k is a helical gear, and its teeth are angled so that the thrust generated by the rotation of the helical gear is directed toward the center of the developing roller 9c (FIG. 31). One end of the shaft of the magnet 9g, which is shaped to give it a D-shaped cross-section, projects outward through the flange 9p, and engages with the developing means gear holder 40 to be nonrotatively supported.

The aforementioned developing roller bearing 9j is provided with a round hole having a rotation preventing projection 9j5 which projects into the hole, and in this round hole, the C-shaped bearing 9j4 perfectly fits. The flange 9p rotatively fits in the bearing 9j4. The developing roller bearing 9j is fitted into a slit 12f of the image developing chamber frame 12, and is supported there as the developing means gear holder 40 is fixed to the image developing chamber frame 12 by putting the projections 40g of the developing means gear holder 40 through the corresponding holes 9j1 of the developing roller gear bearing 9j, and then inserting them in the corresponding holes 12g of the image developing chamber frame 12. The bearing 9j4 in this embodiment has a C-shaped flange. However, there will be no problem even if the cross-section of the actual bearing portion of the bearing 9j4 is C-shaped. The aforementioned hole of the development roller bearing 9j, in which the bearing 9j1 fits, has a step. In other words, it consists of a large diameter portion and a small diameter portion, and the rotation preventing projection 9j5 is projecting from the wall of the large diameter portion in which the flange of the bearing 9j4 fit. The material for the bearing 9j, and the bearing 9f which will be described later, is polyacetal, polyamide, or the like.

Although substantially encased in the developing roller 9c, the magnet 9g extends from the developing roller 9c at both lengthwise ends, and is fitted in a D-shaped supporting hole 9v3 of the developing roller bearing box 9v illustrated in FIG. 18, at the end 9g1 having the D-shaped cross-section. In FIG. 18, the D-shaped supporting hole 9v3, which is located in the top portion of the developing roller bearing box 9v, is not visible. At one end of the developing roller 9c, a hollow journal 9w formed of electrically insulative material is immovably fitted within the developing roller 9c, in contact with the internal peripheral surface. A cylindrical portion 9w1, which is integral with the journal 9w and has a smaller diameter than the journal 9w, electrically insulates the magnet 9g from a coil spring type contact 9l which is electrically in contact with the developing roller 9c. The bearing 9f with the aforementioned flange is formed of electrically insulative synthetic resin, and fits in the bearing accommodating hole 9v4, which is coaxial with the aforementioned magnet supporting hole 9v3. A key portion 9f1, integrally formed with the bearing 9f, fits in a key groove 9v5 of the bearing accommodating hole 9v4, preventing the bearing 9f from rotating.

As shown in FIG. 18, the bearing accommodating hole 9v4 has a bottom, and on this bottom, a doughnut-shaped development bias contact 121 is disposed. As the developing roller 9c is assembled into the developing roller bearing box 9v, the metallic coil spring type contact 9l comes in contact with this doughnut-shaped development bias contact 121, and is compressed, establishing thereby an electrical connection. The doughnut-shaped development bias contact 121 has a lead which comprises: a first portion 121a which perpendicularly extends from the outer periphery of the doughnut-shaped portion, fitting in the recessed portion 9v6 of the bearing accommodating hole 9v4, and running along the exterior wall of the bearing 9f up to the cutaway portion located at the edge of the bearing accommodating hole 9v4; a second portion 121b which runs from the cutaway portion, being bent outward at the cutaway portion; a third portion 121*c*, which is bent from the second portion 121*b*; a fourth portion 121*d*, which is bent from the third portion 121*c* in the outward, or radial, direction of the developing roller 9*c*; and an external contact portion 121*e*, which is bent from the fourth portion 121*d* in the same direction.

In order to support the development bias contact 121 having the above described shape, the developing roller bearing box 9*v* is provided with a supporting portion 9*v*8, which projects inward in the lengthwise direction of the developing roller 9*c*. The supporting portion 9*v*8 is in contact with the third and fourth portion 121*c* and 121*d*, and the external contact portion 121*e*, of the lead of the development bias contact 121. The second portion 121*b* is provided with an anchoring hole 121*f*, into which a dowel 9*v*9 projecting inward from the inward facing wall of the developing roller bearing box 9*v* in the lengthwise direction of the developing roller 9*c* is pressed. The external contact portion 121*e* of the development bias contact 121 comes in contact with the development bias contact member 125 of the apparatus main assembly 14 as the process cartridge B is installed in the apparatus main assembly 14, so that a development bias is applied to the developing roller 9*c*. The development bias contact member 125 will be described later.

Two cylindrical projections 9*v*1 of the developing roller bearing box 9*v* are fitted into the corresponding holes 12*m* of the image developing chamber frame 12, which are provided at the lengthwise end as illustrated in FIG. 19. As a result, the developing roller bearing box 9*v* is precisely positioned on the image developing chamber frame 12. Then, an unillustrated small screw is put through each screw hole of the developing roller bearing box 9*v*, and then is screwed into the female-threaded screw hole 12*c* of the image developing chamber frame 12 to fix the developing roller bearing box 9*v* to the image developing chamber frame 12.

As is evident from the above description, in this embodiment, in order to mount the developing roller 9*c* in the image developing chamber frame 12, the developing roller unit G is assembled first, and then, the assembled developing roller unit G is attached to the image developing chamber frame 12.

The developing roller unit G is assembled following the steps described below. First, the magnet 9*g* is put through the developing roller 9*c* fitted with the flange 9*p*, and the journal 9*w* and the coil spring type contact 9*l* for development bias are attached to the end of the developing roller 9*c*. Thereafter, the spacer roller 9*i* and the developing roller bearing 9*j* are fitted around each lengthwise end portion of the developing roller 9*c*, the developing roller bearing 9*j* being on the outer side relative to the lengthwise direction of the developing roller 9*c*. Then, the developing roller gear 9*k* is mounted on the developing roller gear shaft portion 9*p*1 located at the end of the developing roller 9*c*. It should be noted here that the lengthwise end 9*g*1 of the magnet 9*g*, which has a D-shaped cross-section, projects from the developing roller 9*c*, on the side where the developing roller 9*k* is attached; it projects from the end of the cylindrical portion 9*w*1 of the hollow journal 9*w*.

Next, the rod antenna 9*h* for detecting the toner remainder will be described. Referring to FIGS. 14 and 19, one end of the rod antenna 19*h* is bent like that of a crank shaft, wherein the portion comparable to the arm portion of the crank shaft constitutes a contact portion 9*h*1 (toner remainder detecting contact 122), and must be electrically in contact with the toner detecting contact member 126 attached to the apparatus main assembly 14. The toner detection contact member 126 will be described later. In order to mount the rod antenna 9*h* in the image developing chamber frame 12, the rod antenna 9*h* is first inserted into the image developing chamber frame 12 through a through hole 12*b* of a side plate 12B of the image developing chamber frame 12, and the end which is put through the hole 12*b* first is placed in an unillustrated hole of the opposite side plate of the image developing chamber frame 12, so that the rod antenna 9*h* is supported by the side plate. In other words, the rod antenna 9*h* is properly positioned by the through hole 12*b* and the unillustrated hole on the opposite side. In order to prevent toner from invading the through hole 12*b*, an unillustrated sealing member (for example, a ring formed of synthetic resin, a piece of felt or sponge, or the like) is inserted in the through hole 12*b*.

As the developing roller gear box 9*v* is attached to the image developing chamber frame 12, the contact portion 9*h*1 of the rod antenna 9*h*, that is, the portion comparable to the arm portion of a crank shaft, is positioned so that the rod antenna 9*h* is prevented from moving or coming out of the image developing chamber frame 12.

After the toner chamber frame 11 and the image developing chamber frame 12 are united, the side plate 12A of the image developing chamber frame 12, through which the rod antenna 9*h* is inserted, overlaps with the side plate of the toner chamber frame 11, partially covering the toner sealing cap 11*f* of the bottom portion 11*b* of the toner chamber frame 11. Referring to FIG. 16, the side plate 12A is provided with a hole 12*x*, and a shaft fitting portion 9*s*1 (FIG. 15) of the toner feeding gear 9*s* for transmitting a driving force to the toner feeding member 9*b* is put through this hole 12*x*. The shaft fitting portion 9*s*1 is a part of the toner feeding gear 9*s*, and is coupled with the coupling member 11*e* (FIGS. 16 and 20) to transmit a driving force to the toner feeding member 9*b*. As described before, the coupling member 11*e* is engaged with one of the lengthwise ends of the toner feeding member 9*b* and is rotatively supported by the toner chamber frame 11.

Referring to FIG. 19, in the image developing chamber frame 12, the toner stirring member 9*e* is rotatively supported in parallel to the rod antenna 9*h*. The toner stirring member 9*e* is also shaped like a crank shaft. One of the crank-shaft-journal-equivalent portions of the toner stirring member 9*e* is fitted in a bearing hole (unillustrated) of the side plate 12B, whereas the other is fitted with the toner stirring gear 9*m*, which has a shaft portion rotatively supported by the side plate 12A illustrated in FIG. 16. The crank arm equivalent portion of the toner stirring member 9*c* is fitted in the notch of the shaft portion of the toner stirring gear 7*m* so that the rotation of the toner stirring gear 9*m* is transmitted to the toner stirring member 9*e*.

X. Drive Force Transmission to Developing Unit D

Next, transmission of a driving force to the image developing unit D will be described.

Referring to FIG. 15, the shaft 9*g*1 of the magnet 9*g*, which has the D-shaped cross-section, engages with a magnet supporting hole 40*a* of the image developing means gear holder 40. As a result, the magnet 9*g* is nonrotatively supported. As the image developing means gear holder 40 is attached to the image developing chamber frame 12, the developing roller gear 9*k* meshes with a gear 9*g* of a gear train GT, and the toner stirring gear 9*m* meshes with a small gear 9*s*2. Thus, the toner feeding gear 9*s* and the toner stirring gear 9*m* are enabled to receive the driving force transmitted from the developing roller gear 9*k*.

All the gears from the gear 9*q* to the toner gear 9*s* are idler gears. The gear 9*q* which meshes with the developing roller gear 9*k*, and a small gear which is integral with the gear 9*q*, are rotatively supported on a dowel 40*b* which is integral with the image developing means gear holder 40. A large gear 9*r* which engages with the small gear 9*q*1, and a small gear 9*r*1 which is integral with the gear 9*r*, are rotatively supported on the dowel 40*c* which is integral with the image developing means gear holder 40. The small gear 9*r*1 engages with the toner feeding gear 9*s*. The toner feeding gear 9*s* is rotatively supported on a dowel 40*d* which is a part of the image developing means gear holder 40. The toner feeding gear 9*s* has the shaft fitting portion 9*s*1. The toner feeding gear 9*s* engages with a small gear 9*s*2. The small gear 9*s*2 is rotatively supported on a dowel 40*e* which is a part of the image developing means gear holder 40. The dowels 40*b*, 40*c*, 40*d* and 40*e* have a diameter of approximately 5 to 6 mm, and support the corresponding gears of the gear train GT.

With the provision of the above described structure, the gears which constitute the gear train can be supported by a single component (image developing means gear holder 40). Therefore, when assembling the process cartridge B, the gear train GT can be partially preassembled onto the image developing means gear holder 40; and compound components can be preassembled to simplify the main assembly process. In other words, first, the rod antenna 9*h*, and the toner stirring member 9*e* are assembled into the image developing chamber frame 12, and then, the developing roller unit G and the gear box 9*v* are assembled into the developing station driving force transmission unit DG and the image developing chamber frame 12, respectively, completing the image developing unit D.

Referring to FIG. 19, alphanumeric reference characters 12*p* designate an opening of the image developing chamber frame 12, which extends in the lengthwise direction of the image developing chamber frame 12. After the toner chamber frame 11 and the image developing chamber frame 12 are united, the opening 12*p* squarely meets with the opening 11*i* of the toner chamber frame 11, enabling the toner held in the toner chamber frame 11 to be supplied to the developing roller 9*c*. The aforementioned toner stirring member 9*e* and rod antenna 9*h* are disposed along one of the lengthwise edges of the opening 12*p*, across the entire length thereof.

The materials suitable for the image developing chamber frame 12 are the same as the aforementioned materials suitable for the toner chamber frame 11.

XI. Structure of Electrical Contact

Next, referring to FIGS. 8, 9, 11, 23 and 30, connection and positioning of the contacts which establish an electrical connection between the process cartridge B and the image forming apparatus main assembly 14 as the former is installed into the latter will be described.

Referring to FIG. 8, the process cartridge B has a plurality of electrical contacts: (1) cylindrical guide 13*a*L as an electrically conductive contact placed in contact with the photosensitive drum 7 to ground the photosensitive drum 7 through the apparatus main assembly 14 (the actual ground contact is the end surface of the cylindrical guide 13*a*L; it is designated by a numerical reference 119 when referred to as an electrically conductive grounding contact); (2) electrically conductive charge bias contact 120 electrically connected to the charging roller shaft 8*a* to apply a charge bias to the charging roller 8 from the apparatus main assembly 14; (3) electrically conductive development bias contact 121 electrically connected to the developing roller 9*c* to apply a development bias to the developing roller 9*c* from the apparatus main assembly 14; and (4) electrically conductive toner remainder-detecting contact 122 electrically connected to the rod antenna 9*h* to detect the toner remainder. These four contacts 119 to 122 are exposed from the side or bottom wall of the cartridge frame. More specifically, they all are disposed so as to be exposed from the left wall or bottom wall of the cartridge frame, as seen from the direction from which the process cartridge B is installed, being separated from each other by a predetermined distance sufficient to prevent on electrical leak. The grounding contact 119 and the charge bias contact 121 belong to the cleaning unit C, and the development bias contact 121 and the toner remainder detection contact 122 belong to the image developing chamber frame 12. The toner remainder detection contact 122 doubles as a process cartridge detection contact through which the apparatus main assembly 14 detects whether or not the process cartridge B has been installed in the apparatus main assembly 14.

Referring to FIG. 11, the grounding contact 119 is a part of the flange 29 formed of electrically conductive material as described before. Therefore, the photosensitive drum 7 is grounded through a grounding plate 7*f* electrically in connection with the drum portion 7*d* of the photosensitive drum 7, the drum shaft 7*a*, which is integral with the flange 29 and the cylindrical guide 13*a*L and is in contact with the grounding plate 7*f*, and the grounding contact 119, which is the end surface of the cylindrical guide 13*a*L. The flange 29 in this embodiment is formed of metallic material, such as steel. The charge bias contact 120 and the development bias contact 121 are formed of an approximately 0.1 to 0.3 mm thick electrically conductive metallic plate (for example, stainless steel plate and phosphor bronze plate), and are laid (extended) along the internal surface of the process cartridge. The charge bias contact 120 is exposed from the bottom wall of the cleaning unit C, on the side opposite to the side from which the process cartridge B is driven. The development bias contact 121 and the toner remainder detection contact 122 are exposed from the bottom wall of the image developing unit D, also on the side opposite to the side from which the process cartridge B is driven.

This embodiment will be described further in detail.

As described above, in this embodiment, the helical drum gear 7*b* is provided at one of the axial ends of the photosensitive drum 7, as illustrated in FIG. 11. The drum gear 7*b* engages with the developing roller gear 9*k* to rotate the developing roller 9*c*. As it rotates, it generates thrust in the direction indicated in an arrow mark d in FIG. 11. This thrust pushes the photosensitive drum 7, which is disposed in the cleaning chamber frame 13, with a slight play in the longitudinal direction, toward the side on which the drum gear 7*b* is mounted. Further, the reactive force, which is generated as the grounding plate 7*f* fixed to the spur gear 7*n* is pressed against the drum shaft 7*a*, adds to the thrust, in the direction of the arrow mark d. As a result, the outward edge 7*b*1 of the drum gear 7*b* remains in contact with the surface of the inward end of the bearing 38 fixed to the cleaning chamber frame 13. Thus, the position of the photosensitive drum 7 relative to the process cartridge B in the axial direction of the photosensitive drum 7 is regulated. The grounding contact 119 is exposed from the side plate 13*k* of the cleaning chamber frame 13. The drum shaft 7*a* extends into the base drum 7*d* (aluminum drum in this embodiment) coated with a photosensitive layer 7*e*, along the axial line.

The base drum 7*d* and the drum shaft 7*a* are electrically connected through the internal peripheral surface 7*d*1 of the base drum 7*d* and the grounding plate 7*f* in contact with the end surface 7*a*1 of the drum shaft 7*a*.

Figure 23:
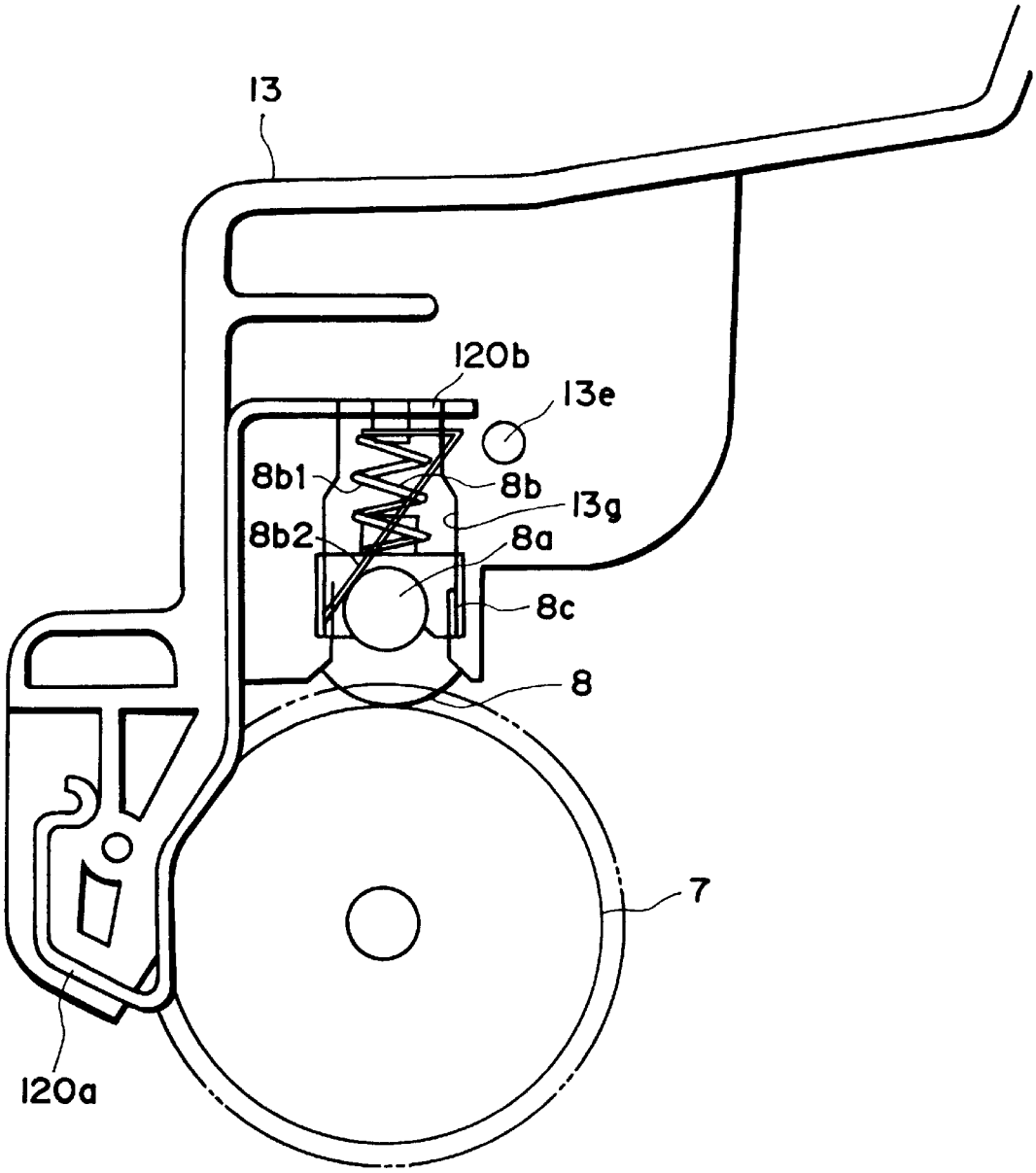
FIG. 23 is a vertical section of the structure which supports the photosensitive drum charging roller.
Figure 24:
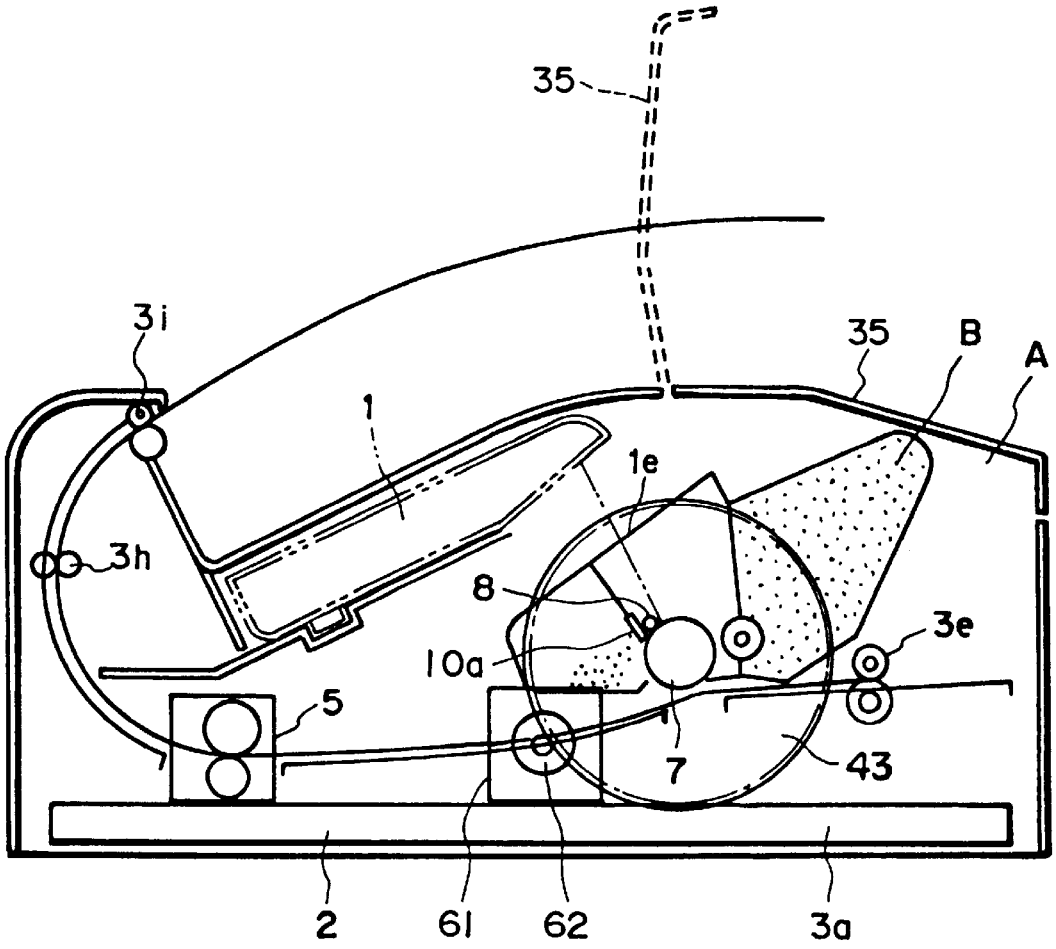
FIG. 24 is a schematic section of the driving system for the main assembly of the apparatus illustrated in FIG. 1.

The charge bias contact 120 is attached to the cleaning chamber frame 13, adjacent to where the charging roller 8 is supported (FIG. 8). Referring to FIG. 23, the charge bias contact 120 is electrically in contact with the shaft 8*a* of the charging roller 8 by way of a compound spring 8*b*, which is in contact with the charge roller shaft 8*a*. This compound spring 8*b* is constituted of a compression spring portion 8*b*1 and an internal contact portion 8*b*2. The compression coil portion 8*b*1 is placed between the spring seat 120*b* and a charging roller bearing 8*c*. The internal contact portion 8*b*2 extends from the spring seat side end of the compression spring portion 8*b*1 and presses on the charge roller shaft 8*a*. The charging roller bearing 8*c* is slidably fitted in a guide groove 13*g*, and the spring seat 120*b* is located at the closed end of the guiding groove 13*g*. The guide groove 13*g* extends in the direction of an imaginary line that runs through the centers of the cross-sections of the charging roller 8 and photosensitive drum 7, the center line of the guiding groove 3*g* substantially coinciding with this imaginary line. Referring to FIG. 23, the charge bias contact 120 enters the cleaning chamber frame 13 at the location where it is exposed, runs along the internal wall of the cleaning chamber frame 13, bends in the direction which intersects with the direction in which the charge roller shaft 8*a* of the charging roller 8 is moved, and ends at the spring seat 120*b*.

Next, the development bias contact 121 and the toner remainder detection contact 122 will be described. Both contacts 121 and 122 are disposed on the bottom surface (the surface of the image developing unit D, which faces downward when the process cartridge B is in the apparatus main assembly 14) of the image developing unit D, on the same side as the side plate 13*k* of the cleaning chamber frame 13. The aforementioned third portion 121*e* of the development contact 121, that is, the portion exposed from the image developing unit D, is disposed so as to oppose the charge bias contact 120 across the spur gear 7*n*. As described previously, the development bias contact 121 is electrically in contact with the developing roller 9*c* through the coil spring type contact 9*l*, which is electrically in contact with the lengthwise end of the developing roller 9*c* (FIG. 18).

FIG. 31 schematically illustrates the relationship between the thrusts generated by the drum gear 7*b* and the developing roller gear 9*k* and the development bias contact 121. As stated before, the photosensitive drum 7 is shifted in the direction of the arrow mark d in FIG. 31 as the process cartridge B is driven. As a result, the end surface of the photosensitive drum 7 on the drum gear 7*b* side remains in contact with the end surface of the bearing 38, which is not illustrated in FIG. 31; the position of the photosensitive drum 7 in terms of the lengthwise direction thereof becomes fixed. On the other hand, the developing roller gear 9*k*, which meshes with the drum gear 7*b*, is thrusted in the direction of an arrow mark e, which is opposite to the direction of the arrow mark d. As a result, it presses the coil spring type contact 9*l*, which is pressing the development bias contact 121. Consequently, the pressure generated by the coil spring type contact 9*l* in the direction of an arrow mark f, that is, in the direction to press the developing roller 9*c* against developing roller bearing 9*j*, is reduced. Thus, it is assured that the coil spring type contact 9*l* and the development bias contact 121 never fail to remain in contact with each other, while the friction between the end surfaces of the developing roller 9*c* and developing roller bearing 9*j* is reduced to allow the developing roller 9*c* to rotate smoothly.

The toner remainder detection contact 122 illustrated in FIG. 8 is attached to the image developing chamber frame 12, being exposed on the upstream side of development bias contact 121 relative to the direction in which the process cartridge B is inserted (the direction of an arrow mark X in FIG. 9). As is evident from FIG. 19, the toner remainder detection contact 122 is a part of the rod antenna 9*h*, which is formed of an electrically conductive material, such as metallic wire, and is extended in the lengthwise direction of the developing roller 9*c*. As described previously, the rod antenna 9*h* stretches across the entire length of the developing roller 9*c*, holding a predetermined distance from the developing roller 9*c*. It comes in contact with the toner detection contact member 126 of the apparatus main assembly 14 as the process cartridge B is inserted into the apparatus main assembly 14. The capacitance between the rod antenna 9*h* and the developing roller 9*c* changes according to the amount of the toner prevent between the two. Therefore, the change in this capacitance is detected as a potential difference by a control section (unillustrated) electrically connected to the toner detection contact member 126 of the apparatus main assembly 14 to determine the amount of the toner remainder.

The term "toner remainder " refers to an amount of toner that induces a predetermined amount of capacitance when the toner is placed between the developing roller 9*c* and the rod antenna 9*h*. In other word, the control section detects that the amount of the toner in the toner container 11A has been reduced to a predetermined amount; the control section of the apparatus main assembly 14 detects through the toner remainder detection contact 122 that the capacitance has reached the first predetermined value, and therefore, determines that the amount of the toner within the toner container 11A has dropped to a predetermined amount. Upon detecting that the capacitance has reached the first value, the control section of the apparatus main assembly 14 informs the user that the process cartridge B should be replaced; for example, it flashes an indicator light or sounds a buzzer. On the contrary, when the control section detects that the capacitance shows a predetermined second value which is smaller than the predetermined first value, it determines that the process cartridge B has been installed in the apparatus main assembly 14. It does not allow the image forming operation of the apparatus main assembly 14 to be started unless it detects the completion of the process cartridge B installation in the apparatus main assembly 14.

The control section may be enabled to inform the user of the absence of the process cartridge B in the apparatus main assembly 14, by flashing an indicator light, for example.

XII. Construction of Electric Contacts of Main Assembly 14 of Image Forming Apparatus Next, the connection between the electrical contacts of the process cartridge B and the electrical contact members of the apparatus main assembly 14 will be described.

Referring to FIG. 9, disposed on the internal surface of on the left-hand side wall of the cartridge accommodating space S in the image forming apparatus A are four contact members, which come in contact with the aforementioned contacts 119 to 122 as the process cartridge B is inserted into the apparatus main assembly 14; a grounding contact member 123, which comes electrically in contact with the grounding contact 119; a charge bias contact member 124, which comes electrically in contact with the charge bias contact 120; a development bias contact member 125, which electrically come in contact with the development bias contact 121; and a toner detection contact member 126, which comes electrically in contact with the toner remainder detection contact 122.

As illustrated in FIG. 9, the grounding contact member 123 is at the bottom portion of the positioning groove 16*b*. The development bias contact member 125, the toner detection contact member 126, and the charging roller contact member 124 are disposed, facing upward, on the bottom surface of the cartridge accommodating space S, below the guide portion 16*a* and adjacent to the left-hand side wall. They are enabled to move elastically in the vertical direction.

At this point, the positional relationship between each contact and the guide will be described.

Referring to FIG. 6, which illustrates the process cartridge B in a substantially horizontal position, the toner-remainder-detection contact 122 is at the lowest level. The development bias contact 121 is positioned higher than the toner remainder detection contact 122, and the charge bias contact 120 is positioned higher than the development bias contact 121. The rotation controlling guide 13*b*L and the cylindrical guide 13*a*L (grounding contact 119) are positioned higher than the charge bias contact 120, being approximately at the same level. In terms of the direction (indicated by the arrow mark X) in which the process cartridge B is inserted, positioned most upstream is the toner-remainder-detection contact 122, and the rotation controlling guide 13*b*L, the development-bias contact 121, the cylindrical guide 13*a*L (grounding contact 119), and the charge-bias contact 120, are disposed in this order toward the downstream direction. With the provision of this positional arrangement, the charge bias contact 120 is positioned close to the charging roller 8; the development bias contact 121 is close to the developing roller 9*c*; the toner-remainder-detection contact 122 is close to the rod antenna 9*h*; and the grounding contact 119 is positioned close to the photosensitive drum 7. In other words, the distance between each contact and a related component can be reduced without intricately laying a long electrode in the process cartridge B and the image forming apparatus main assembly 14.

The dimensions of the actual contact area of each contact are as follows. The charge bias contact 120 measures approximately 10.0 mm in both the horizontal and vertical directions; the development bias contact 121 measures approximately 6.5 mm in the vertical direction and approximately 7.5 mm in the horizontal direction; the toner-remainder-detection contact 122 is 2.0 mm in diameter and approximately 18.0 mm in the horizontal direction; and the grounding contact 119, which is circular, measures approximately 10.0 mm in external diameter. The charge bias contact 120 and the development bias contact 121 are rectangular. In measuring the dimension of the contact area, the term "vertical" refers to the direction parallel to the direction X in which the process cartridge B is inserted, and the term "horizontal" refers to the direction perpendicular to the direction X.

Figure 30:
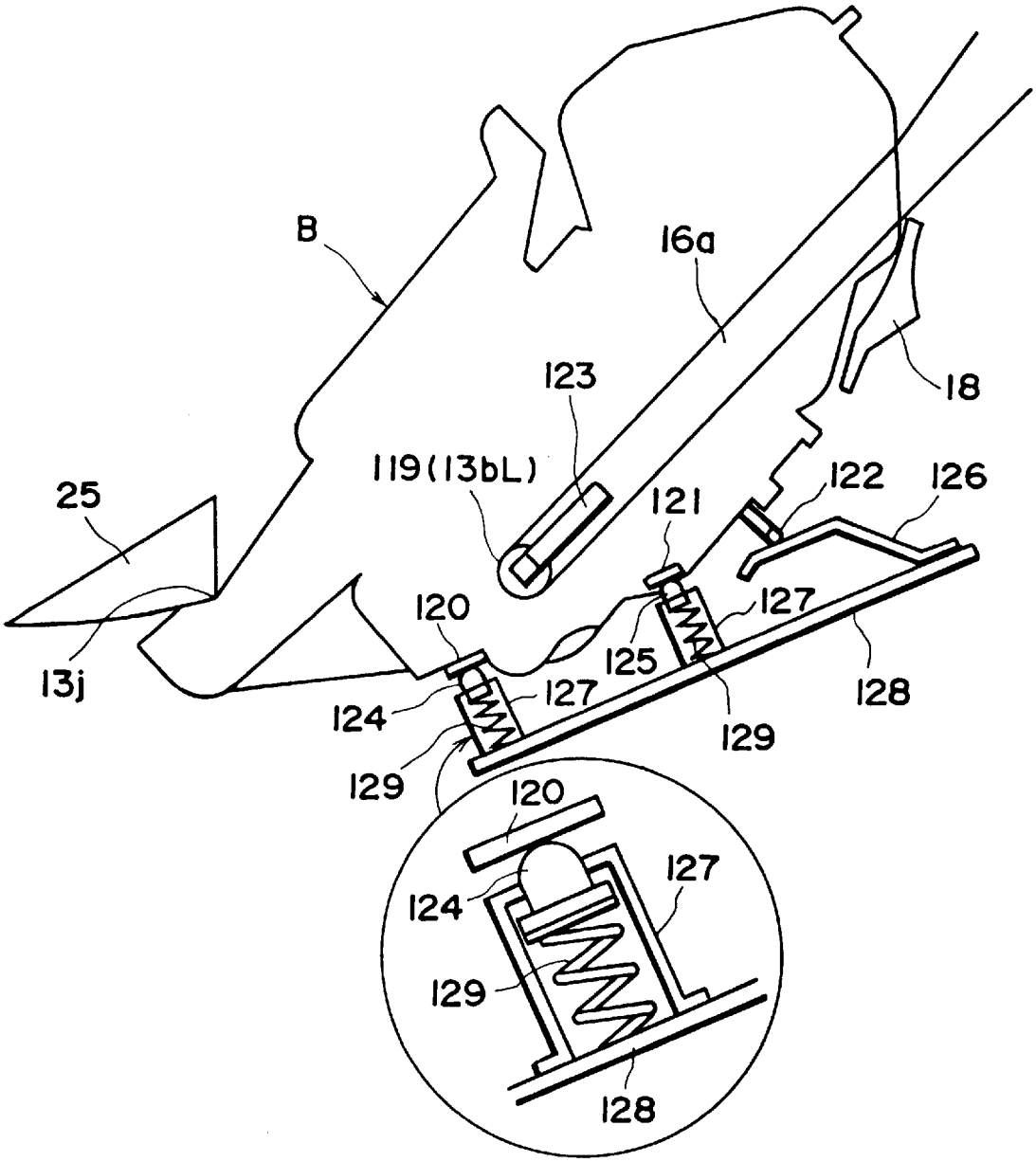
FIG. 30 is a vertical view of the process cartridge in the apparatus main assembly and regions adjacent thereto, depicting the positional relationship among the electrical contacts as seen while the process cartridge is installed into, or removed from, the apparatus main assembly.

The grounding contact member 123 is an electrically conductive plate spring. It is disposed in the positioning groove 16*b* (position of the drum shaft 7*a* is fixed) in which the grounding contact 119 of the process cartridge B, that is, the cylindrical guide 13*a*L, fits (FIGS. 9, 11 and 30). It is grounded through the chassis of the apparatus main assembly 14. The toner-remainder-detection contact member 126 is also an electrically conductive plate spring. It is disposed adjacent to the guide portion 16*a*, being next to the guide portion 16*a* in terms of the horizontal direction, but below in terms of the vertical direction. The other contact members 124 and 125 are also disposed adjacent to the guide portion 16*a*, being slightly farther away from the guide portion 16*a* than the toner-remainder-detection contact member 126 in terms of the horizontal direction, and below the guide portion 16*a* in terms of the vertical direction. The contact members 124 and 125 are provided with a compression-type coil spring 129, and therefore, they project upward from their holders 127. This arrangement will be described more specifically referring to the charging roller contact member 124. Referring to the enlarged view of the charging roller contact member 124 in FIG. 30, the charging roller contact member 124 is placed in the holder 127 so that it is allowed to project upward from the holder 127 without slipping out. Then, the holder 127 is fixed to the electrical substrate 128 attached to the apparatus main assembly 14. The contact member 124 is electrically connected to the wiring pattern through an electrically conductive compression type coil spring 129.

Before the process cartridge B inserted in the image forming apparatus A is guided to a predetermined position by the guide portion 16*a*, the contact members 123 to 126 of the image forming apparatus A remain projected by the springs as far as they are allowed to project. In this state, none of the contact members 123 to 126 is in contact with their counterparts, that is, the contacts 119 to 122 of the process cartridge B. As the process cartridge B is inserted farther, the contact members 123 to 126 come in contact with the corresponding contacts 119 to 122 of the process cartridge B one by one. Then, as the cylindrical guide 13*a*L of the process cartridge B is fitted into the positioning groove 16*b* by additional inward movement of the process cartridge B, the contact members 123 to 126 of the apparatus main assembly 14 are pushed down by the corresponding contacts 119 to 122 of the process cartridge B against the elastic force of the compression type coil springs 129 in the holder 127. As a result, the contact pressures between the contact members 123 to 126 and the corresponding contacts 119 to 122 are increased.

As described above, according to this embodiment of the present invention, as the process cartridge B is guided to a predetermined position in the apparatus main assembly 14 by the guide member 16, the contacts of the process cartridge B reliably make contact with the contact members of the apparatus main assembly 14.

As the process cartridge B is installed in the predetermined position, the grounding contact member 123, which is in the form of a plate spring, comes in contact with the grounding contact 119, which is projecting from the cylindrical guide 13*a*L (FIG. 11); and the grounding contact 119 is electrically connected to the grounding contact member 123, and as a result, the photosensitive drum 7 is grounded. The charge bias contact 120 and the charging roller contact member 124 becomes electrically connected to allow high voltage (a voltage composed by superposing AC voltage and DC voltage) to be applied to the charging roller 8. The development bias contact 121 and the development bias contact member 125 make electrical connection to each other to allow high voltage to be applied to the developing roller 9*c*. The toner-remainder-detection contact 122 comes electrically in contact with the toner detection contact member 126, and information reflecting the capacitance between the developing roller 9*c* and the rod antenna 9*h* (contact 122) is transmitted to the apparatus main assembly 14 through the contact 122.

Further, the contacts 119 to 122 of the process cartridge B are disposed on the bottom side of the process cartridge B, and therefore, the reliability of contact between the contacts 119 to 122 and the corresponding contact members is not affected by the accuracy in their positional relationship in terms of a direction perpendicular to the direction of the arrow X in which the process cartridge B is inserted.

Further, all the contacts of the process cartridge B are positioned on one side of the cartridge frame. Therefore, the mechanical members and the electrical wiring members of the image forming apparatus main assembly 14 and the process cartridge B can be separately positioned on the appropriate sides of the cartridge accommodating space S, and the process cartridge B, to reduce the number of assembly steps and simplify maintenance.

As the lid 35 is closed after the process cartridge B is inserted into the image forming apparatus main assembly 14, the coupling device on the process cartridge side connects with the coupling device on the apparatus main assembly side in synchronism with the movement of the lid 35, enabling the photosensitive drum 7 and the like to receive a driving force from the apparatus main assembly 14 to be rotated.

Further, since all electrical contacts of the process cartridge B are disposed on one side of the cartridge frame, reliable electrical connection can be established between the image forming apparatus main assembly 14 and the process cartridge B.

Further, positioning each electrical contact in the above described manner makes it possible to reduce the distance the corresponding electrode must be routed in the cartridge frame.

XIII. Coupling and Driving Structure

A description will be provided as to a structure of coupling means which is a drive transmission mechanism for transmitting the driving force to the process cartridge B from the main assembly 14 of the image forming apparatus.

Referring to FIG. 11, there is shown a longitudinal sectional view of a coupling portion wherein the photosensitive drum 7 is mounted to the process cartridge B.

Cartridge side coupling means is provided to one longitudinal end of the photosensitive drum 7 mounted to the process cartridge B, as shown in FIG. 11. The coupling means is in the form of a male coupling shaft 37 (circular column configuration) formed on a drum flange 36 fixed to the one end of the photosensitive drum 7. The end surface 37*a*1 of the projection 37*a* is parallel with the end surface of the male shaft 37. The male shaft 37 is engageable with a bearing 38 to function as a drum shaft. In this example, the drum flange 36, the male coupling shaft 37 and the projection 37*a* are integrally formed. The drum flange 36 is integrally provided with a helical drum gear 7*b* to transmit the driving force to the developing roller 9*c* in the process cartridge B. Therefore, as shown in FIG. 11, the drum flange 36 is an integrally molded product of plastic resin material having a drum gear (helical gear) 7*b*, a male shaft 37, and the projection 37*a* to constitute a driving-force transmitting part having the function of transmitting a driving force.

The projection 37*a* has the configuration of a twisted prism, and more particularly, it has a cross-section of a substantially equilateral triangle, and is gradually twisted to a small extent in the axial direction. The corner portion of the prism is rounded. The recess 39*a* for engaging with the projection 37*a* has a cross-section of polygonal shape, and is gradually twisted to a small extent in the axial direction. The projection 37*a* and the recess 39*a* are twisted in the same direction with the same twisting pitch. The section of the recess 39*a* is of a substantially triangular shape in this embodiment. The recess 39*a* is provided in a female coupling shaft 39*b* which is integral with a gear 43 in the main assembly 14 of the apparatus. The female coupling shaft 39*b* is rotatable and movable in the axial direction relative to the main assembly 14 of the apparatus. With this structure of this example, when the process cartridge B is mounted to the main assembly 14 of the apparatus, the projection 37*a* enters the recess 39*a* provided in the main assembly 14.

When the recess 39*a* starts to rotate, the recess 39*a* and the projection 37*a* are brought into engagement with each other. When the rotating force of recess 39*a* is transmitted to the projection 37*a*, the edge lines 37*a*2 of the substantially equilateral triangle projection 37*a* and the inner surfaces 39*a*2 of the recess 39*a*, uniformly contact each other, and therefore, the axes are aligned. To accomplish this, the diameter of the circumscribed circle R0 of the male coupling projection 37*a* is larger than that of the inscribed circle R1 of the female coupling recess 39*a*, and is smaller than that of the circumscribed circle R2 of the female coupling recess 39*a*. The twisting produces such a force that projection 37*a* is pulled toward the recess 39*a*, so that end surface of the projection 37*a*1 is abutted to the bottom 39*a*1 of the recess 39*a*. Thus, a thrust force is produced to urge the drum gear 7*b* in the direction of an arrow d, and therefore, the photosensitive drum 7 integral with the projection 37*a* is stably positioned in the main assembly 14 of the image forming apparatus, both in the axial direction and in the radial direction.

In this example, the twisting direction of the projection 37*a* is opposite from the rotational direction of the photosensitive drum 7 in the direction from the bottom trunk of the projection 37*a* toward the free end thereof, as seen from the photosensitive drum 7; the twisting direction of the recess 39*a* is opposite in the direction from the inlet of the recess 39*a* toward the inside; and the twisting direction of the drum gear 7*b* of the drum flange 36 is opposite from the twisting direction of the projection 37*a*.

The male shaft 37 and the projection 37*a* are provided on the drum flange 36 such that when the drum flange 36 is mounted to end of the photosensitive drum 7, they are coaxial with the axis of the photosensitive drum 7. Designated by 36*b* is an engaging portion which is engaged with the inner surface of the drum cylinder 7*d* when the drum flange 36 is mounted to the photosensitive drum 7. The drum flange 36 is mounted to the photosensitive drum 7 by crimping or bonding. The circumference of the drum cylinder 7*d* is coated with a photosensitive layer 7*e*.

As described in the foregoing, a spur gear 7*n* is fixed to the other end of the photosensitive drum 7.

Examples of the material of the spur gear 7*n* and the drum flange 36 include polyacetal (polyacetal), polycarbonate (polycarbonate), polyamide (polyamide) and polybutylene terephthalate (polybutylenetelephthalate) or another resin material. However, another material is usable.

Around the projection 37*a* of the male coupling shaft 37 of the process cartridge B, there is provided a cylindrical projection 38*a* (cylindrical guide 13*a*R) coaxial with the male shaft 37, which projection 38*a* is integral with a bearing 38 fixed to a cleaning frame 13. The projection 37*a* of the male coupling shaft 37 is protected when, for example, the process cartridge B is mounted or demounted, and therefore, it is not damaged or deformed. Thus, the possible play or vibration during driving through the coupling due to damage of the projection 37*a*, can be prevented.

The bearing 38 may function as a guiding member when the process cartridge B is mounted or demounted relative to the main assembly 14 of the image forming apparatus. More particularly, when the process cartridge B is mounted to the main assembly 14 of the image forming apparatus, the projection 38*a* of the bearing 38 and the side guide portion 16*c* of the main assembly are contacted, and the projection 38*a* functions to position the process cartridge B to the mounting position (guide 13*a*R) to facilitate the mounting and demounting of the process cartridge B relative to the main assembly 14 of the apparatus. When the process cartridge B is mounted to the mounting position, the projection 38*a* is supported by a positioning groove 16*d* formed in the guide portion 16*c*.

Among the photosensitive the drum 7, drum flange 36 and the male coupling shaft 37, there is a relation shown in FIG. 11. More particularly, H>F≧M, and E>N, where H is an outer diameter of the photosensitive drum 7; E is a circle diameter of a dedendum of the drum gear 7*b*; F is a diameter of the bearing of the photosensitive drum 7 (an outer diameter of the shaft portion of the male coupling shaft 37, and an inner diameter of the bearing 38); M is a circumscribed circle diameter of the male coupling projection 37*a*; and N is a diameter of the engaging portion between the photosensitive drum 7 and the drum flange 36 (the inner diameter of the drum).

By H>F, the sliding load torque at the bearing portion can be reduced than when the drum cylinder 7*d* is born; by F≧M, the mold structure can be simplified since no undercut portion is provided, in view of the fact that when the flange portion is molded, the mold is divided normally in a direction of the arrow p in the Figure.

By E>N, the mold configuration of the gear portion is formed above the left mold as seen in the direction of mounting of the process cartridge B, and therefore, the right-hand mold can be simplified to improve the durability of the mold.

Figure 25:
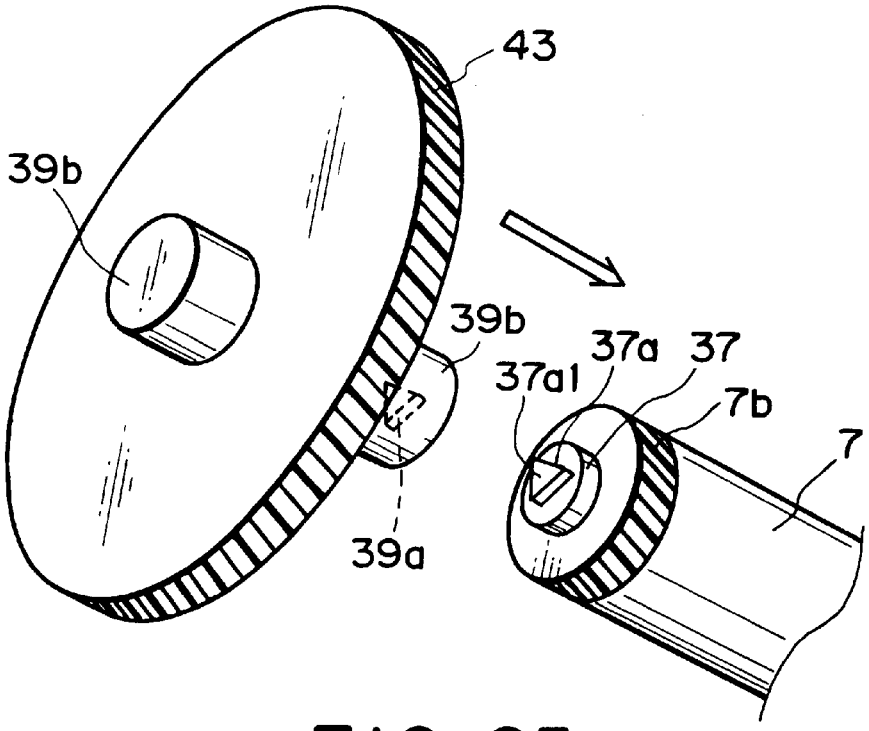
FIG. 25 is a perspective view of a coupling provided on the apparatus main assembly side, and a coupling provided on the process cartridge side.
Figure 26:
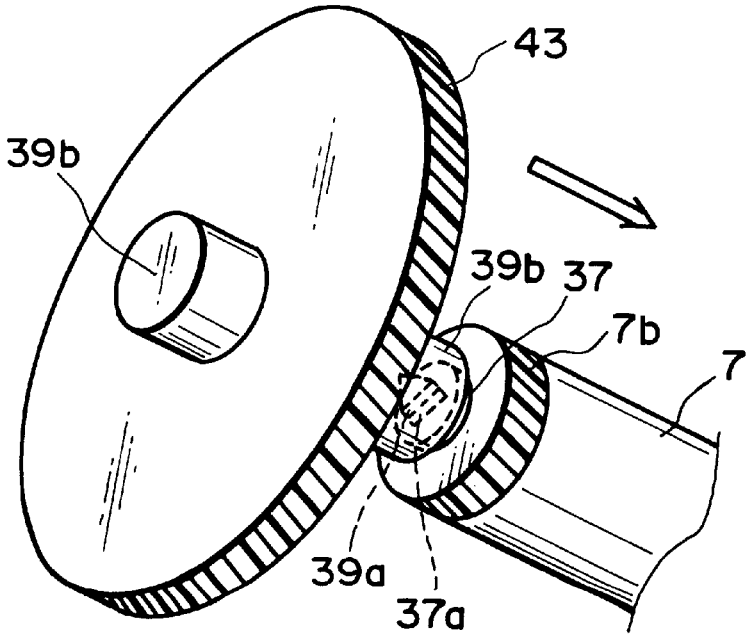
FIG. 26 is a perspective view of the coupling provided in the apparatus main assembly side, and the coupling provided on the process cartridge side.

The main assembly 14 of the image forming apparatus is provided with coupling means of the main assembly. The coupling means of the main assembly has a female coupling shaft 39*b* (circular column configuration) at a position aligned with the rotation axis of the photosensitive drum when the process cartridge B is inserted (FIGS. 11 and 25). The female coupling shaft 39*b*, as shown in FIG. 11, is a driving shaft integral with a large gear 43 for transmitting the driving force to the photosensitive drum 7 from the motor 61. The female shaft 39*b* is projected from the lateral edge of the large gear 43 at the center of rotation of the large gear 43. In this example, the large gear 43 and the female coupling shaft 39*b* are integrally molded.

The large gear 43 in the main assembly 14 is a helical gear, which is in meshing engagement with a small helical gear 62 fixed to or integral with the shaft 61*a* of the motor 61; the twisting directions and the inclination angles thereof are such that when the driving force is transmitted from the small gear 62, female shaft 39*b* is moved toward the male shaft 37 by the thrust force produced. Thus, when the motor 61 is driven for the image formation, the female shaft 39*b* is moved toward the male shaft 37 by the thrust force to establish engagement between the recess 39*a* and the projection 37*a*. The recess 39*a* is provided at the end of the female shaft 39*b* in alignment with the center of rotation of the female shaft 39*b*.

In this embodiment, the driving force is directly transmitted from the small gear 62 of the motor shaft 61*a* to the large gear 43, but it may be transmitted through a speed reduction gear train, belt-pulley means, a couple of friction rollers, a combination of a timing belt and a pulley.

Referring to FIGS. 24 and 27 to FIG. 29, a description will be provided as to a structure for engaging the recess 39*a* and the projection 37*a* in interrelation with the closing operation of the openable cover 35.

Figure 29:
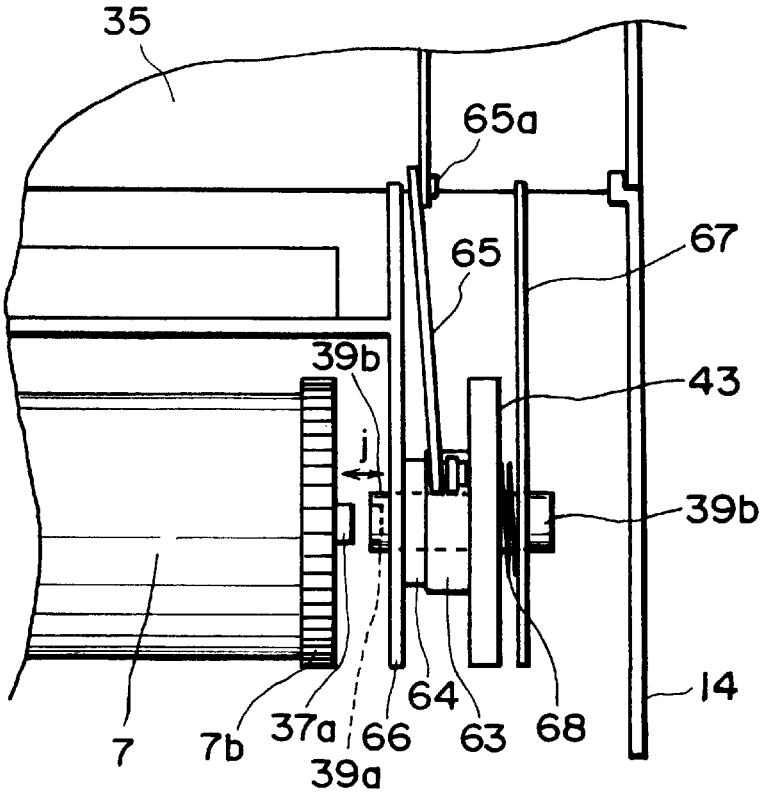
FIG. 29 is a front view of the indented coupling shaft and regions adjacent thereto as seen while the process cartridge in the apparatus main assembly is driven.

As shown in FIG. 29, a side plate 67 is fixed between the large gear 43 and the side plate 66 in the main assembly 14, and the female coupling shaft 39*b* coaxially integral with the large gear 43 is rotatably supported by the side plates 66, 67. An outer cam 63 and an inner cam 64 are closely inserted into between the large gear 43 and the side plate 66. The inner cam 64 is fixed to the side plate 66, and the outer cam 63 is rotatably engaged with the female coupling shaft 39*b*. The surfaces of the outer cam 63 and the inner cam 64, which are substantially perpendicular to the axial direction and which face each other, are cam surfaces, and are screw surfaces coaxial with the female coupling shaft 39*b* and contact to each other. Between the large gear 43 and the side plate 67, a compression coil spring 68 is compressed and fitted around the female coupling shaft 39*b*.

Figure 27:
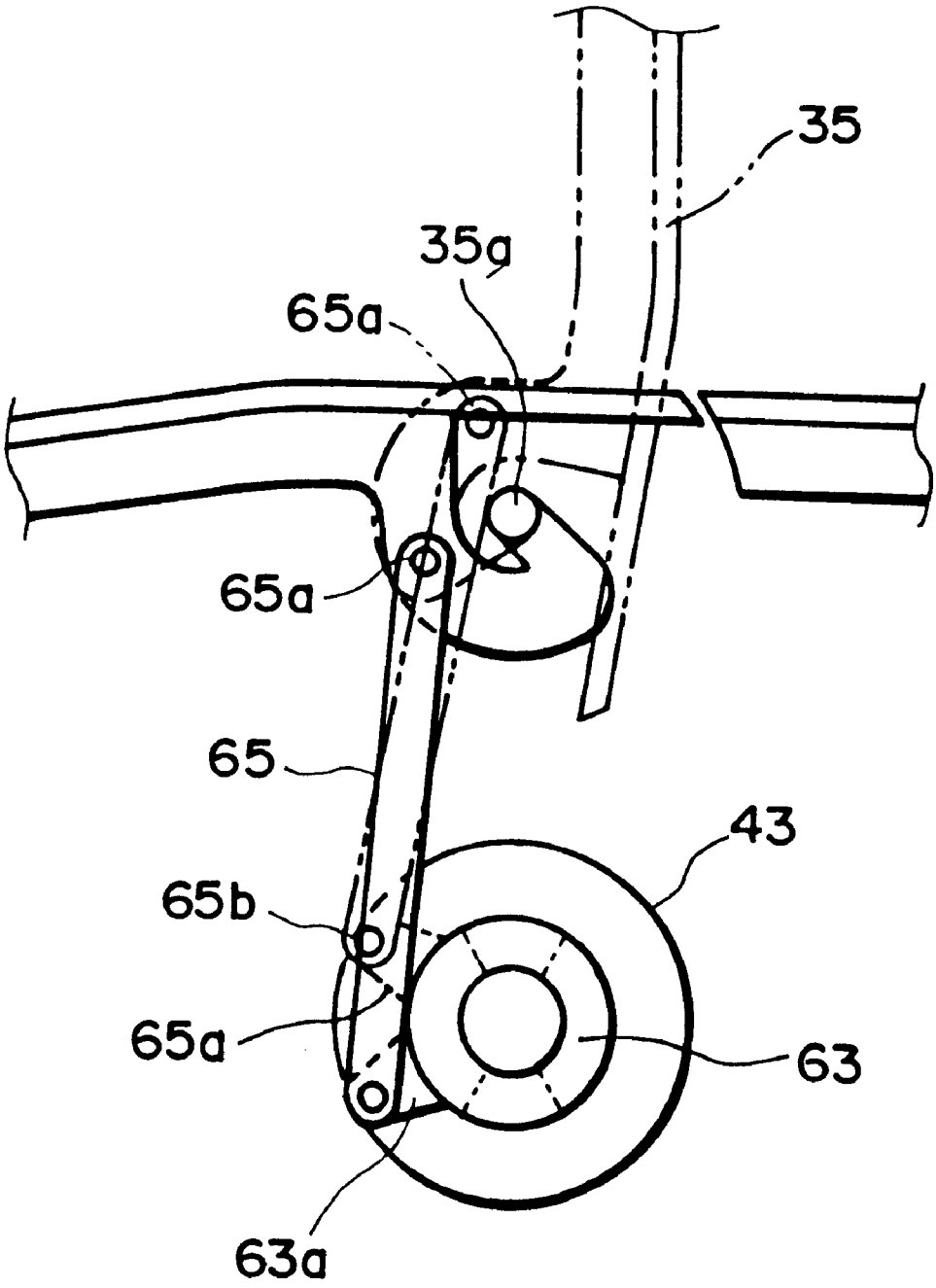
FIG. 27 is a section of the structure which links the lid of the apparatus main assembly, and the coupling portion of the apparatus main assembly.

As shown in FIG. 27, an arm 63*a* is extended from an outer periphery of the outer cam 63 in a radial direction, and an end of the arm 63*a* is coupled with an end of a link 65 by a pin 65*a* at a position opposite from the opening side when the openable cover 35 is closed. The other end of the link 65 is combined with an end of the arm 63*a* by a pin 65*b*.

Figure 28:
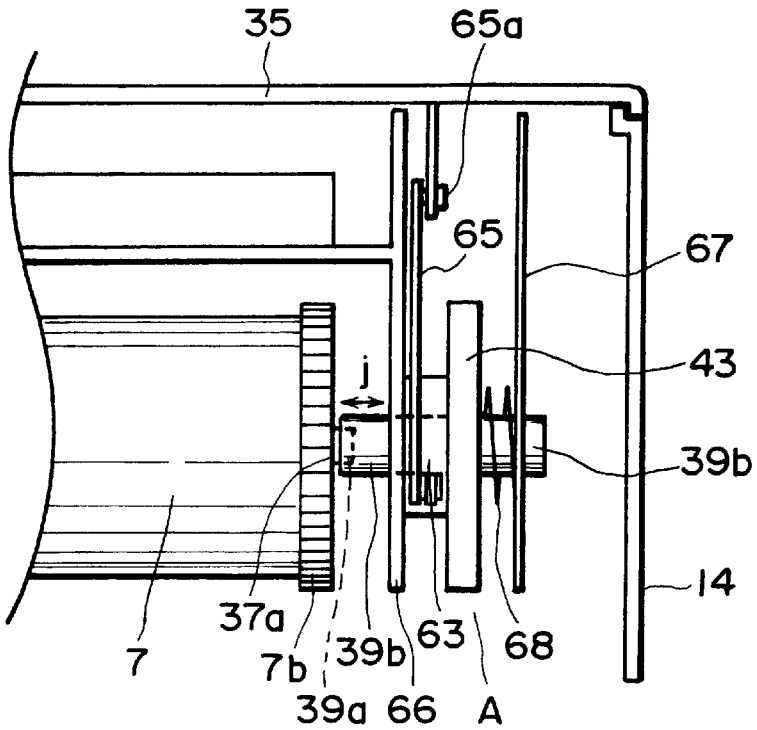
FIG. 28 is a front view of the indented coupling shaft and regions adjacent thereto as seen while the process cartridge in the apparatus main assembly is driven.

FIG. 28 is a view as seen from the right in FIG. 27, and when the openable cover 35 is closed, the link 65, the outer cam 63 and the like are at the positions shown in the Figure, where the male coupling projection 37*a* and the recess 39*a* are engaged so that a driving force can be transmitted from the large gear 43 to the photosensitive drum 7. When the openable cover 35 is opened, the pin 65*a* is rotated upward about the fulcrum 35*a*, so that arm 63*a* is pulled up through the link 65, and the outer cam 63 is rotated; thus, a relative sliding motion is caused between the outer cam 63 and the inner cam 64 to move the large gear 43 away from the photosensitive drum 7. At this time, the large gear 43 is pushed by the outer cam 63, and is moved against the compression coil spring 68 mounted between the side plate 67 and the large gear 39, by which the female coupling recess 39*a* is disengaged from the male coupling projection 37*a* as shown in FIG. 29 to release the coupling to bring the process cartridge B into a demountable state.

On the contrary, when the openable cover 35 is closed, the pin 65*a* connecting the link 65 with the openable cover 35, is rotated downward about the fulcrum 35*a*, and the link 65 is moved downward to push the arm 63*a* down, so that outer cam 63 is rotated in the opposite direction, by which the large gear 43 is moved to the left by the spring 68 to a position shown in FIG. 28, so that large gear 43 is set again at a position of FIG. 28, and the female coupling recess 39*a* is engaged with the male coupling projection 37*a* to re-establish a drive transmittable state. Thus, the demountable state and the drive transmittable state of the process cartridge B are established in response to opening and closing of the openable cover 35. When the outer cam 63 is rotated in the opposite direction by the closing of the openable cover 35 to move the large gear 43 to the left from the position of FIG. 29, the female coupling shaft 39*b* and the end surface of the male coupling shaft 37 may be abutted to each other so that the male coupling projection 37*a* and the female coupling recess 39*a* may not be engaged with each other. However, they will be brought into engagement as soon as starting of the image forming apparatus A, as will be described hereinafter.

Thus, in this embodiment, when the process cartridge B is mounted to or demounted from the main assembly 14 of the apparatus, the openable cover 35 is opened. In interrelation with the opening and closing of the openable cover 35, the female coupling recess 39*a* is moved in the horizontal direction (the direction of arrow j). When the process cartridge B is mounted to or demounted from the main assembly 14, the coupling (37*a*, 39*a*) of the main assembly 14 and the process cartridge B are not to be engaged. And, they should not be engaged. Thus, the mounting-and-demounting of the process cartridge B relative to the main assembly 14 can be carried out smoothly. In this example, the female coupling recess 39*a* is urged toward the process cartridge B by the large gear 43 being urged by the compression coil spring 68. When the male coupling projection 37*a* and the recess 39*a* are to be brought into engagement, they may be abutted to each other, and therefore, they are not properly engaged. When, however, the motor 61 is first rotated after the process cartridge B is mounted to the main assembly 14, the female coupling recess 39*a* is rotated, by which they are instantaneously brought into engagement.

A description will be provided as to the configurations of the projection 37*a* and the recess 39*a* constituting the engaging portion of the coupling means.

The female coupling shaft 39*b* provided in the main assembly 14 is movable in the axial direction, as described hereinbefore, but it not movable in the radial direction (radial direction). The process cartridge B is movable in its longitudinal direction and the cartridge mounting direction (x direction (FIG. 9)) when it is mounted in the main assembly. In the longitudinal direction, the process cartridge B is permitted to move between the guiding members 16R, 16L provided in the cartridge mounting space S.

When the process cartridge B is mounted to the main assembly 14, a portion of a cylindrical guide 13*a*L (FIGS. 6, 7 and 9) formed on the flange 29 mounted to the other longitudinal end of the cleaning frame 13, is fitted substantially without a gap into the positioning groove 16*b* (FIG. 9) of the main assembly 14 to accomplish correct positioning, and the spur gear 7*n*, fixed to the photosensitive drum 7, is brought into meshing engagement with a gear (unshown) for transmitting the driving force to the transfer roller 4. On the other hand, at one longitudinal end (driving side) of the photosensitive drum 7, a cylindrical guide 13*a*R formed on the cleaning frame 13, is supported by a positioning groove 16*b* provided in the main assembly 14.

When the opening and closing member 35 is closed, the female coupling recess 39 horizontally moves to enter the male coupling projection 37*a* (see FIG. 28.)

Figure 32A:
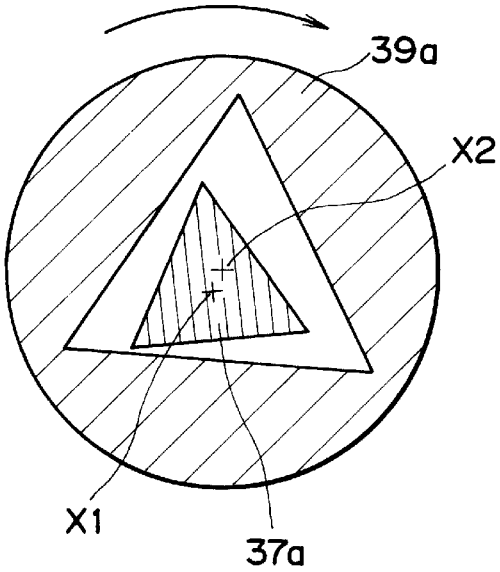
FIGS. 32A and 32B are cross-sections of the coupling portions, depicting the centering mechanism thereof.
Figure 32B:
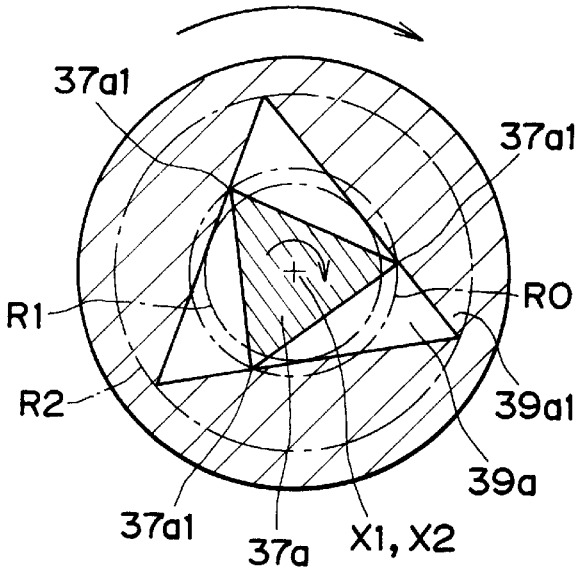
Figure 33:
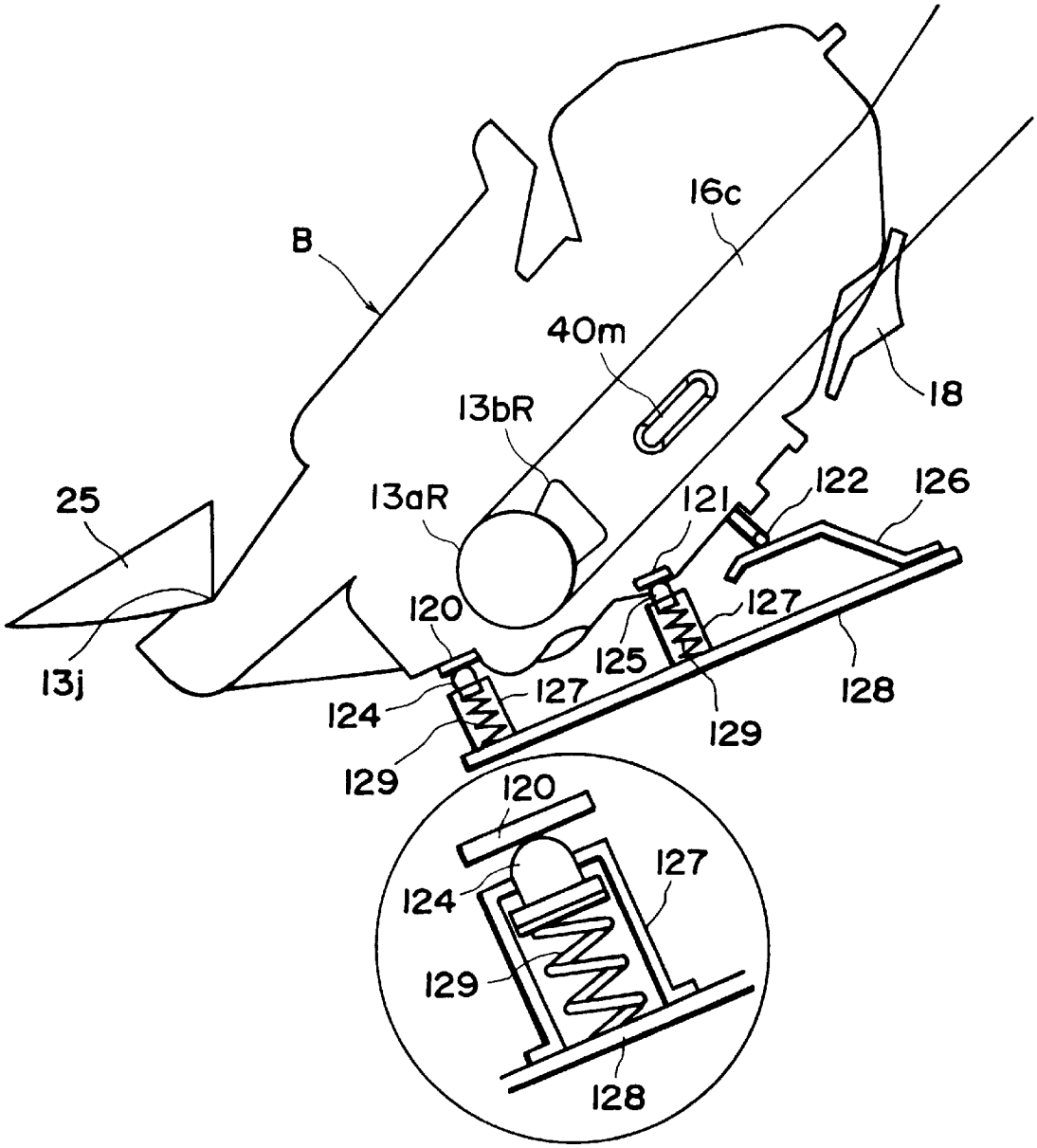
FIG. 33 is a longitudinal view showing a positioning relationship between a tilt preventive projection and a guide unit, and a relationship among electric contacts in mounting and detaching of process cartridge on and from the main assembly of electrophotographic image forming apparatus.

When the female coupling shaft 39*b* rotates under the condition that the male coupling projection 37*a* has been engaged with the female coupling recess 39*a* in image forming, as shown in FIG. 32A, an actuating force is transmitted by engagement of the inner surfaces 39*a*1 of the female coupling recess 39*a* with the edge lines 37*a*1 of three points of the substantially equilateral triangular projection of the male coupling projection 37*a*. At this time, the male coupling projection 37 instantaneously moves (from the situation shown in FIG. 32A to the situation shown in FIG. 32B) to allow equal engagement of the inner surface 39*a*1 of the female coupling recess 39*a* with the edge lines 37*a*1 of the male coupling projection 37*a*. The male coupling projection 37*a* and the female coupling recess 39*a* form a substantially equilateral triangle to allow alignment of the axes of the male coupling shaft 37 and the female coupling shaft 39*b* by a uniform contact force. Therefore, the position of the rotating center X1 of the male coupling projection 37*a* is offset from that of the rotating center X2 of the female coupling recess 39*a* in the situation of engagement of the male coupling projection 37*a* with the female coupling recess 39*a* (FIG. 32A). In addition, when the female coupling recess 39*a* starts to rotate to contact with the edge lines 37*a*1 of three points of the male coupling projection 37*a*, the rotating centers X1 and X2 are substantially aligned.

XIV. Means for Prevention of Tilting Insertion of the Process Cartridge B.

As described before, for fitting the process cartridge B into the main assembly of the image forming apparatus 14, cylindrical guides 13*a*R and 13*a*L as the first guide unit provided on a cleaning frame unit (the first unit) C of the process cartridge B are inserted into the guide units 16*a* and 16*c* as mounting means of the main assembly of the image forming apparatus 14, followed by inserting the rotation stopping guides 13*b*R and 13*b*L into the guide units 16*a* and 16*c* of the main assembly of the image forming apparatus 14, keeping the front of the process cartridge B in a lower position viewed from inserting direction, respectively. If the process cartridge B tilts in the direction intersecting the mounting direction (lengthwise direction of the process cartridge B) in the insertion of the cylindrical guides 13*a*R and 13*a*L of the cleaning frame unit C into the guide units 16*a* and 16*c* of the main assembly of the image forming apparatus 14, the walls 16*a*1 and 16*a*2 of the guide provided on the main assembly and comprising a part of the guide units 16*a* and 16*c* (See FIG. 9 and FIG. 10) as mounting means of the main assembly of the image forming apparatus 14 interfere with the cylindrical guide 13*a*R and 13*a*L of the cleaning frame unit (the first unit) C to allow possible inhibition of smooth mounting of the process cartridge B to the main assembly of the image forming apparatus 14.

Particularly, when the cylindrical guide 13*a*L of the cylindrical guide 13*a*R and 13*a*L of a cleaning frame unit (the first unit) C, substantially comprising a ground contact 119 of an electrophotographic photosensitive drum 7, interferes with the walls 16*c*1 of the guide of the guide units 16*c* of the main assembly of the image forming apparatus 14 for mounting to the main assembly, the ground contact 119 is damaged to cause possibly a defect of contacting with a ground contact member 23 of the main assembly of the image forming apparatus.

Thus, in the preferred embodiment, a tilt preventive projection (a second guide unit) 40*m* is provided to control a tilt of the process cartridge B to a development unit (a second unit) D of the process cartridge B (see FIG. 4 and FIG. 5) allowing smooth mounting of the process cartridge B to the main assembly of the image forming apparatus 14.

The tilt preventive projection 40*m* is, as shown in FIG. 4 and FIG. 5, provided on a development holder 40 (side board) attached to a development chamber frame 12 in the opposite side of a ground contact 119, an electrifying bias contact 120, a development bias contact 121, and a contact 122 to detect a remaining quantity of toner of the process cartridge B shown in FIG. 8. Therefore, the tilt preventive projection 40*m* is provided to the opposite side of respective contacts of the process cartridge B shown in the FIG. 8. Besides, the tilt preventive projection 40*m* is located in an upward position of the cylindrical guide 13*a*R against the mounting direction X of the process cartridge B to the main assembly of the image forming apparatus 14 (see FIG. 5). In detail, it is located in an upward position of the cylindrical guide 13*a*R against the mounting direction X in the substantial center between the top and bottom tangential lines X1 and X2 touching the cylindrical guide 13*a*R parallel to the mounting direction X of the process cartridge B to the main assembly of the image forming apparatus 14. Namely, a tilting distance of the process cartridge B is reduced in mounting the process cartridge B with tilting to the cartridge fitting unit S of the main assembly of the image forming apparatus 14 by increasing a span L2 from the front end of the cylindrical guide 13*a*R to the rear end of the tilt preventive projection 40*m*, in comparison with the span L1 from the front end of the cylindrical guide 13*a*R to the rear end of the rotation stopping guide 13*b*R in the mounting direction X of the process cartridge B.

Further, the tilt preventive projection 40*m* is formed in a laterally long, substantially conical, trapezoid shape elongating to the same direction as that of the mounting direction X of the process cartridge B to the main assembly of the image forming apparatus 14, and the circumference thereof has an inclination surface 40*m*1 with a tapering inclination. In addition, the tilt preventive projection 40*m* projects, like the cylindrical guide 13*a*R, in the lengthwise direction of the electrophotographic photosensitive drum 7; the projection length s1 is shorter than the projected length of s2 of the cylindrical guide 13*a*R (see FIG. 34). The top surface 40*m*2 of the tilt preventive projection 40*m* is formed parallel to the walls 16*c*1 of the guide of the guide units 16*c* of the main assembly of the image forming apparatus 14 for fitting to the main assembly.

Herewith the action of the tilt preventive projection 40*m* in mounting the process cartridge is described with reference to the FIG. 34.

Figure 34:
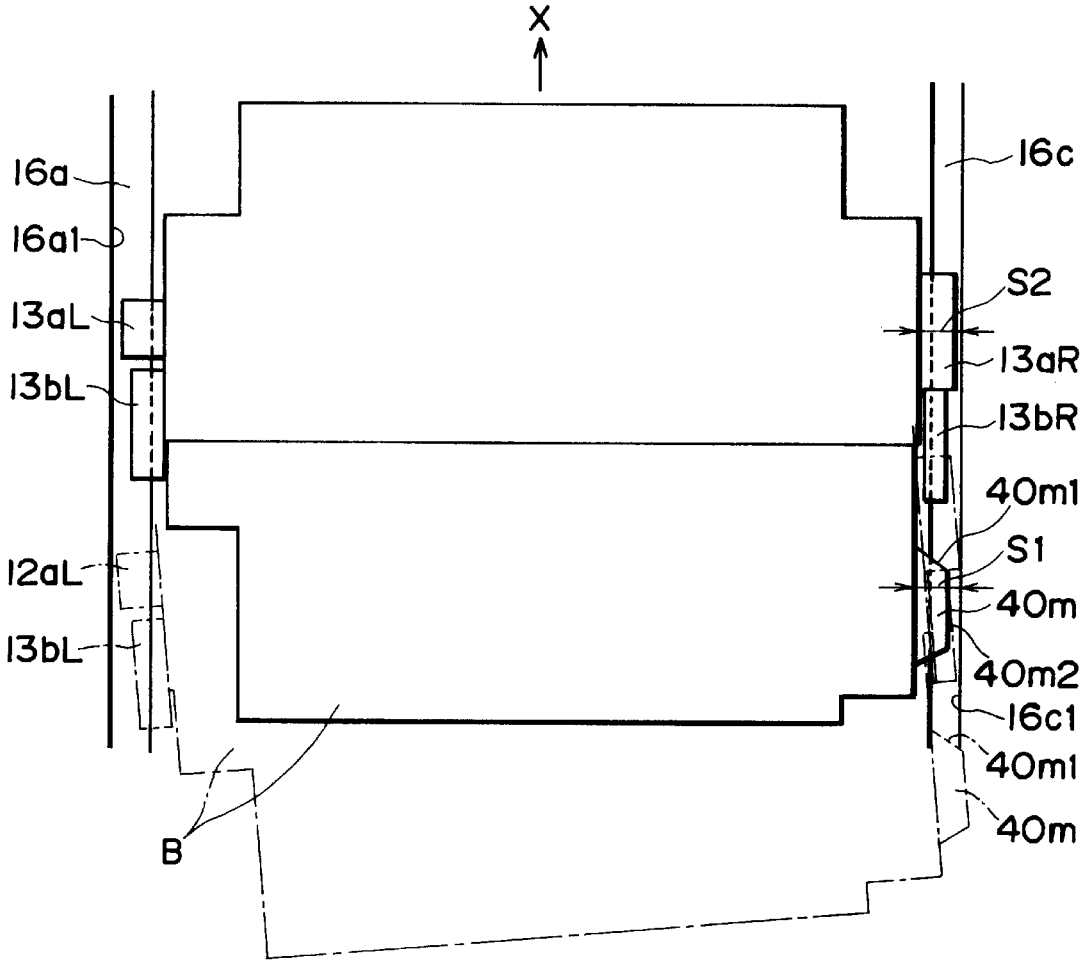
FIG. 34 is an explanatory view showing control of the tilt in fitting a process cartridge to the main assembly of the electrophotographic image forming apparatus.

When the process cartridge is mounted to the cartridge mounting unit S of the main assembly of the image forming apparatus 14 if the process cartridge B tilts to right-hand side in the direction intersecting the mounting direction X as shown with a single dotted chain line in FIG. 34, the inclination surface 40*m*1 of the tilt preventive projection 40*m* contacts the wall 16*c*1 of the guide of the guide units 16*c* of the main assembly of the image forming apparatus 14 for mounting to the main assembly, after the cylindrical guide 13*a*R and 13*a*L and the rotation stopping guides 13*b*R and 13*b*L of the process cartridge B are inserted into the guide units 16*a* and 16*c* of the main assembly of the image forming apparatus 14.

When the process cartridge B is inserted into mounting direction X, the inclination surface 40*m*1 of the tilt preventive projection 40*m* is movably contacted to the wall 16*c*1 of the guide for mounting to the main assembly by further insertion of the process cartridge B, and the process cartridge B is clockwise rotated around a fulcrum which is the contact part of the wall 16*c*1 of the guide for mounting to the main assembly and the inclination surface 40*m*1 while it is moved to direction of the guide unit 16*c*.

Next, when the inclination surface 40*m*1 of the tilt preventive projection 40*m* is not movably contacted to the wall 16*c*1 of the guide for mounting to the main assembly, namely at the timing of leaving of the inclination surface 40*m*1 from the wall 16*c*1 of the guide for mounting to the main assembly, the tilt preventive projection 40*m* enters the guide unit 16*c* of the main assembly of the image forming apparatus 14. Through such steps, the inclination surface 40*m*1 of the tilt preventive projection 40*m* movably contacts the wall 16*c*1 of the guide for mounting to the main assembly and clockwise rotates the process cartridge B around a fulcrum, which is the contact part of the inclination surface 40*m*1 with the wall 16*c*1 of the guide for mounting to the main assembly. Thus, the cylindrical guide 13*a*L (the ground contact 119) does not interfere with the walls 16*c*1 of the guide for mounting to the main assembly to enter the guide units 16*c* of the main assembly of the image forming apparatus 14. In this way, the process cartridge B can be supported in the normal profile without tilt by the guide units 16*a* and 16*c* of the main assembly of the image forming apparatus 14.

Tilt preventive projection 40*m* of the process cartridge B in this situation does not contact the guide 16*c* of the main assembly of the image forming apparatus 14. The non-contact situation is kept even after the process cartridge B is further inserted into the mounting direction X to mount finally the process cartridge B to the given mounting position of the main assembly of the image forming apparatus 14. Thus, mounting of the process cartridge B to the given fitting position of the main assembly of the image forming apparatus 14 allows, as shown in FIG. 11, FIG. 30, and FIG. 32, the ground contact 119, the electrifying bias contact 120, the development bias contact 121, and the contact 122 to detect a remaining quantity of toner of the process cartridge B to be connected electrically to a ground contact member 123, electrifying contact member 124, development bias contact member 125 and toner detecting contact 126 of the main assembly of the image forming apparatus 14, respectively.

As described above, in the process cartridge B made up by an integral combination of a cleaning frame unit C and a development unit D, tilting can be prevented in mounting and demounting of the process cartridge B on/from the main assembly of the image forming apparatus 14 to prevent prying the process cartridge B against the main assembly of the image forming apparatus 14 and allowing smooth mounting and demounting, by providing the cylindrical guides 13*a*R and 13*a*L guiding in mounting and demounting of the process cartridge B in the cleaning frame unit C and providing the tilt preventive projection 40*m* that prevents tilting in development unit D.

The process cartridge itself can be miniaturized in the process cartridge integrally constructed by integral assembly of the cleaning frame unit and the development unit similar to the process cartridge of the preferred embodiment. Therefore, defects incapable of the longer structure of the width of the guide for the process cartridge to the main assembly of the image forming apparatus and the easy mounting and demounting of the process cartridge have been solved by providing the aforementioned tilt preventive unit (tilt preventive projection).

XV. Structure of a Laser Shutter.

Figure 36:
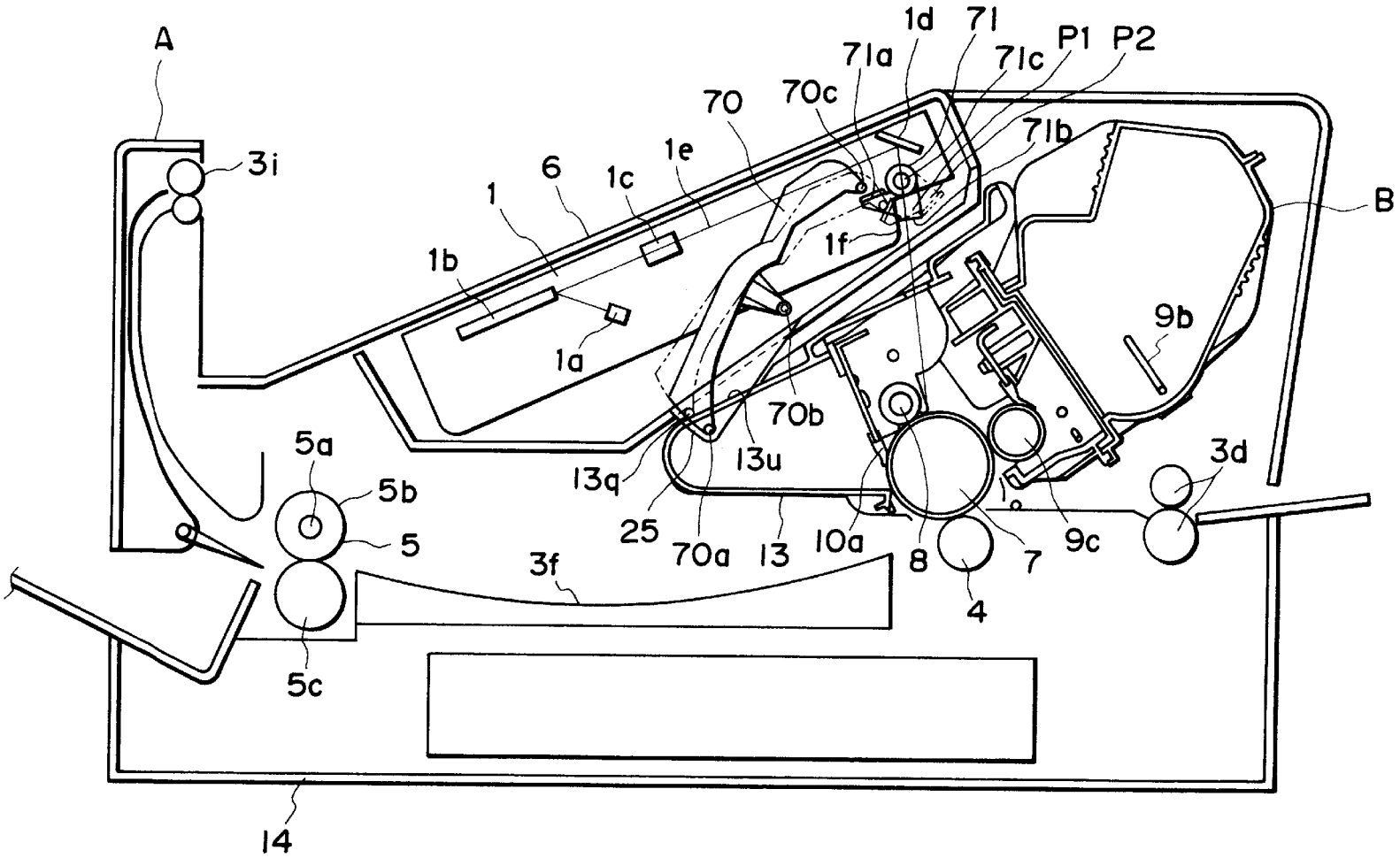
FIG. 36 is a longitudinal view of an electrophotographic image forming apparatus.
Figure 37:
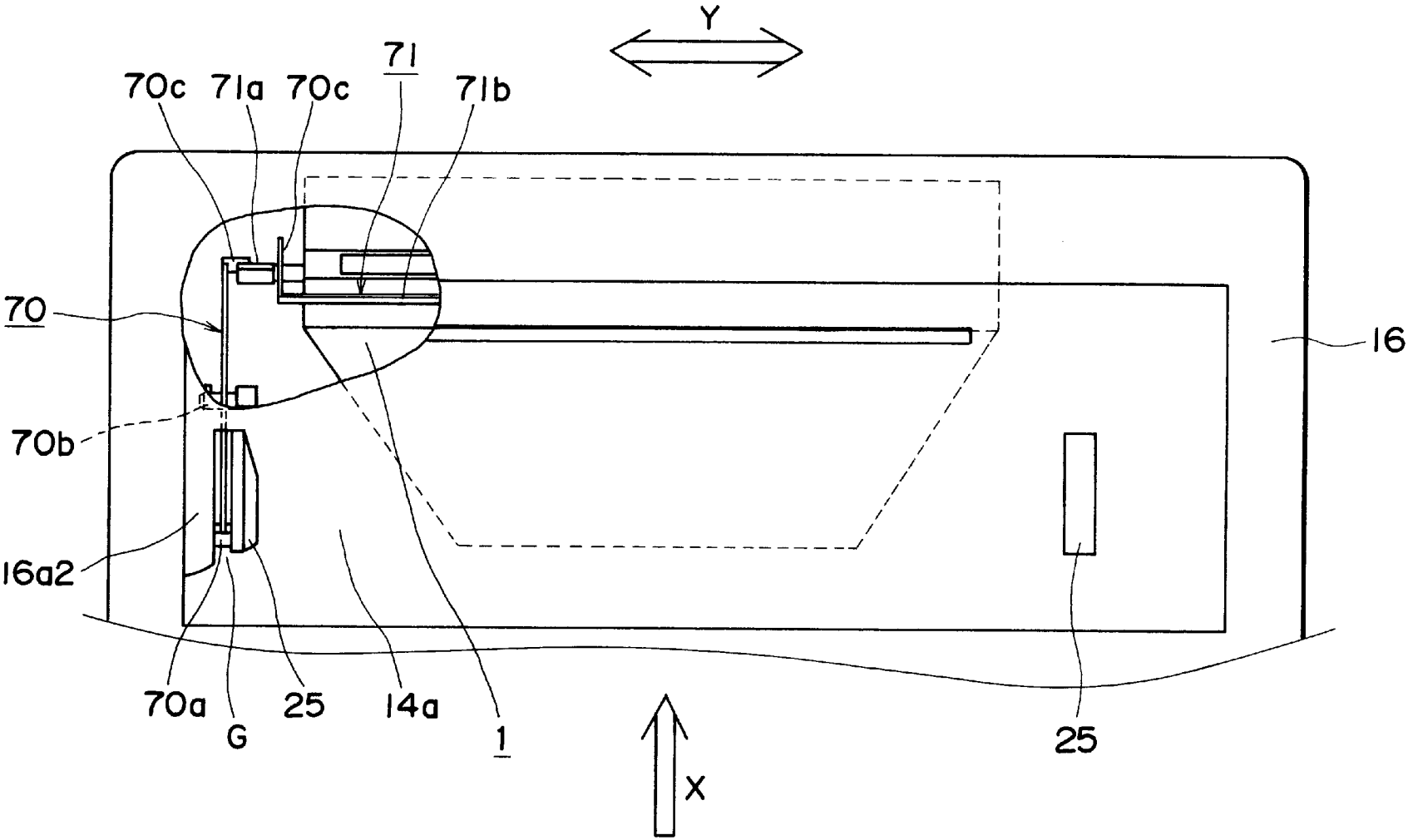
FIG. 37 is an internal view of the main assembly viewing from a process cartridge side.
Figure 38:
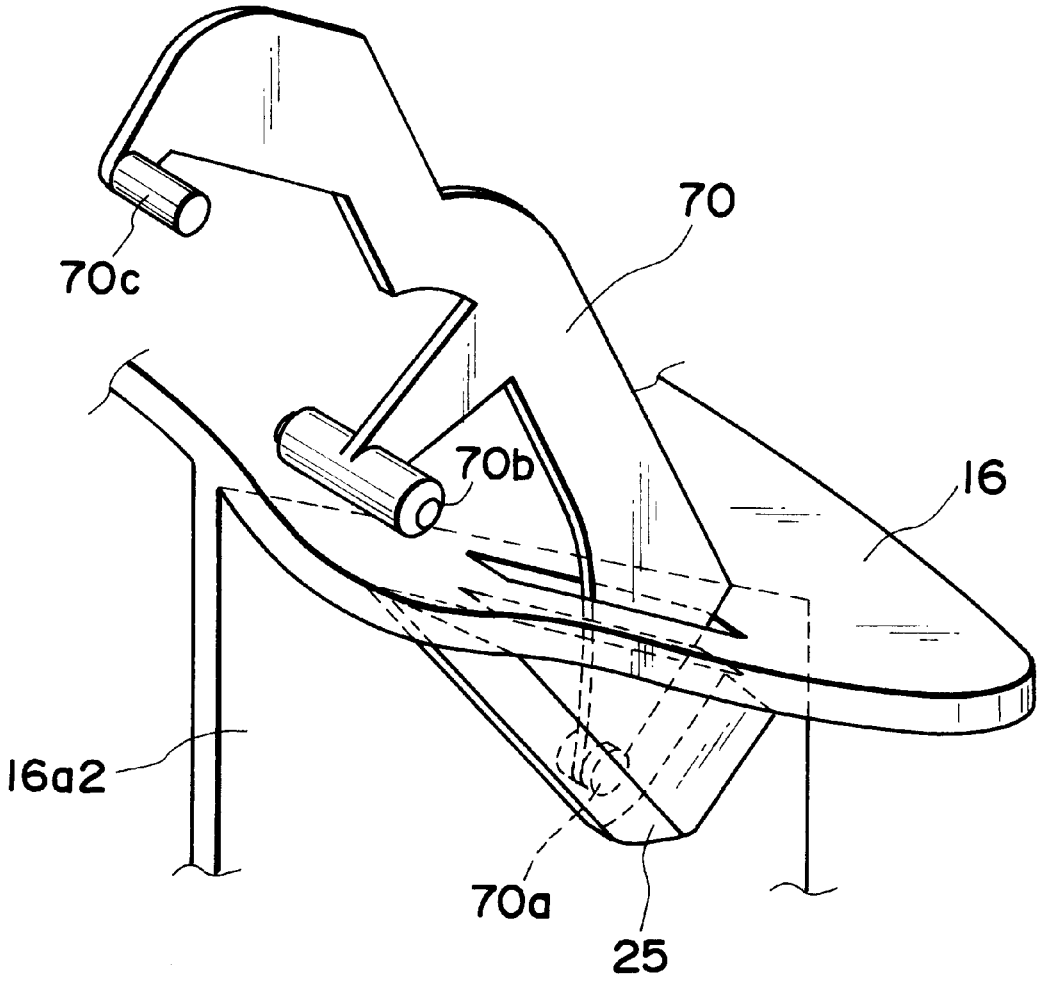
FIG. 38 is a perspective side view of a shutter link unit.

In the situation that the process cartridge has not been mounted to the image forming apparatus A, the structure of the laser shutter to shut the laser beam path for preventing the leakage of laser beam from an optical system 1 is explained with reference to FIG. 36, FIG. 37, and FIG. 38. FIG. 36 is the sectional view of the main assembly of the apparatus, FIG., 37 is a view from the internal side of the main assembly of the apparatus, and FIG. 38 is the perspective side view of shutter link unit.

The laser shutter 71 has been rotatably provided on the frame unit 16 of the main assembly by the fulcrum 71*c* in the frame unit 16 of the main assembly with supporting axis, etc. (not shown). As well, the shutter link 70 to rotate the laser shutter 71 is rotatably provided on the frame unit 16 of the main assembly with bearings etc. (not shown). When the process cartridge B is provided in the direction Y that intersects the mounting direction X of the process cartridge B, the shutter link 70, as shown in FIG. 36, is located between a fixing member 25 with which controlling contact unit 13*j* (FIG. 4 to FIG. 7) of cleaning frame unit 13 contacts and the side wall 16*a*2 of the frame unit 16 of the main assembly. The shutter link 70 is located in the back of the fixing member 25 in the mounting direction X1 of the process cartridge B. For reference, 14*a* (FIG. 37) is a cover (dividing wall) to divide the mounting unit of the process cartridge B and the back of the main assembly of the apparatus 14. The fixing member 25 has been mounted to the cover 14*a*.

Next, practical actions of the laser shutter 71 and laser shutter link 70 are explained below.

Figure 35:
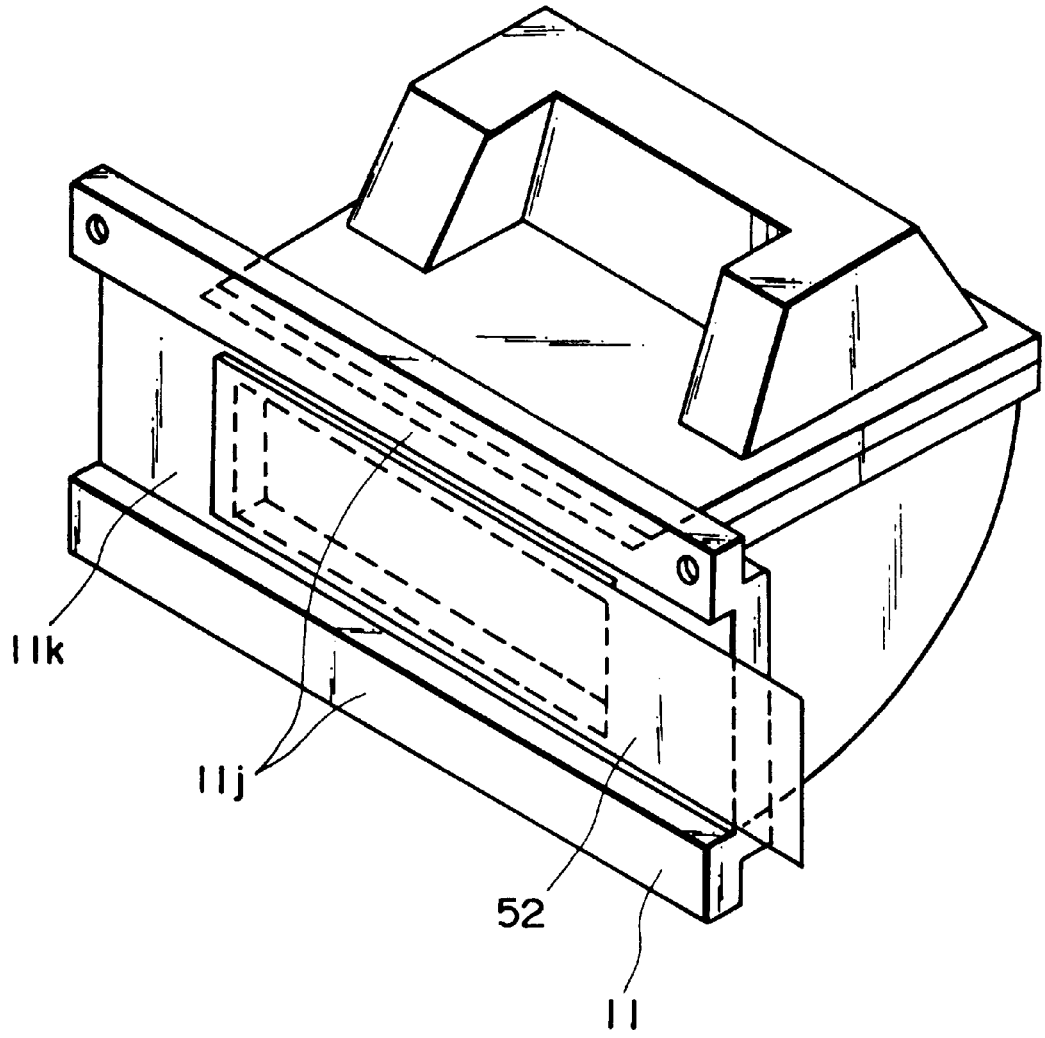
FIG. 35 is a perspective view of the opening and regions adjacent thereto of the toner chamber frame, in one of the embodiment of the present invention.

When the process cartridge B is not mounted to the main assembly of the image forming apparatus A, the laser shutter 71 is clockwisely pushed by a spring etc. (not illustrated) around a fulcrum 71*c* in FIG. 36. A shutter unit 71*b* shuts a laser beam path 1*e* in the position in which the shutter unit 71*b* contacts the frame unit If of the optical system. When the process cartridge B is mounted on the electrophotographic image forming apparatus A, a rib 13*q* (FIG. 4 to FIG. 7) mounted to the side of the controlling contact part 13*j* of the cleaning frame unit 13 of the process cartridge B contacts the contact part 70*a* of the shutter link 70. When the rib 13*q* contacts the contact part 70*a* of the shutter link 70, the shutter link 70 clockwise rotates around the fulcrum 70*b* in FIG. 35. At this time, a boss 70*c* of the shutter link contacts with the contact part 71*a* of the shutter 71 to be pushed. By this step, the shutter 71 is rotated counterclockwise around the fulcrum 71*c* to cause the shutter unit 71*b* to retreat from the laser beam path 1*e*. Therefore, when the process cartridge B is mounted to a given position of the main assembly of the image forming apparatus A, the light path 1*e* is not shut by the shutter unit 71*b* and makes accurate radiation of laser beam on a photosensitive drum 7 possible.

The following is a compilation of the aforementioned descriptions.

First, the process cartridge is explained herewith. A process cartridge (for example, the process cartridge B) detachably mountable on the main assembly of the electrophotographic image forming apparatus (for example, the main assembly of the electrophotographic image forming apparatus (14)) has a laser beam emitting means (for example, laser diode 1*a*) to emit a laser beam, a laser shutter (for example, the laser shutter 71) capable assuming a position between and moving between a shutting position (P1) to shut the path of a laser beam emitted from the laser beam emitting means and an opening position (P2) to retreat from the shutting position for allowing passage of a laser beam, and a moving means (for example, the shutter link 70) to move the laser shutter from the shutting position to the opening position. The process cartridge has a cartridge frame (for example, toner frame unit 11, development frame unit 12, cleaning frame unit 13), an electrophotographic photosensitive member (for example, the electrophotographic photosensitive drum 7), a process means (for example, electrifying roller 8, developing roller 9*c*, cleaning blade 10*a*) acting to the electrophotographic photosensitive member, the first contact part (for example, the controlling contact 13*j*) provided on the cartridge frame (for example, cleaning frame unit 13) to determine the position of the process cartridge relative to the main assembly of the apparatus by contacting with a fixing member (for example, the fixing member 25) provided on the main assembly of the apparatus in mounting the process cartridge to the main assembly of the apparatus, and the second contact part (for example, rib 13*q*) provided on the cartridge frame adjacent to the first contact part, and contacting the moving means to move the laser shutter from the shutting position to the opening position in a mounting step to the main assembly of the apparatus.

When the process cartridge was mounted to the main assembly of the apparatus, the second contact part projects into the upper position than that of the first contact part. The second contact part has a flat shape projecting from the cartridge frame along the mounting direction (X1) for mounting the process cartridge to the main assembly of the apparatus, wherein the flat part located in front, when the process cartridge is mounted to the main assembly of the apparatus is arc-shaped (13*q*1) showing a flat upper surface (13*q*2) of the flat shape. The arc-shaped part (13*q*1) of the second contact part (rib 13*q*) contacts the contact portion (for example, contact unit 70*a*) of the moving means according to the progress of the process cartridge to a mounting direction (X) to keep the contact part in the flat part (13*q*2). The first contact part is a recess made in a face (13*u*) to become the upper face when the process cartridge (B) is mounted to the main assembly of the apparatus 14. The first contact part is located inside the second contact part in a direction (Y) intersecting a mounting direction (X) for mounting the process cartridge (B) to the main assembly of the apparatus (14).

Further, the first contact part is located in one end and the other end of the cartridge frame in a direction (Y) intersecting a mounting direction (X) of the process cartridge (B) to the main assembly of the apparatus (14) (see FIG. 4 and FIG. 7). When the process cartridge is mounted to the main assembly of the apparatus (14), the second contact part is located at the opposite side of the cartridge frame to a side at which a driving force receiving member (for example, male axis 37) receives a rotation driving force from the main assembly of the apparatus for which the electrophotographic photosensitive member is provided, in a direction (Y) intersecting a mounting direction for mounting the process cartridge to the main assembly of the apparatus (14). Furthermore, when the process cartridge (B) is mounted to the main assembly of the apparatus (14), the second contact part is located at the opposite side of the cartridge frame to a side to which a ground contact (for example, the ground contact 119), to establish a ground of the electrophotographic photosensitive member against the main assembly of the apparatus, is provided in a direction (Y) intersecting a mounting direction (X) for mounting the process cartridge (B) to the main assembly of the apparatus (14). The first contact part contacts with the fixing member (for example, the fixing member 25) provided on the main assembly of the apparatus (14) when the process cartridge (B) is fitted to the main assembly of the apparatus (14) to determine a position of the process cartridge (B) relative to the main assembly of the apparatus (14) by regulating rotation of the cartridge frame in the same direction as that of rotation of the electrophotographic photosensitive member, when the electrophotographic photosensitive member receives a rotation driving force from the main assembly of the apparatus. The process means is at least any one of developing means to develop a latent image formed on the electrophotographic photosensitive member, electrifying means to electrify the electrophotographic photosensitive member, cleaning means to remove toner remaining on the electrophotographic photosensitive member.

The followings are the explanation of the electrophotographic image forming apparatus.

An electrophotographic image forming apparatus has a detachably mountable process cartridge (B) and form an image on a recording medium, and comprises (a) a laser beam emission means (for example, the laser diode la) to emit a laser beam, (b) a laser shutter (for example, the laser shutter (71) moving between a first shutting position (A) to shut the path of the laser beam emitted by the laser beam emission means and a second opening position (B) to allow passage of a laser beam by retreating from the shutting position, (c) moving means (for example, the shutter link 70) to move the laser shutter from the first position to the second position, (d) a fixing member (for example, the fixing member 25), and (e) mounting means (for example, guide members 16R and 16L) to removably mount the process cartridge having a cartridge frame (for example, toner frame unit 11, development frame unit 12, and cleaning frame unit 13), an electrophotographic photosensitive member (for example, the electrophotographic photosensitive drum 7), and a process means (for example, electrifying roller 8, developing roller 9*c*, cleaning blade 10*a*) acting to the electrophotographic photosensitive member, the first contact part (for example, the controlling contact 13*j*) provided on the cartridge frame (for example, cleaning frame unit 13) to determine the position of the process cartridge relative to the main assembly of the apparatus by contacting a fixing member (for example, the fixing member 25) mounted to the main assembly of the apparatus in mounting the process cartridge to the main assembly of the apparatus, and the second contact part (for example, rib 13*q*) provided on the cartridge frame adjacent to the first contact part and contacting the moving means to move the laser shutter from the shutting position to the opening position in mounting the process cartridge to the main assembly of the apparatus (14).

The moving means has a contacting member (for example, the contact unit 70*a*) to contact the second contact part, wherein the contacting member is located in the back of a space (about 3 mm to 5 mm in the preferred embodiment illustrated GO in FIG. 36) kept between the side wall of the main assembly of the apparatus and the fixing member to allow the second contact part included in the process cartridge to enter.

As explained above, in the laser shutter 71 according to the preferred embodiment, the laser shutter 71 is opened by contact of the rib 13*q* provided aside the rotation controlling contact unit 13*j* contacting with the fixing member 25 provided on the main assembly with the shutter link 70. As described before, the precise size of parts can be accomplished by mounting the rib 13*q* aside of the contact unit 13*j* resulting in accurate and precise rotation of the shutter link.

The shutter link 70 is located between the side wall 16*a*2 of the frame unit 16 of the main assembly and the fixing member 25 in the direction of an axis line of the electrophotographic photosensitive drum included in the process cartridge mounted to the main assembly of the apparatus, and does not project into the side to which the process cartridge is mounted in the position of a sectional view. Therefore, in jam processing etc., the laser shutter 70 does not open by user's touch on the shutter link 70. In addition, there is no fear of moving the position of the shutter opening mechanism such as the shutter link. For reference, a laser beam will not leak out to the outside, even if the shutter is carelessly opened, because the laser beam does not emit light during the jam processing, etc.

The shutter link 70 receives a force in the direction to always shut the laser shutter 71 by a spring (not shown) and the contact part 70*a* can move accurately along the surface of the rib 13*q*.

XVI. Another Embodiment

In the above-mentioned embodiments, the process cartridge in which the cleaning unit and the developing unit are made integral is illustrated, but the present invention can be applied to the process cartridge in which the such integral structure is covered by the cartridge cover.

In this embodiment, the process cartridge B was described as a process cartridge which forms a monochromatic image, but the present invention is applicable, with desirable effects, to a process cartridge which comprises a plurality of developing means for forming an image composed of a plurality of colors (for example, a two toner image, three tone images, a full color image, or the like).

The electrophotographic photosensitive member does not need to be limited to the photosensitive drum 7. For example, the following types may be included. First, as for the photosensitive material, photoconductive material such as amorphous silicon, amorphous selenium, zinc oxide, titanium oxide, organic photoconductor, and the like, may be included. As for the configuration of the base member on which photosensitive material is placed, it may be in the form of a drum or belt. For example, the drum type photosensitive member comprises a cylinder formed of aluminum alloy or the like, and a photoconductive layer deposited or coated on the cylinder.

As for the image developing method, various known methods may be employed; for example, a two-component magnetic brush type developing method, a cascade type developing method, a touch-down type developing method, a cloud type developing method, and the like.

Also in this embodiment, a so-called contact type charging method was employed, but obviously, charging means with a structure different from the one described in this embodiment may be employed; for example, one of the conventional structures, in which a tungsten wire is surrounded by a metallic shield formed of aluminum or the like, on three sides, and positive or negative ions generated by applying high voltage to the tungsten wire are transferred onto the surface of a photosensitive drum to uniformly charge the surface of the photosensitive drum.

The charging means may be in the form of a blade (charge blade), a pad, a block, a rod, a wire, or the like, in addition to being in the form of a roller.

As for the method for cleaning the toner remaining on the photosensitive drum, a blade, a fur brush, a magnetic brush, or the like may be employed as a structural member for the cleaning means.

A toner seal includes an easy peel one for reuse by turning a sheet and the other one composed of the aforementioned cover film 51 and a tear tape 52. The invention is applied to a process cartridge using such toner seals.

The process cartridge, for example, has an electrophotographic photosensitive member and developing means, and at least any one of the process means. Therefore, the form of the process cartridge is, for example, made to be detachably mountable on the main assembly of the image forming apparatus by making the cartridge integrally from electrophotographic photosensitive member, developing means, and electrifying means, detachably mountable on the main assembly of the image forming apparatus; by making the cartridge integrally from an electrophotographic photosensitive member and developing means, and detachably mountable on the main assembly of the image forming apparatus; and by making the cartridge integrally from an electrophotographic photosensitive member, developing means, and cleaning means, in addition to the one described in the preferred embodiment.

The process cartridge is made to be detachably mountable on the main assembly of the image forming apparatus through making the cartridge integrally from electrifying means or cleaning means, developing means, and electrophotographic photosensitive member.

The process cartridge is made to be detachably mountable on the main assembly of the image forming apparatus by making the cartridge integrally from at least one of electrifying means and cleaning means, developing means and an electrophotographic photosensitive member. Furthermore, the process cartridge is made to be detachably mountable on the main assembly of the image forming apparatus by making the cartridge integrally from at least developing means and an electrophotographic photosensitive member.

Furthermore, in aforementioned preferred embodiment, an electrophotographic image forming apparatus is exemplified by a laser beam printer. However, it is not confined to the details set forth and this application is intended for use for such electrophotographic image forming apparatus as an electronic copying machine, a facsimile machine, or a word processor.

While the invention has been described with reference to the structures disclosed herein, it is not confined to the details set forth and this application is intended to cover such modifications or changes as may come within the purposes of the improvements or the scope of the following claims.

As mentioned heretofore, according to the present invention, the process cartridge which can open or release the laser shutter securely and an image forming apparatus using such process cartridge can be realized.

What is claimed is:

1. A process cartridge detachably mountable on a main assembly of an electrophotographic image forming apparatus having laser beam emitting means to emit a laser beam, a laser shutter moveable between a shutting position to shut an optical path of the laser beam emitted from the laser beam emitting means and an opening position to retreat from the shutting position for allowing passage of the laser beam, and a moving member to move the laser shutter from the shutting position to the opening position, said process cartridge comprising:

a cartridge frame;

an electrophotographic photosensitive member;

a driving force receiving member for receiving a rotation driving force for said electrophotographic photosensitive member from the main assembly of the apparatus when said process cartridge is mounted to the main assembly of the apparatus;

process means acting on said electrophotographic photosensitive member;

a first contact part provided on said cartridge frame to determine a position of said process cartridge relative to the main assembly of the apparatus by contacting a fixing member provided on the main assembly of the apparatus when said process cartridge is mounted to the main assembly of the apparatus; and a second contact part provided on said cartridge frame adjacent said first contact part in a direction intersecting a mounting direction along which said process cartridge is to be mounted to the main assembly of the apparatus, wherein said second contact part comes into contact with the moving member to move the laser shutter from the shutting position to the opening position and the moving member moves along the surface of said second contact part when said process cartridge is mounted to the main assembly of the apparatus.

2. A process cartridge according to claim 1, wherein when said process cartridge is mounted to the main assembly of the apparatus, said second contact part projects into a higher position than that of the first contact part.

3. A process cartridge according to claim 1 or 2, wherein said second contact part has an arc-shaped portion and a flat upper surface extending in the mounting direction along which said process cartridge is to be mounted to the main assembly of the apparatus, wherein the arc-shaped portion is in the front part of said second contact part in the mounting direction.

4. A process cartridge according to claim 3, wherein as said process cartridge is advanced along said mounting direction, said arc-shaped portion of said second contact part firstly contacts a contact portion of the moving member.

5. A process cartridge according to claim 4, wherein said first contact part is located on the inside side of said second contact part in the direction intersecting the mounting direction.

6. A process cartridge according to claim 3, wherein said first contact part is located inside said second contact part in the direction intersecting the direction.

7. A process cartridge according to claim 1 or 2, wherein said first contact part is a recess made in a face of said process cartridge which becomes an upper face of said process cartridge when said process cartridge is mounted to the main assembly of the apparatus.

8. A process cartridge according to claim 1, wherein said first contact part is located in each of one end and the other end of said cartridge frame in the direction intersecting the mounting direction.

9. A process cartridge according to claim 1, wherein said second contact part is located on an opposite side of said cartridge frame to a side on which said driving force receiving member is provided, in the direction intersecting the mounting direction.

10. A process cartridge according to claim 1, wherein said second contact part is located on a same side of said cartridge frame as a side on which a ground contact for connecting said electrophotographic photosensitive member electrically with a ground through the main assembly of the apparatus is provided, in the direction intersecting the direction.

11. A process cartridge according to claim 1, wherein said first contact part contacts a fixing member provided on the apparatus when said process cartridge is mounted to the main assembly of the apparatus to determine a position of said process cartridge relative to the main assembly of the apparatus by regulating rotation of said cartridge frame to a same direction as that of rotation of said electrophotographic photosensitive member, when said electrophotographic photosensitive member receives the rotation driving force from the main assembly of the apparatus.

12. A process cartridge according to claim 1, wherein said process means includes at least one of developing means to develop a latent image formed on said electrophotographic photosensitive member, electrifying means to electrify said electrophotographic photosensitive member, and cleaning means to remove toner remaining on said electrophotographic photosensitive member.

13. A process cartridge according to claim 1, wherein said driving force receiving member of said process cartridge is a protrusion provided on one longitudinal end of said electrophotographic photosensitive member, and wherein said protrusion engages a recessed portion provided on the main assembly of the apparatus to receive the rotation driving force when said process cartridge is mounted to the main assembly of the apparatus.

14. A process cartridge according to claim 13, wherein said protrusion of said process cartridge is twisted, and said recessed portion of the main assembly of the apparatus is twisted.

15. A process cartridge according to claim 14, wherein said protrusion of said process cartridge is a twisted substantially triangular prism, and said recessed portion of the main assembly of the apparatus has a substantially triangular-shaped cross-section.

16. An electrophotographic image forming apparatus onto which a process cartridge is detachably mountable for forming an image on a recording medium, comprising:

(a) laser beam emitting means to emit a laser beam;

(b) a laser shutter moveable between a shutting position to shut an optical path of the laser beam emitted by said laser beam emitting means and an opening position to retreat from the shutting position for allowing passage of the laser beam;

(c) a moving member to move said laser shutter from shutting position to the opening position;

(d) a fixed member provided on a main assembly of said apparatus; and (e) a mounting member to detachably mount the process cartridge, the process cartridge having:

a cartridge frame, an electrophotographic photosensitive member, a driving force receiving member for receiving a rotation driving force for the electrophotographic photosensitive member from the main assembly of said apparatus when the process cartridge is mounted to said main assembly of said apparatus, process means acting to the electrophotographic photosensitive member, a first contact part provided on the cartridge frame to determine a position of the process cartridge relative to said main assembly of said apparatus by contacting said fixing member provided on said main assembly of said apparatus when the process cartridge is mounted to said main assembly of said apparatus, and a second contact part provided on the cartridge frame side by side with the first contact part in a direction intersecting a mounting direction along which the process cartridge is to be mounted to said main assembly of said apparatus, wherein said second contact part comes into contact with said moving member to move said laser shutter from the shutting position to the opening position and said moving member along the surface of the second contact part when the process cartridge is mounted to said main assembly of said apparatus.

17. An electrophotographic image forming apparatus according to claim 16, wherein said moving member has a contact portion to contact the second contact part, wherein said contact portion is located in an interior portion of said main assembly in a space kept between a side wall of said main assembly and said fixing member, and wherein the second contact part of the process cartridge enters said space when the process cartridge is mounted in said main assembly.

18. A process cartridge detachably mountable on a main assembly of an electrophotographic image forming apparatus having a laser beam emitting member to emit a laser beam, a laser shutter moveable between a shutting position to shut an optical path of the laser beam emitted from the laser beam emitting member and an opening position to retreat from the shutting position for allowing passage of the laser beam, a moving member to move the laser shutter from the shutting position to the opening position, a first guiding surface with a first bearing surface connected thereto, and a second guiding surface with a second bearing surface connected thereto, said process cartridge comprising:

an electrophotographic photosensitive drum;

a driving force receiving member for receiving a rotation driving force for said electrophotographic photosensitive drum from the main assembly of the a pparatus when said process cartridge is mounted to the main assembly of the apparatus;

a developing member for developing a latent image formed on said electrophotographic photosensitive drum;

a charging member for charging member for charging said electrophotographic photosensitive drum;

a cleaning member for removing a developer remaining on said electrophotographic photosensitive drum;

a first frame portion disposed adjacent a first longitudinal end of said photosensitive drum;

a first projection extending outwardly from said first frame portion in a direction coaxial with an axis of said photosensitive drum, said first projection being guided by the first guiding surface while said process cartridge is being mounted to the image forming apparatus, and said second projection being disposed in the second guide surface when said process cartridge is mounted to the image forming apparatus;

a second frame portion disposed adjacent a second longitudinal end of said photosensitive drum opposite said first longitudinal end;

a second projection extending outwardly from said second frame portion in a direction coaxial with the axis of said photosensitive drum, said second projection being guided by the second guiding surface while said process cartridge is being mounted to the image forming apparatus, and said second projection being disposed in the second guide surface when said process cartridge is mounted to the image forming apparatus;

a third frame portion extending between said first frame portion and said second portion;

a pair of rearwardly directed latching portions disposed at a top surface of said third frame portion and spaced apart in a transverse direction of said third frame portion for engaging a corresponding pair of apparatus abutments when said process cartridge is mounted to the image forming apparatus in an operative position to limit pivoting of said process cartridge about said first projection and said second projection; and a contact part provided on said third frame portion side by side with one of said contact portions in said tranverse direction of said third frame portion, wherein said contact part comes into contact with the moving member to move the laser shutter from the shutting position to the opening position and the moving member moves along the surface of said contact part when said process cartridge is mounted to the main assembly of the apparatus, wherein when said process cartridge is mounted to the main assembly of the apparatus, said contact part projects into a higher position than that of the open of said contact portions, and wherein said contact part has an arc-shaped portion portion and a flat upper surface extending in a mounting direction along which said process cartridge is to be mounted to the main assembly of the apparatus, wherein the arc-shaped portion is in the front part of said contact part in the mounting direction, and wherein said contact portions are recesses made in a face of said process cartridge which becomes an upper face of said process cartridge, when said process cartridge is mounted to the main assembly of the apparatus, and wherein at least one of said contact portions provided adjacent said contact part is located on the inside side of said contact part in said tranverse direction of said third portion.

19. A process cartridge according to claim 18, wherein as said process cartridge is advanced along said mounting direction, said arc-shaped portion of said contact part contacts a contact portion of the moving member.

20. A process cartridge according to claim 18, wherein said driving force receiving member of said process cartridge is a protrusion provided on one longitudinal end of said electrophotographic photosensitive drum, and wherein said protrusion engages with a recessed portion provided on the main assembly of the apparatus to receive the rotation driving force when said process cartridge is mounted to the main assembly of the apparatus.

21. A process cartridge according to claim 20, wherein said protrusion of said process cartridge is twisted, and said recessed portion of the main assembly of the apparatus is twisted.

22. A process cartridge according to claim 21, wherein said protrusion of said process cartridge is a twisted substantially triangular prism, and said recessed portion of the main assembly of the apparatus has a substantially triangular-shaped cross-section.

23. The process cartridge according to claim 18, wherein the process cartridge further comprises a frame, wherein said first guide surface is a first guide groove and said second guide surface is a second guide groove, wherein said contact part is a rib, wherein said driving force receiving member is a protrusion provided on one longitudinal end of said electrophotographic photosensitive drum, and wherein said protrusion engages with a recessed portion provided on the main assembly of the apparatus to receive the rotation driving force when said process cartridge is mounted to the main assembly of the apparatus, wherein said protrusion of said process cartridge is a twisted substantially triangular prism, and said recessed portion of the main assembly of the apparatus has a substantially triangular-shaped cross-section, wherein as said process cartridge is advanced along said mounting direction, said arc-shaped portion of said contact part contacts a contact portion of the moving member, and wherein contact between said contact portions and a fixed member provided on the main assembly of said apparatus regulates rotation of said cartridge frame to a same direction as that of rotation of said electrophotographic photosensitive drum and when said electrophotographic photosensitive drum receives the rotation driving force from the main assembly of the apparatus.

24. An electrophotographic image forming apparatus onto which a process cartridge is detachably mountable for forming an image on a recording medium, comprising:

(a) a laser beam emitting member to emit a laser beam;

(b) a laser shutter moveable between a shutting position to shut an optical path of the laser beam emitted by said laser beam emitting member and an opening position to retreat from the shutting position for allowing passage of the laser beam;

(c) a moving member to move said laser shutter from the shutting position to the opening position;

(d) a first guiding surface with a first bearing surface connected thereto;

(e) a second guiding surface with a second bearing surface connected thereto;

(f) a fixing member provided on a main assembly of said apparatus; and (g) a mounting member to detachably mount the process cartridge, the process cartridge having:

an electrophotographic photosensitive drum, a driving force receiving member for receiving a rotation driving force for the electrophotographic photosensitive drum from said main assembly of said apparatus when the process cartridge is mounted to said main assembly of said apparatus, a developing member for developing a latent image formed on the electrophotographic photosensitive drum, a charging member for charging the electrophotographic photosensitive drum, a cleaning member for removing a developer remaining on the electrophotographic photosensitive drum, a first frame portion disposed adjacent a first longitudinal end of the electrophotographic photosensitive drum;

a first projection extending outwardly from the first frame portion in a direction coaxial with an axis of the electrophotographic photosensitive drum, the first projection being guided by said first guiding surface while the process cartridge is being mounted to said image forming apparatus, and the first projection being disposed in said first guide surface when the process cartridge is mounted to said image forming apparatus, a second frame portion disposed adjacent a second longitudinal end of the electrophotographic photosensitive drum opposite the first longitudinal end, a second projection extending outwardly from the second frame portion in a direction coaxial with the axis of the electrophotographic photosensitive drum, the second projection being guided by said second guiding surface while the process cartridge is being mounted to said image forming apparatus, and the second projection being disposed in said second guide surface when the process cartridge is mounted to said image forming apparatus, a third frame portion extending between the first frame portion and the second portion, a pair of rearwardly directed latching portions disposed at a top surface of the third portion and spaced apart in a transverse direction of the third frame portion for engaging a corresponding pair of apparatus abutments when the process cartridge is mounted to said image forming apparatus in an operative position to regulate rotation of the process cartridge about the first projection and the second projection, and a contact part provided on the third frame portion side by side with one of the portions in the transverse direction of the third frame portion, wherein the contact part comes into contact with said moving member to move said laser shutter from the shutting position to the opening position and said moving member runs moves along a surface of the contact part when the process cartridge is mounted to said moving member when the process cartridge is mounted to said main assembly of said apparatus, wherein when the process cartridge is mounted to said main assembly of said apparatus, the contact part projects into a higher position than that of the one of the contact portions, and wherein the contact part has an arc-shaped portion and a flat upper surface extending in a mounting direction along which the process cartridge is to be mounted to said main assembly of said apparatus, wherein the arc-shaped portion is located in the front part of said contact part in the mounting direction, and wherein the contact portions are recesses made in a face of the process cartridge which becomes an upper face of the process cartridge, when the process cartridge is mounted to said main assembly of said apparatus, and wherein at least one contact portion provided adjacent the contact part is located on the inside side of the contact part in the transverse direction of the third frame portion.

25. The apparatus according to claim 24, wherein said process cartridge further comprises a cartridge frame, wherein said first guide surface is a first guide groove and said second guide surface is a second guide groove, wherein said contact part is a rib, wherein said driving force receiving member is a protrusion provided on one longitudinal end of said electrophotographic photosensitive drum, and wherein said protrusions engages with a recessed portion on the main assembly of the apparatus to receive the rotation driving force when said process cartridge is mounted to the main assembly of the apparatus, wherein said protrusion of said process cartridge is a twisted substantially triangular prism, and said recessed portion of the main assembly of the apparatus has a substantially triangular-shaped cross-section, wherein as said process cartridge is advanced along said mounting direction, said arc-shaped portion of said contact part contacts a contact portion of the moving member, and wherein contact between said contact portions and said fixed member regulates rotation of said cartridge to a same direction as that of rotation of said electrophotographic photosensitive drum when said electrophotographic photosensitive drum receives the rotation driving force from the main assembly of the apparatus.

* * * * *

UNITED STATES PATENT AND TRADEMARK OFFICE

CERTIFICATE OF CORRECTION

PATENT NO. : 6,144,398
DATED : November 7, 2000
INVENTOR(S) : Katsunori Yokoyama et al.

It is certified that error appears in the above-identified patent and that said Letters Patent is hereby corrected as shown below:

Title page,
Item [57], ABSTRACT,
Line 3, "tus a" should read -- tus, a --.
Line 9, "fixing" should read -- fixed --.

Column 1,
Line 42, "of apparatus" should read -- of the apparatus --.
Line 52, "mountable of" should read -- mountable on --.
Line 64, "to main" should read -- to the main --.

Column 2,
Line 2, "to main" should read -- to the main --.

Column 3,
Line 34, "embodiment" should read -- embodiments --.

Column 5,
Line 13, "an developing" should read -- a developing --.

Column 6,
Line 30, "extent" should read -- extended --.

Column 7,
Line 3, "mains" should read -- main --.
Line 34, "an partitioning" should read -- a partitioning --.
Line 37, "the-image" should read -- the image --.

Column 10,
Line 36, "respectively" should read -- respectively, --.

Column 12,
Line 22, "opening 11m" should read -- opening 11i --.
Line 32, "located one" should read -- located at one --.
Line 32, "engthwise" should read -- lengthwise --.

UNITED STATES PATENT AND TRADEMARK OFFICE

CERTIFICATE OF CORRECTION

PATENT NO. : 6,144,398
DATED : November 7, 2000
INVENTOR(S) : Katsunori Yokoyama et al.

It is certified that error appears in the above-identified patent and that said Letters Patent is hereby corrected as shown below:

Column 13,
Line 26, "one 9b1 of the journals" should read -- one of the journals 9b1 --.
Line 31, "journal is" should read -- journal which is --.

Column 14,
Line 5, "a tongue" should read -- tongues --.
Line 30, "with hand" should read -- with the hand --.
Line 51, "surface race" should read -- surface --.
Line 52, "width the" should read -- width of the --.

Column 16,
Line 2, "the almost" should read -- almost --.

Column 18,
Line 28, "fit." should read -- fits. --.

Column 22,
Line 9, "prevent on" should read -- prevent an --.

Column 24,
Line 14, "toner prevent" should read -- prevent --.
Line 23, "word." should read -- words. --.
Line 51, "of on" should read -- of --.
Line 61, "come" should read -- comes --.

Column 28,
Line 32, "to end" should read -- to an end --.

Column 29,
Line 4, "the drum" should read -- drum -- and "drum flange" should read -- the drum flange --.
Line 17, "than when" should read -- more than when -- and "born;" should read -- borne; --.
Line 67, "into between" should read -- between --.

UNITED STATES PATENT AND TRADEMARK OFFICE

CERTIFICATE OF CORRECTION

PATENT NO. : 6,144,398
DATED : November 7, 2000
INVENTOR(S) : Katsunori Yokoyama et al.

It is certified that error appears in the above-identified patent and that said Letters Patent is hereby corrected as shown below:

Column 30,
Line 7, "contact to" should read -- contact --.
Line 37, "that outer" should read -- that the outer --.
Line 40, "that large" should read -- that the large --.

Column 31,
Line 15, "it not" should read -- is not --.

Column 32,
Line 8, "inserting" should read -- the inserting --.
Line 46, "the Fig." should read -- Fig. --.

Column 33,
Line 19, "to right-" should read -- to the right- --.
Line 38, "direction" should read -- the direction --.

Column 34,
Line 52, delete "with".
Line 66, "clockwisely pushed" should read -- pushed clockwise --.

Column 35,
Line 11, "contacts with" should read -- contacts --.
Line 28, "capable assuming" should read -- capable of assuming --.
Line 46, "contacting with" should read -- contacting --.
Line 55, "was" should read -- is --.
Line 57, "than that" should read -- more than that --.

Column 36,
Line 47, "followings" should read -- following --.
Line 50, "form" should read -- forms --.

Column 37,
Line 32, "contacting with" should read -- contacting --.
Line 35, "aside of" should read -- aside --.
Line 59, "the such" should read -- such --.

UNITED STATES PATENT AND TRADEMARK OFFICE

CERTIFICATE OF CORRECTION

PATENT NO. : 6,144,398
DATED : November 7, 2000
INVENTOR(S) : Katsunori Yokoyama et al.

It is certified that error appears in the above-identified patent and that said Letters Patent is hereby corrected as shown below:

Column 39,
Line 1, "in" should read -- in the --.
Line 67, "firstly" should be deleted.

Column 40,
Line 6, "inside said" should read -- on the inside side of said --.
Line 27, "the direc-" should read -- the mounting direc- --.
Line 31, "apparatus" should read -- main assembly of the apparatus --.
Line 34, "to a" should read -- to the --.

Column 41,
Line 27, "side by side with" should read -- adjacent --.
Line 34, "member along" should read -- member moves along --.
Line 41, "kept" should be deleted.
Line 56, "bearing" should read -- guide --.
Line 61, "a pparatus" should read -- apparatus --.

Column 42,
Line 1, "for charging member" should be deleted.
Lines 5, 8, 15, 19, 29, 30, 36 and 38 "frame" should be deleted.
Line 10, "surface" should read -- portion --.
Line 12, "second" (both occurrences) should read -- first --.
Line 21, "surface" should read -- portion --.
Line 23, "in" should read -- on --.
Line 26, "frame" (both occurrences) should be deleted.
Line 28, "latching" should read -- contact --.
Line 32, "abutments" should read -- contact members --.
Line 34, "limit pivoting" should read -- regulate rotation --.
Line 37, "tranverse" should read -- transverse --.
Line 47, "the open of" should be deleted.
Line 49, "portion" should be deleted.
Line 61, "tranverse" should read -- transverse --.

Column 43,
Lines 56 and 58, "surface" should read -- portion --, and "bearing" should read -- guide --.

UNITED STATES PATENT AND TRADEMARK OFFICE

CERTIFICATE OF CORRECTION

PATENT NO. : 6,144,398
DATED : November 7, 2000
INVENTOR(S) : Katsunori Yokoyama et al.

It is certified that error appears in the above-identified patent and that said Letters Patent is hereby corrected as shown below:

Column 44,
Lines11, 15, 23, 27, 39 and 47 "frame" should be deleted.
Lines 18 and 30, "surface" should read -- portion --.
Line 20, "disposed in" should read -- disposed on --.
Line 35, "frame" (both occurrences) should be deleted.
Line 37, "latching" should read -- contact --.
Line 40, "abut-" should be deleted.
Line 41, "ments" should read -- contact members --.
Line 45, "frame" should be deleted, and "side" should be deleted.
Line 46, "by side with" should read -- adjacent --, and "portions" should read -- contact portions --.
Line 51, "runs" should be deleted.
Line 53, "moving member when the process cartridge is" should be deleted.
Line 54, "mounted to said" should be deleted.

Column 45,
Line 17, "protrusions" should read -- protrusion --, and "portion on" should read -- portion provided on --.

Signed and Sealed this

Twenty-second Day of January, 2002

*Attest:*

*Attesting Officer*

JAMES E. ROGAN
*Director of the United States Patent and Trademark Office*